US007141789B2

(12) United States Patent
Douglas et al.

(10) Patent No.: US 7,141,789 B2
(45) Date of Patent: Nov. 28, 2006

(54) METHOD AND APPARATUS FOR PROVIDING TWO-DIMENSIONAL SUBSTANTIALLY QUADRUPOLE FIELDS HAVING SELECTED HEXAPOLE COMPONENTS

(75) Inventors: Donald J. Douglas, Vancouver (CA); Chuan-Fan Ding, Vancouver (CA); Frank Londry, Peterborough (CA)

(73) Assignee: MDS Inc., Concord (CA)

( * ) Notice: Subject to any disclaimer, the term of this patent is extended or adjusted under 35 U.S.C. 154(b) by 98 days.

(21) Appl. No.: 10/943,069

(22) Filed: Sep. 17, 2004

(65) Prior Publication Data

US 2005/0067564 A1 Mar. 31, 2005

Related U.S. Application Data

(60) Provisional application No. 60/505,422, filed on Sep. 25, 2003.

(51) Int. Cl.
*H01J 49/00* (2006.01)

(52) U.S. Cl. ..... 250/292; 250/290; 250/281; 250/396 R; 250/288

(58) Field of Classification Search ..... None
See application file for complete search history.

(56) References Cited

U.S. PATENT DOCUMENTS

| | | | |
|---|---|---|---|
| 2,939,952 | A | 8/1960 | Paul et al. |
| 4,234,791 | A | 11/1980 | Enke et al. |
| 4,328,420 | A | 5/1982 | French |
| 4,882,484 | A | 11/1989 | Franzen et al. |
| 5,051,593 | A | 9/1991 | Ishihara |
| 5,170,054 | A | 12/1992 | Franzen |
| 5,179,278 | A | 1/1993 | Douglas |
| 5,420,425 | A | 5/1995 | Bier et al. |
| 5,528,031 | A | 6/1996 | Franzen |
| 5,689,111 | A | 11/1997 | Dresch et al. |
| 5,708,268 | A | 1/1998 | Franzen |
| 5,714,755 | A | 2/1998 | Wells et al. |
| 5,739,530 | A | 4/1998 | Franzen et al. |
| 5,763,878 | A | 6/1998 | Franzen |
| 5,793,048 | A | 8/1998 | Petric et al. |
| 5,825,026 | A | 10/1998 | Baykut |
| 5,838,003 | A | 11/1998 | Bertsch et al. |
| 5,847,386 | A | 12/1998 | Thomson et al. |
| 5,864,136 | A | 1/1999 | Kelley et al. |

(Continued)

FOREIGN PATENT DOCUMENTS

| | | |
|---|---|---|
| EP | 0 290 712 | 11/1988 |

(Continued)

OTHER PUBLICATIONS

D.J. Douglas, T.A. Glebova, N.V. Konenkov and M. Yu. Sudakov, Spatial Harmonics of the Field in a Quadrupole Mass Filter With Circular Electrodes, Technical Physics, Oct. 1999, 1215-1219, vol. 44, No. 10, American Institute of Physics.

(Continued)

*Primary Examiner*—Nikita Wells
*Assistant Examiner*—Zia R. Hashmi
(74) *Attorney, Agent, or Firm*—Bereskin and Parr

(57) ABSTRACT

A method and apparatus for manipulating ions using a two-dimensional substantially quadrupole field, and a method of manufacturing and operating an apparatus for manipulating ions using a two-dimensional substantially quadrupole field are described. The field has a quadrupole harmonic with amplitude $A_2$ and a hexapole harmonic with amplitude $A_3$. The amplitude $A_3$ of the hexapole component of the field is selected to improve the performance of the field with respect to ion selection and ion fragmentation.

62 Claims, 33 Drawing Sheets

U.S. PATENT DOCUMENTS

| | | | | |
|---|---|---|---|---|
| 6,011,259 | A | 1/2000 | Whitehouse et al. | |
| 6,020,586 | A | 2/2000 | Dresch et al. | |
| 6,075,244 | A | 6/2000 | Baba et al. | |
| 6,111,250 | A | 8/2000 | Thomson et al. | |
| 6,177,668 | B1 | 1/2001 | Hager | |
| 6,297,500 | B1 | 10/2001 | Franzen et al. | |
| 6,340,814 | B1 | 1/2002 | Vandermey | |
| 6,403,955 | B1 | 6/2002 | Senko | |
| 6,504,148 | B1 | 1/2003 | Hager | |
| 7,019,289 | B1 * | 3/2006 | Wang | 250/290 |
| 2002/0175279 | A1 | 11/2002 | Hager | |
| 2002/0185596 | A1 | 12/2002 | Amy et al. | |
| 2003/0042415 | A1 | 3/2003 | Hager | |
| 2003/0189168 | A1 | 10/2003 | Londry et al. | |
| 2003/0189171 | A1 | 10/2003 | Londry et al. | |
| 2004/0051036 | A1 | 3/2004 | Franzen et al. | |

FOREIGN PATENT DOCUMENTS

| | | |
|---|---|---|
| WO | WO 97/07530 | 2/1997 |
| WO | WO 2004/013891 | 2/2004 |

OTHER PUBLICATIONS

Ma'an H, Amad and R.S. Houk, High-Resolution Mass Spectrometry With a Multiple Pass Quadrupole Mass Analyzer, Analytical Chemistry, Dec. 1, 1998, 4885-4889, vol. 70, No. 23, American Chemical Society.

Ma'an H. Amad and R.S. Houk, Mass Resolution of 11,000 to 22,000 With a Multiple Pass Quadrupole Mass Analyzer, American Society for Mass Spectrometry, 2000, 407-415, vol. 11, Elsevier Science Inc.

Jae C. Schwartz, Michael W. Senko and John E.P. Syka, A Two-Dimensional Quadrupole Ion Trap Mass Spectrometer. American Society for Mass Spectrometry, 2002, 659-669, vol. 13, Elsevier Science Inc.

J.M. Campbell, B.A. Collings and D.J. Douglas, A New Linear Ion Trap Time-of-Flight System With Tandem Mass Spectrometry Capabilities, Rapid Communications in Mass Spectrometry, 1998, 1463-1474, vol. 12, John Wiley & Sons, Ltd.

B.A. Collings, J.M. Campbell, Dunmin Mao and D.J. Douglas, A Combined Linear Ion Trap Time-of-Flight System With Improved Performance and MS Capabilities, Rapid Communications in Mass Spectrometry, 2001, 1777-1795, vol. 15, John Wiley & Sons, Ltd.

M.A.N. Razvi, X.Z. Chu, R. Alheit, G. Werth and R. Blumel, Fractional Frequency Collective Parametric Resonances of an Ion Cloud in a Paul Trap, Physical Review A, Jul. 1998, R34-R37, vol. 58, The American Physical Society.

P.H. Dawson and N.R. Whetten, Non-Linear Resonances in Quadrupole Mass Spectrometers Due to Imperfect Fields, International Journal of Mass Spectrometry and Ion Physics, 1969, 1-12, vol. 3, Elsevier Publishing Company.

P.H. Dawson, Ion Optical Properties of Quadrupole Mass Filters, Advances in Electronics and Electron Physics, 1980, 153-208, vol. 53, Academic Press, Inc.

M. Sudakov, N. Konenkov, D.J. Douglas and T. Glebova, Excitation Frequencies of Ions Confined in a Quadrupole Field With Quadrupole Excitatilon, American Society for Mass Spectrometry, 2000, 10-18, vol. 11, Elsevier Science Inc.

D.J. Douglas, and J.B. French, Collisional Focusing Effects in Radio Frequency Quadrupoles, American Society for Mass Spectrometry, 1992, 398-408, vol. 3.

James Hager, Mass Spectrometry Using a Linear RF Quadrupole Ion Trap With Axial Ion Ejection, Presented at the 46th ASMS Conference on Mass Spectrometry and Allied Topics, May 31-Jun. 4, 2003, Orlando, Florida.

James W. Hager, Performance Optimization and Fringing Field Modifications of a 24-mm Long RF-only Quadrupole Mass Spectrometer, Rapid Commun. Mass Spectrom, 1999, 740-748, vol. 13, John Wiley & Sons, Ltd.

James W. Hager, A New Linear Ion Trap Mass Spectrometer, Rapid Commun. Mass Spectrom, 2002, 512-526, vol. 16, John Wiley & Sons, Ltd.

D.A. Church, Storage-Ring Ion Trap Derived From the Linear Quadrupole Radio-Frequency Mass Filter, Journal of Applied Physics, Jul. 1969, 3127-3134, vol. 40.

B.I. Deutch, F.M. Jacobsen, L.H. Andersen, P. Hvelplund and H. Knudsen, Antihydrogen Production by Positronium-Antriproton Collision in an Ion Trap, Physica Scripta, 1988, 248-255, vol. T22.

I. Waki, S. Kassner, G. Birkl and H. Walther, Observation of Ordered Structures of Laser-Cooled Ions in a Quadrupole Stroage Ring, Physical Review Letters, Mar. 30, 1992, 2007-2013, vol. 68.

James W. Hager and J.C. Yves Le Blanc, Product Ion Scanning Using a Q-q-Qlinear ion trap (Q TRAP) Mass Spectrometer, Rapid. Commun. Mass Spectrom, 1056-1064, vol. 17, published online by Wiley InterScience.

Stephen A. Lammert, Wolfgang R. Plass, Cyril V. Thompson, Marcus B. Wise, Design, Optimization and Initial Performance of a Toroidal RF Ion Trap Mass Spectrometer, International Journal of Mass Spectrometry, 2001, 25-40, vol. 212.

Bruce E. Wilcox, Christopher L. Hendrickson and Alan G. Marshall, "Improved Ion Extraction From a Linear Octopole Ion Trap:SIMION Analysis and Experimental Demonstration", Journal of The American Society For Mass Spectrometry, Nov. 2002, 1304-1312, vol. 13, No. 11, Elsevier Science Inc., New York, New York.

M. Sudakov, Effective Potential and the Ion Axial Beat Motion Near the Boundary of the First Stable Region in a Nonlinear Ion Trap, International Journal of Mass Spectrometry, 2001, 27-43, vol. 206, Elsevier Science B.V.

B.A. Collings and D.J. Douglas, Observation of Higher Order Quadrupole Excitation Frequencies in a Linear Ion Trap, Journal of The American Society for Mass Spectrometry, Nov. 2000, 1016-1022, vol. 11, Elsevier Science Inc.

D.J. Douglas and N.V. Konenkov, Influence of the 6th and 10th Spatial Harmonics on the Peak Shape of a Quadrupole Mass Filter With Round Rods, Rapid Communications in Mass Spectrometry, 2002, 1425-1431, vol. 16, Wiley InterScience.

P.H. Dawson ed., Quadrupole Mass Spectrometry and Its Applications, American Vacuum Society Classics, 1976, Elsevier Publishing Company, Amsterdam and 1995 by the American Institute of Physics, 19-23 and 70.

Raymond E. March and Richard J. Hughes, Quadrupole Storage Mass Spectrometry, The Quadrupole Mass Filter, 1989, 41, John Wiley and Sons, Toronto.

L. Landau and E.M. Lifshitz, Mechanics, Third Edition, 1966, 80-87, vol. 1, Pergamon Press, Oxford.

Raymond E. March and Frank A. Londry, Theory of Quadrupole Mass Spectrometry, Practical Aspects of Mass Spectrometry, J.F.J. Todd and R.E. March ed., 1995, Chapter 2, CRC Press, Boca Raton.

J. Franzen, R.H. Gabling, M. Schubert and Y. Wang, Nonlinear Ion Traps, Practical Aspects of Mass Spectrometry, J.F. J. Todd and R.E. March ed., 1995, Chapter 3, CRC Press, Boca Raton.

Jodie V. Johnson, Randall Pedder, Richard Yost, The Stretched Quadrupole Ion Trap: Implications for the Mathieu $a_u$ and $q_u$ Parameters and Experimental Mapping of the Stability Diagram, Rapid Communications in Mass Spectrometry, 1992, vol. 6, 670.

Y. Wang and J. Franzen, The Non-Linear Resonance QUISTOR Part 1, Potential Distribution in Hyperboloidal QUISTORs, International Journal of Mass Spectrometry and Ion Processes, 1992, vol. 112, 167.

Y. Wang, J. Franzen, K.P. Wanczek, The Non-Linear Resonance Ion Trap. Part 2. A General Theoretical Analysis, International Journal of Mass Spectrometry and Ion Processes, 1993, vol. 124, 125.

Y. Wang, J. Franzen, The Nonlinear Ion Trap. Part 3. Multipole Components in Three Types of Practical Ion Trap, International Journal of Mass Spectrometry and Ion Processes, 1994, vol. 132, 155.

J. Franzen, The Non-Linear Ion Trap. Part 4, Mass Selective Instability Scan With Multipole Superposition, International Journal of Mass Spectrometry and Ion Processes, 1993, vol. 125, 165.

J. Franzen, The Non-Linear Ion Trap. Part 5, Nature of Non-Linear Resonances and Resonant Ion Ejection International Journal of Mass Spectrometry and Ion Processes, 1994, vol. 130, 15.
J. Franzen, Simulation Study of an Ion Cage With Superimposed Multipole Fields, International Journal of Mass Spectrometry and Ion Processes, 1991, vol. 106, 63.
M. Splendore, F.A. Londry, R.E. March, R.J.S. Morrison, P. Perrier, J. André, A Simulation Study of Ion Kinetic Energies During Resonant Excitation in a Stretched Ion Trap, International Journal of Mass Spectrometry and Ion Processes, 1996, 11-29, vol. 156, Elsevier Science B.V.
S. Sevugarajan, A.G. Menon, Field Imperfection Induced Axial Secular Frequency Shifts in Nonlinear Ion Traps, International Journal of Mass Spectrometry, 1999, 53-61, vol. 189, Elsevier Science B.V.
S. Sevugarajan, A.G. Menon, Frequency Perturbation in Nonlinear Paul Traps: A Simulation Study of the Effect of Geometric Aberration, Space Charge, Dipolar Excitation, and Damping On Ion Axial Secular Frequency, International Journal of Mass Spectrometry, 2000, 263-278, vol. 197, Elsevier Science B.V.
S. Sevugarajan, A.G. Menon, A Simulation Study of Coupled Secular Oscillations in Nonlinear Paul Trap Mass Spectrometers, International Journal of Mass Spectrometry, 2001, 209-226, vol. 209, Elsevier Science B.V.
S. Sevugarajan, A.G. Menon, Transition Curves and *ISO*—$\beta_u$ Lines in Nonlinear Paul Traps, International Journal of Mass Spectrometry, 2002, 181-196, vol. 218, Elsevier Science B.V.
D.J. Douglas, T.A. Glebova, N.V. Konenkov and M. Yu. Sudakov, Spatial Harmonics of the Field in a Quadrupole Mass Filter With Circular Electrodes, Technical Physics, Oct. 1999, 1215-1219, vol. 44, No. 10, American Institute of Physics.
Ma'an H. Amad and R.S. Houk, High-Resolution Mass Spectrometry With a Multiple Pass Quadrupole Mass Analyzer, Analytical Chemistry, Dec. 1, 1998, 4885-4889, vol. 70, No. 23, American Chemical Society.
Ma'an H. Amad and R.S. Houk, Mass Resolution of 11, 000 to 22, 000 With a Multiple Pass Quadrupole Mass Analyzer, American Society for Mass Spectrometry, 2000, 407-415, vol. 11, Elsevier Science Inc.
Jae C. Schwartz, Michael W. Senko and John E.P. Syka, A Two-Dimensional Quadrupole Ion Trap Mass Spectrometer, American Society for Mass Spectrometry, 2002, 659-669, vol. 13, Elsevier Science Inc.
J.M. Campbell, B.A. Collings and D.J. Douglas, A New Linear Ion Trap Time-of-Flight System With Tandem Mass Spectrometry Capabilities, Rapid Communications in Mass Spectrometry, 1998, 1463-1474, vol. 12, John Wiley & Sons, Ltd.
B.A. Collings, J.M. Campbell, Dunmin Mao and D.J. Douglas, A Combined Linear Ion Trap Time-of-Flight System Wth Improved Performance and MS Capabilities, Rapid Communications in Mass Spectrometry, 2001, 1777-1795, vol. 15, John Wiley & Sons, Ltd.
M.A.N. Razvi, X.Z. Chu, R. Alheit, G. Werth and R. Blumel, Fractional Frequency Collective Parametric Resonances of an Ion Cloud in a Paul Trap, Physical Review A, Jul. 1998, R34-R37, vol. 58, The American Physical Society.
P.H. Dawson and N.R. Whetten, Non-Linear Resonances in Quadrupole Mass Spectrometers Due to Imperfect Fields, International Journal of Mass Spectrometry and Ion Physics, 1969, 1-12, vol. 3, Elsevier Publishing Company.
P.H. Dawson, Ion Optical Properties of Quadrupole Mass Filters, Advances in Electronics and Electron Physics, 1980, 153-208, vol. 53, Academic Press, Inc.
M. Sudakov, N. Konenkov, D.J. Douglas and T. Glebova, Excitation Frequencies of Ions Confined in a Quadrupole Field With Quadrupole Excitatiion, American Society for Mass Spectrometry, 2000, 10-18, vol. 11, Elsevier Science Inc.
D.J. Douglas, and J.B. French, Collisional Focusing Effects in Radio Frequency Quadrupoles, American Society for Mass Spectrometry, 1992, 398-408, vol. 3.
James Hager, Mass Spectrometry Using a Linear RF Quadrupole Ion Trap With Axial Ion Ejection, Presented at the 46th ASMS Conference on Mass Spectrometry and Allied Topics, May 31-Jun. 4, 2003, Orlando, Florida.
James W. Hager, Performance Optimization and Fringing Field Modifications of a 24-mm Long RF-only Quadrupole Mass Spectrometer, Rapid Commun. Mass Spectrom, 1999, 740-748, vol. 13, John Wiley & Sons, Ltd.
James W. Hager, A New Linear Ion Trap Mass Spectrometer, Rapid Commun. Mass Spectrom, 2002, 512-526, vol. 16, John Wiley & Sons, Ltd.
D.A. Church, Storage-Ring Ion Trap Derived From the Linear Quadrupole Radio-Frequency Mass Filter, Journal of Applied Physics, Jul. 1969, 3127-3134, vol. 40.
B.I. Deutch, F.M. Jacobsen, L.H. Andersen, P. Hvelplund and H. Knudsen, Antihydrogen Production by Positronium-Antriproton Collision in an Ion Trap, Physica Scripta, 1988, 248-255, vol. T22.
I. Waki, S. Kassner, G. Birkl and H. Walther, Observation of Ordered Structures of Laser-Cooled Ions in a Quadrupole Storage Ring, Physical Review Letters, Mar. 30, 1992, 2007-2013, vol. 68.
James W. Hager and J.C. Yves Le Blanc, Product Ion Scanning Using a Q-q-Qlinear ion trap (Q Trap) Mass Spectrometer, Rapid. Commun. Mass Spectrom, 1056-1064, vol. 17, published online by Wiley InterScience.
Stephen A. Lammert, Wolfgang R. Plass, Cyril V. Thompson, Marcus B. Wise, Design, Optimization and Initial Performance of a Toroidal RF Ion Trap Mass Spectrometer, International Journal of Mass Spectrometry, 2001, 25-40, vol. 212.
Bruce E. Wilcox, Christopher L. Hendrickson and Alan G. Marshall, "Improved Ion Extraction From a Linear Octopole Ion Trap:Simion Analysis and Experimental Demonstration", Journal of The American Society For Mass Spectrometry, Nov. 2002, 1304-1312, vol. 13, No. 11, Elsevier Science Inc. New York, New York.
M. Sudakov, Effective potential and the Ion Axial Beat Motion Near the Boundary of the First Stable Region in a Nonlinear Ion Trap, International Journal of Mass Spectrometry, 2001, 27-43, vol. 206, Elsevier Science B.V.
B.A. Collings and D.J. Douglas, Observation of Higher Order Quadrupole Excitation Frequencies in a Linear Ion Trap, Journal of The American Society for Mass Spectrometry, Nov. 2000, 1016-1022, vol. 11, Elsevier Science Inc.
D.J. Douglas and N.V. Konenkov, Influence of the 6th and 10th Spatial Harmonics on the Peak Shape of a Quadrupole Mass Filter With Round Rods, Rapid Communications in Mass Spectrometry, 2002, 1425-1431, vol. 16, Wiley InterScience.
P.H. Dawson ed., Quadrupole Mass Spectrometry and Its Applications, American Vacuum Society Classics, 1976, Elsevier Publishing Company, Amsterdam and 1995 by the American Institute of Physics, 19-23 and 70.
Raymond E. March and Richard J. Hughes, Quadrupole Storage Mass Spectrometry, The Quadrupole Mass filter, 1989, 41, John Wiley and Sons, Toronto.
L. Landau and E.M. Lifshitz, Mechanics, Third Edition, 1966, 80-87, vol. 1, Pergamon Press, Oxford.
Raymond E. March and Frank A. Londry, Theory of Quadrupole Mass Spectrometry, Practical Aspects of Mass Spectrometry, J.F.J. Todd and R.E. March ed., 1995, Chapter 2, CRC Press, Boca Raton.
J. Franzen, R.H. Gabling, M. Schubert and Y. Wang, Nonlinear Ion Traps, Practical Aspects of Mass Spectrometry, J.F.J. Todd and R.E. March ed., 1995, Chapter 3, CRC Press, Boca Raton.
Jodie V. Johnson, Randall Pedder, Richard Yost, The Stretched Quadrupole Ion Trap: Implications for the Mathleu $a_{\cup}$ and $q_{\cup}$Parameters and Experimental Mapping of the Stability Diagram, Rapid Communications in Mass Spectrometry, 1992, vol. 6, 670.
Y. Wang and J. Franzen, The Non-Linear Resonance Quistor Part 1, Potential Distribution in Hyperboloidal Quistors, International Journal of Mass Spectrometry and Ion Processes, 1992, vol. 112, 167.
Y. Wang, J. Franzen, K.P. Wanczek, The Non-Linear Resonance Ion Trap. Part 2, A General Theoretical Analysis, International Journal of Mass Spectrometry and Ion Processes, 1993, vol. 124, 125.
Y. Wang, J. Franzen, The Nonlinear Ion Trap, Part 3, Multipole Components in Three Types of Practical Ion Trap, International Journal of Mass Spectrometry and Ion Processes, 1994, vol. 132, 155.
J. Franzen, The Non-Linear Ion Trap. Part 4, Mass Selective Instability Scan With Multipole Superposition, International Journal of Mass Spectrometry and Ion Processes, 1993, vol. 125, 165.

J. Franzen, The Non-Linear Ion Trap, Part 5, Nature of Non-Linear Resonances and Resonant Ion Ejection International Journal of Mass Spectrometry and Ion Processes, 1994, vol. 130, 15.

J. Franzen, Simulation Study of an Ion Cage With Superimposed Multipole Fields, International Journal of Mass Spectrometry and Ion Processes, 1991, vol. 106, 63.

M. Splendore, F.A. Londry, R.E. March, R.J.S. Morrison, P. Perrier, J. André, A Simulation Study of Ion Kinetic Energies During Resonant Excitation In a Stretched Ion Trap, International Journal of Mass Spectrometry and Ion Processes, 1996, 11-29, vol. 156, Elsevier Science B.V.

S. Sevugarajan, A.G. Menon, Field Imperfection Induced Axial Secular Frequency Shifts in Nonlinear Ion Traps, International Journal of Mass Spectrometry, 1999, 53-61, vol. 189, Elsevier Science B.V.

S. Sevugarajan, A.G. Menon, Frequency Perturbation in Nonlinear Paul Traps: A Simulation Study of the Effect of Geometric Aberration, Space Charge, Dipolar Excitation, and Damping On Ion Axial Secular Frequency, International Journal of Mass Spectrometry, 2000, 263-278, vol. 197, Elsevier Science B.V.

S. Sevugarajan, A.G. Menon, A Simulation Study of Coupled Secular Oscillations in Nonlinear Paul Trap Mass Spectrometers, International Journal Mass Spectrometry, 2001, 209-226, vol. 209, Elsevier Science B.V.

S. Sevugarajan, A.G. Menon, Transition Curves iso —$\beta_u$ Lines in Nonlinear Paul Traps, International Journal of Mass Spectrometry, 2002, 181-196, vol. 218, Elsevier Science B.V.

* cited by examiner

Rod geometries of a linear quadrupole with (1) $A_2$=98%, $A_3$=+2%; (2) $A_2$=95%, $A_3$=+5%; (3) $A_2$=90%, $A_3$=+10%.

Rod geometries of a linear quadrupole with $A_2$=98%, $A_3$=+2%:

Rod geometries of a linear quadrupole with (1) $A_2$=95%, $A_3$=-5%;

Rod shapes of $A_2$=0.96,$A_3$=0.02 and $A_4$=0.02.

METHOD AND APPARATUS FOR PROVIDING TWO-DIMENSIONAL SUBSTANTIALLY QUADRUPOLE FIELDS HAVING SELECTED HEXAPOLE COMPONENTS

FIELD OF THE INVENTION

This invention relates in general to quadrupole fields, and more particularly to quadrupole electrode systems for generating improved quadrupole fields for use in mass spectrometers.

BACKGROUND OF THE INVENTION

The use of quadrupole electrode systems in mass spectrometers is known. For example, U.S. Pat. No. 2,939,952 (Paul et al.) describes a quadrupole electrode system in which four rods surround and extend parallel to a quadrupole axis. Opposite rods are coupled together and brought out to one of two common terminals. Most commonly, an electric potential V(t)=+(U−V cos Ωt) is then applied between one of these terminals and ground and an electric potential V(t)=−(U−V cos Ωt) is applied between the other terminal and ground. In these formulae, U is a DC voltage, pole to ground, and V is a zero to peak AC voltage, pole to ground, and ω is the angular frequency of the AC. The AC component will normally be in the radio frequency (RF) range, typically about 1 MHz.

In constructing a linear quadrupole, the field may be distorted so that it is not an ideal quadrupole field. For example round rods are often used to approximate the ideal hyperbolic shaped rods required to produce a perfect quadrupole field. The calculation of the potential in a quadrupole system with round rods can be performed by the method of equivalent charges—see, for example, Douglas et al., *Russian Journal of Technical Physics,* 1999, Vol. 69, 96–101. When presented as a series of harmonic amplitudes $A_0, A_1, A_2 \ldots A_n$, the potential in a linear quadrupole can be expressed as follows:

$$\phi(x, y, z, t) = V(t) \times \phi(x, y) = V(t) \sum_n \phi_n(x, y) \tag{1}$$

Field harmonics $\phi_n$, which describe the variation of the potential in the X and Y directions, can be expressed as follows:

$$\phi_n(x, y) = \text{Real}\left[A_n\left(\frac{x+iy}{r_0}\right)^n\right] \tag{2}$$

where Real [(f (x+iy)] is the real part of the complex function f(x+iy).

For example:

$$\phi_0(x, y) = A_0\text{Real}\left[\left(\frac{x+iy}{r_0}\right)^0\right] = A_0 \text{ Constant potential} \tag{3}$$

$$\phi_1(x, y) = A_1\text{Real}\left[\left(\frac{x+iy}{r_0}\right)^1\right] = \frac{A_1 x}{r_0} \text{ Dipole potential} \tag{3.1}$$

-continued $$\phi_2(x, y) = A_2\text{Real}\left[\left(\frac{x+iy}{r_0}\right)^2\right] = A_2\left(\frac{x^2-y^2}{r_0^2}\right) \text{ Quadrupole} \tag{4}$$

$$\phi_3(x, y) = A_3\text{Real}\left[\left(\frac{x+iy}{r_0}\right)^3\right] = A_3\left(\frac{x^3-3xy^2}{r_0^3}\right) \text{ Hexapole} \tag{5}$$

$$\phi_4(x, y) = A_4\text{Real}\left[\left(\frac{x+iy}{r_0}\right)^4\right] = A_4\left(\frac{x^4-6x^2y^2+y^4}{r_0^4}\right) \text{ Octopole} \tag{6}$$

In these definitions, the X direction corresponds to the direction towards an electrode in which the potential $A_n$ increases to become more positive when V(t) is positive.

As shown above, $A_0$ is the constant potential (i.e. independent of X and Y), $A_1$ is the dipole potential, $A_2$ is the quadrupole component of the field, $A_3$ is the hexapole component of the field $A_4$ is the octopole component of the field, and there are still higher order components of the field, although in a practical quadrupole the amplitudes of the higher order components are typically small compared to the amplitude of the quadrupole term.

In a quadrupole mass filter, ions are injected into the field along the axis of the quadrupole. In general, the field imparts complex trajectories to these ions, which trajectories can be described as either stable or unstable. For a trajectory to be stable, the amplitude of the ion motion in the planes normal to the axis of the quadrupole must remain less than the distance from the axis to the rods ($r_0$). Ions with stable trajectories will travel along the axis of the quadrupole electrode system and may be transmitted from the quadrupole to another processing stage or to a detection device. Ions with unstable trajectories will collide with a rod of the quadrupole electrode system and will not be transmitted.

The motion of a particular ion is controlled by the Mathieu parameters a and q of the mass analyzer. For positive ions, these parameters are related to the characteristics of the potential applied from terminals to ground as follows:

$$a_x = -a_y = a = \frac{8\text{ eU}}{m_{ion}\Omega^2 r_0^2} \text{ and } q_x = -q_y = q = \frac{4\text{ eV}}{m_{ion}\Omega^2 r_0^2} \tag{7}$$

where e is the charge on an ion, $m_{ion}$ is the ion mass, Ω=2πf where f is the AC frequency, U is the DC voltage from a pole to ground and V is the zero to peak AC voltage from each pole to ground. If the potentials are applied with different voltages between pole pairs and ground, then in equation (7) U and V are ½ of the DC potential and the zero to peak AC potential respectively between the rod pairs. Combinations of a and q which give stable ion motion in both the X and Y directions are usually shown on a stability diagram.

With operation as a mass filter, the pressure in the quadrupole is kept relatively low in order to prevent loss of ions by scattering by the background gas. Typically the pressure is less than $5\times10^{-4}$ torr and preferably less than $5\times10^{-5}$ torr. More generally quadrupole mass filters are usually operated in the pressure range $1\times10^{-6}$ torr to $5\times10^{-4}$ torr. Lower pressures can be used, but the reduction in scattering losses below $1\times10^{-6}$ torr are usually negligible.

As well, when linear quadrupoles are operated as a mass filter the DC and AC voltages (U and V) are adjusted to place ions of one particular mass to charge ratio just within the tip of a stability region, as described. Normally, ions are continuously introduced at the entrance end of the quadrupole and continuously detected at the exit end. Ions are not normally confined within the quadrupole by stopping potentials at the entrance and exit. An exception to this is shown in the papers Ma'an H. Amad and R. S. Houk, "High Resolution Mass Spectrometry With a Multiple Pass Quadrupole Mass Analyzer", *Analytical Chemistry,* 1998, Vol. 70, 4885–4889, and Ma'an H. Amad and R. S. Houk, "Mass Resolution of 11,000 to 22,000 With a Multiple Pass Quadrupole Mass Analyzer", *Journal of the American Society for Mass Spectrometry,* 2000, Vol. 11, 407–415. These papers describe experiments where ions were reflected from electrodes at the entrance and exit of the quadrupole to give multiple passes through the quadrupole to improve the resolution. Nevertheless, the quadrupole was still operated at low pressure, although this pressure is not stated in these papers, and with the DC and AC voltages adjusted to place the ions of interest at the tip of the first stability region.

In contrast, when linear quadrupoles are operated as ion traps, the DC and AC voltages are normally adjusted so that ions of a broad range of mass to charge ratios are confined. Ions are not continuously introduced and extracted. Instead, ions are first injected into the trap (or created in the trap by fragmentation of other ions, as described below, or by ionization of neutrals). Ions are then processed in the trap, and are subsequently removed from the trap by a mass selective scan, or allowed to leave the trap for additional processing or mass analysis, as described. Ion traps can be operated at much higher pressures than quadrupole mass filters, for example $3\times10^{-3}$ torr of helium (J. C. Schwartz, M. W. Senko, J. E. P. Syka, "A Two-Dimensional Quadrupole Ion Trap Mass Spectrometer", *Journal of the American Society for Mass Spectrometry,* 2002, Vol. 13, 659–669; published online Apr. 26, 2002 by Elsevier Science Inc.) or up to $7\times10^{-3}$ torr of nitrogen (Jennifer Campbell, B. A. Collings and D. J. Douglas, "A New Linear Ion Trap Time of Flight System With Tandem Mass Spectrometry Capabilities", *Rapid Communications in Mass Spectrometry,* 1998, Vol. 12, 1463–1474; B. A. Collings, J. M. Campbell, Dunmin Mao and D. J. Douglas, "A Combined Linear Ion Trap Time-of-Flight System With Improved Performance and $MS^n$ Capabilities", *Rapid Communications in Mass Spectrometry,* 2001, Vol. 15, 1777–1795. Typically, ion traps operate at pressures of $10^{-1}$ torr or less, and preferably in the range $10^{-5}$ to $10^{-2}$ torr. More preferably ion traps operate in the pressure range $10^{-4}$ to $10^{-2}$ torr. However ion traps can still be operated at much lower pressures for specialized applications (e.g. $10^{-9}$ mbar (1 mbar=0.75 torr) M. A. N. Razvi, X. Y. Chu, R. Alheit, G. Werth and R. Blumel, "Fractional Frequency Collective Parametric Resonances of an Ion Cloud in a Paul Trap", *Physical Review A,* 1998, Vol. 58, R34–R37). For operation at higher pressures, gas can flow into the trap from a higher pressure source region or can be added to the trap through a separate gas supply and inlet.

Recently, there has been interest in performing mass selective scans by ejecting ions at the stability boundary of a two-dimensional quadrupole ion trap (see, for example, U.S. Pat. No. 5,420,425 (Bier et al., issued May 30, 1995); J. C. Schwartz, M. W. Senko, J. E. P. Syka, "A Two-Dimensional Quadrupole Ion Trap Mass Spectrometer", *Journal of the American Society for Mass Spectrometry,* 2002, Vol. 13, 659–669; published online Apr. 26, 2002 by Elsevier Science Inc.). In the two-dimensional ion trap, ions are confined radially by a two-dimensional quadrupole field and are confined axially by stopping potentials applied to electrodes at the ends of the trap. Ions are ejected through an aperture or apertures in a rod or rods of a rod set to an external detector by increasing the AC voltage so that ions reach their stability limit and are ejected to produce a mass spectrum.

Ions can also be ejected through an aperture or apertures in a rod or rods by applying an auxiliary or supplemental excitation voltage to the rods to resonantly excite ions at their frequencies of motion, as described below. This can be used to eject ions at a particular q value, for example q=0.8. By adjusting the trapping AC voltage, ions of different mass to charge ratio are brought into resonance with the excitation voltage and are ejected to produce a mass spectrum. Alternatively the excitation frequency can be changed to eject ions of different masses. Most generally the frequencies, amplitudes and waveforms of the excitation and trapping voltages can be controlled to eject ions through a rod or rods in order to produce a mass spectrum.

Mass spectrometry (MS) will often involve the fragmentation of ions and the subsequent mass analysis of the fragments (tandem mass spectrometry). Frequently, selection of ions of a specific mass to charge ratio or ratios is used prior to ion fragmentation caused by Collision Induced Dissociation (CID) with a collision gas or other means (for example, by collisions with surfaces or by photodissociation with lasers). This facilitates identification of the resulting fragment ions as having been produced from fragmentation of a particular precursor ion. In a triple quadrupole mass spectrometer system, ions are mass selected with a quadrupole mass filter, collide with gas in an ion guide, and mass analysis of the resulting fragment ions takes place in an additional quadrupole mass filter. The ion guide is usually operated with AC only voltages between the electrodes to confine ions of a broad range of mass to charge ratios in the directions transverse to the ion guide axis, while transmitting the ions to the downstream quadrupole mass analyzer. In a three-dimensional ion trap mass spectrometer, ions are confined by a three-dimensional quadrupole field, a precursor ion is isolated by resonantly ejecting all other ions or by other means, the precursor ion is excited resonantly or by other means in the presence of a collision gas and fragment ions formed in the trap are subsequently ejected to generate a mass spectrum of fragment ions. Tandem mass spectrometry can also be performed with ions confined in a linear quadrupole ion trap. The quadrupole is operated with AC only voltages between the electrodes to confine ions of a broad range of mass to charge ratios. A precursor ion can then be isolated by resonant ejection of unwanted ions or other methods. The precursor ion is then resonantly excited in the presence of a collision gas or excited by other means, and fragment ions are then mass analyzed. The mass analysis can be done by allowing ions to leave the linear ion trap to enter another mass analyzer such as a time-of-flight mass analyzer (Jennifer Campbell, B. A. Collings and D. J. Douglas, "A New Linear Ion Trap Time of Flight System With Tandem Mass Spectrometry Capabilities", *Rapid Communications in Mass Spectrometry,* 1998, Vol. 12, 1463–1474; B. A. Collings, J. M. Campbell, Dunmin Mao and D. J. Douglas, "A Combined Linear Ion Trap Time-of-Flight System With Improved Performance and $MS^n$ Capabilities", *Rapid Communications in Mass Spectrometry,* 2001, Vol. 15, 1777–1795) or by ejecting the ions through an aperture or apertures in a rod or rods to an external ion detector (M. E. Bier and John E. P. Syka, U.S. Pat. No. 5,420,425, May 30, 1995; J. C. Schwartz, M. W. Senko, J. E. P. Syka, "A Two-Dimensional Quadrupole Ion Trap Mass Spectrometer", *Journal of the American Society for Mass*

*Spectrometry,* 2002, Vol. 13, 659–669; published online Apr. 26, 2002 by Elsevier Science Inc.). Alternatively, fragment ions can be ejected axially in a mass selective manner (J. Hager, "A New Linear Ion Trap Mass Spectrometer", *Rapid Communications in Mass Spectrometry,* 2002, Vol. 16, 512–526 and U.S. Pat. No. 6,177,668, issued Jan. 23, 2001 to MDS Inc.). The term $MS^n$ has come to mean a mass selection step followed by an ion fragmentation step, followed by further ion selection, ion fragmentation and mass analysis steps, for a total of n mass analysis steps.

Similar to mass analysis, CID is assisted by moving ions through a radio frequency field, which confines the ions in two or three dimensions. However, unlike conventional mass analysis in a linear quadrupole mass filter, which uses fields to impart stable trajectories to ions having the selected mass to charge ratio and unstable trajectories to ions having unselected mass to charge ratios, quadrupole fields when used with CID are operated to provide stable but oscillatory trajectories to ions of a broad range of mass to charge ratios. In two-dimensional ion traps, resonant excitation of this motion can be used to fragment the oscillating ions. However, there is a trade off in the oscillatory trajectories that are imparted to the ions. If a very low amplitude motion is imparted to the ions, then little fragmentation will occur. However, if a larger amplitude oscillation is provided, then more fragmentation will occur, but some of the ions, if the oscillation amplitude is sufficiently large, will have unstable trajectories and will be lost. There is a competition between ion fragmentation and ion ejection. Thus, both the trapping and excitation fields must be carefully selected to impart sufficient energy to the ions to induce fragmentation, while not imparting so much energy as to lose the ions. In some instruments (J. Hager, "A New Linear Ion Trap Mass Spectrometer", *Rapid Communications in Mass Spectrometry,* 2002, Vol. 16, 512–526), with some modes of operation, it is desirable to use a linear quadrupole rod set as an ion trap to resonantly excite ions for MS/MS and in other modes to use the same rod set as a mass filter.

Accordingly, there is a continuing need to improve the two-dimensional quadrupole fields for ion traps in terms of ion fragmentation without losing the capability of using the same field for mass analysis. Specifically, for ion fragmentation in a linear ion trap, a quadrupole electrode system that provides a field that provides an oscillatory motion that is energetic enough to induce fragmentation while stable enough to prevent ion ejection, is desirable. The same electrode system should be capable of operation as a mass filter.

SUMMARY OF THE INVENTION

An object of a first aspect of the present invention is to provide an improved quadrupole electrode system.

In accordance with this aspect of the present invention, there is provided, a quadrupole electrode system for connection to a voltage supply means for providing an at least partially-AC potential difference within the quadrupole electrode system. The quadrupole electrode system comprises (a) a quadrupole axis; (b) a first pair of rods, wherein each rod in the first pair of rods is spaced from and extends alongside the quadrupole axis; (c) a second pair of rods, wherein each rod in the second pair of rods is spaced from and extends alongside the quadrupole axis; and (d) a voltage connection means for connecting at least one of the first pair of rods and the second pair of rods to the voltage supply means to provide the at least partially-AC potential difference between the first pair of rods and the second pair of rods. In use the first pair of rods and the second pair of rods are operable, when the at least partially-AC potential difference is provided by the voltage supply means and the voltage connection means to at least one of the first pair of rods and the second pair of rods, to generate a two-dimensional substantially quadrupole field having a quadrupole harmonic with amplitude $A_2$ and a hexapole harmonic with amplitude $A_3$ wherein the magnitude of $A_3$ is greater than 0.1% of the magnitude of $A_2$.

An object of a second aspect of the present invention is to provide an improved method of processing ions in a quadrupole mass filter.

In accordance with this second aspect of the present invention, there is provided a method of processing ions in a quadrupole mass filter. The method comprises (a) establishing and maintaining a two-dimensional substantially quadrupole field for processing ions within a selected range of mass to charge ratios, the field having a quadrupole harmonic with amplitude $A_2$ and a hexapole harmonic with amplitude $A_3$ wherein the magnitude of $A_3$ is greater than 0.1% of the magnitude of $A_2$; and, (b) introducing ions to the field, wherein the field imparts stable trajectories to ions within the selected range of mass to charge ratios to retain such ions in the mass filter for transmission through the mass filter, and imparts unstable trajectories to ions outside of the selected range of mass to charge ratios to filter out such ions.

An object of a third aspect of the present invention is to provide an improved method of increasing average kinetic energy of ions in a two-dimensional ion trap mass spectrometer.

In accordance with this third aspect of the present invention, there is provided a method of increasing average kinetic energy of ions in a two-dimensional ion trap mass spectrometer. The method comprises (a) establishing and maintaining a two-dimensional substantially quadrupole field to trap ions within a selected range of mass to charge ratios wherein the field has a quadrupole harmonic with amplitude $A_2$ and a hexapole harmonic with amplitude $A_3$, wherein the magnitude of $A_3$ is greater than 0.1% of the magnitude of $A_2$; (b) trapping ions within the selected range of mass to charge ratios; and (c) adding an excitation field to the field to increase the average kinetic energy of trapped ions within a first selected sub-range of mass to charge ratios, wherein the first selected sub-range of mass to charge ratios is within the selected range of mass to charge ratios.

An object of a fourth aspect of the present invention is to provide an improved method of manufacturing a quadrupole electrode system for connection to a voltage supply means for providing an at least partially-AC potential difference within the quadrupole electrode system to generate a two-dimensional substantially quadrupole field for manipulating ions.

In accordance with this fourth aspect of the present invention, there is provided a method of manufacturing a quadrupole electrode system for connection to a voltage supply means for providing an at least partially-AC potential difference within the quadrupole electrode system to generate a two-dimensional substantially quadrupole field for manipulating ions. The method comprises the steps of: (a) determining a selected hexapole component to be included in the field; (b) installing a first pair of rods; (c) installing a second pair of rods substantially parallel to the first pair of rods, and (d) configuring the first pair of rods and the second pair of rods to provide the field with the selected hexapole component.

An object of a fifth aspect of the present invention is to provide an improved method of operating a mass spectrometer having an elongated rod set, said rod set having an entrance end and an exit end and a longitudinal axis.

In accordance with this fifth aspect of the present invention, there is provided a method of operating a mass spectrometer having an elongated rod set, said rod set having an entrance end and an exit end and a longitudinal axis. The method comprises: (a) admitting ions into said entrance end of said rod set, (b) trapping at least some of said ions in said rod set by producing a barrier field at an exit member adjacent to the exit end of said rod set and by producing an AC field between the rods of said rod set adjacent at least the exit end of said rod set, (c) said AC and barrier fields interacting in an extraction region adjacent to said exit end of said rod set to produce a fringing field, and (d) energizing ions in said extraction region to mass selectively eject at least some ions of a selected mass to charge ratio axially from said rod set past said barrier field. The AC field is a two-dimensional substantially quadrupole field having a quadrupole harmonic with amplitude $A_2$ and a hexapole harmonic with amplitude $A_3$, wherein the magnitude of $A_3$ is greater than 0.1% of the magnitude of $A_2$.

An object of a sixth aspect of the present invention is to provide an improved method of operating a mass spectrometer having an elongated rod set, the rod set having an entrance end and an exit end and a longitudinal axis.

In accordance with this sixth aspect of the present invention, there is provided a mass spectrometer system comprising: (a) an ion source; (b) a main rod set having an entrance end for admitting ions from the ion source and an exit end for ejecting ions traversing a longitudinal axis of the main rod set; (c) an exit member adjacent to the exit end of the main rod set; (d) power supply means coupled to the main rod set and the exit member for producing an AC field between rods of the main rod set and a barrier field at the exit end, whereby in use (i) at least some of the ions admitted in the main rod set are trapped within the rods and (ii) the interaction of the AC and barrier fields products a fringing field adjacent to the exit end, and (e) an AC voltage source coupled to one of: the rods of the main rod set and the exit member, whereby at least one of the AC voltage source and the power supply means mass dependently and axially ejects ions trapped in the vicinity of the fringing field from the exit end. The AC field is a two-dimensional substantially quadrupole field having a quadrupole harmonic with amplitude $A_2$ and a hexapole harmonic with amplitude $A_3$, wherein the magnitude of $A_3$ is greater than 0.1% of the magnitude of $A_2$.

BRIEF DESCRIPTION OF THE DRAWINGS

A detailed description of the preferred embodiments is provided herein below with reference to the following drawings, in which.

DETAILED DESCRIPTION OF PREFERRED EMBODIMENTS OF THE INVENTION

Figure 1:
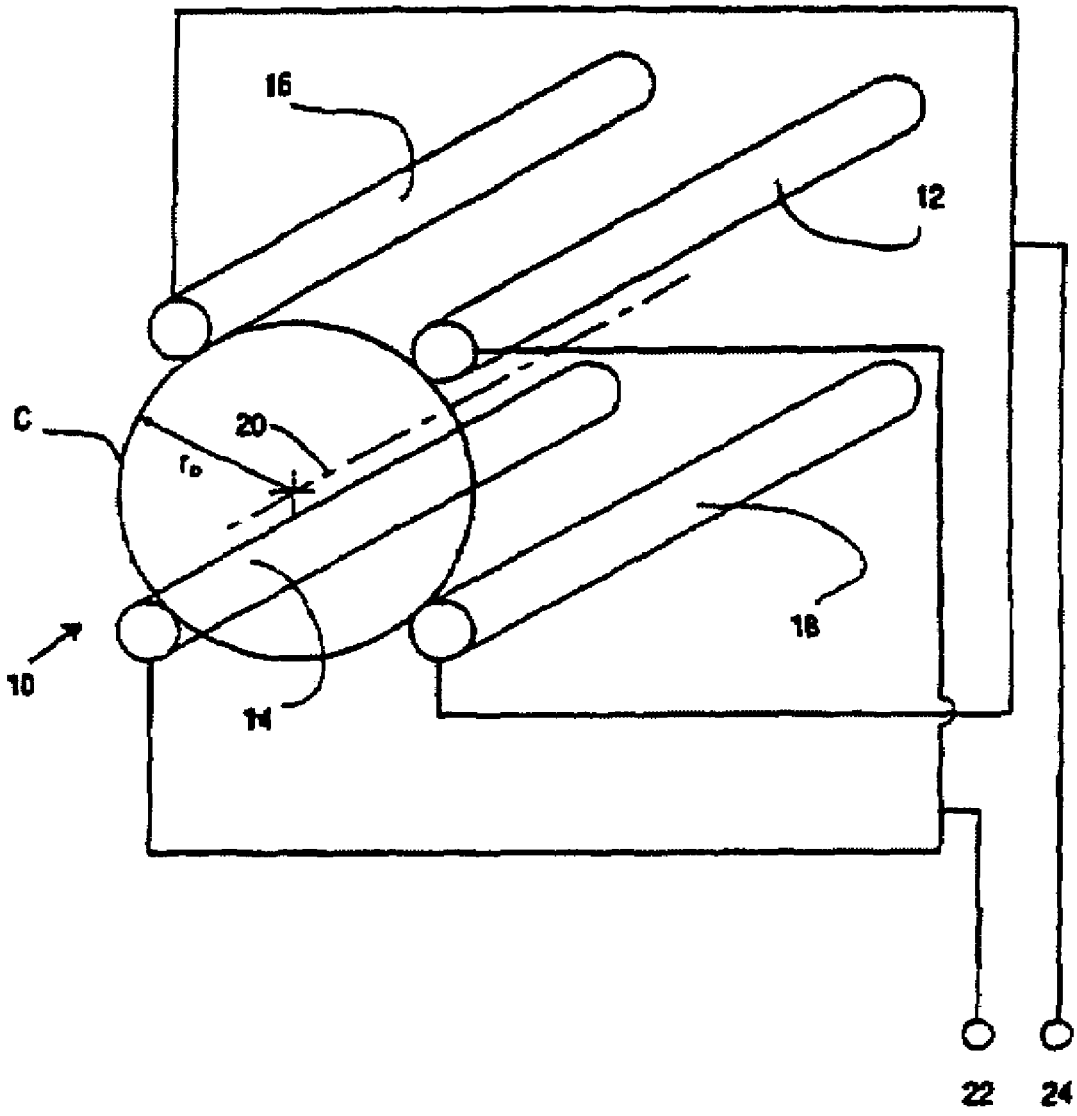
FIG. 1, in a schematic perspective view, illustrates a set of quadrupole rods.

Referring to FIG. 1, there is illustrated a quadrupole rod set 10 according to the prior art. Quadrupole rod set 10 comprises rods 12, 14, 16 and 18. Rods 12, 14, 16 and 18 are arranged symmetrically around axis 20 such that the rods have an inscribed circle C having a radius $r_0$. The cross sections of rods 12, 14, 16 and 18 are ideally hyperbolic and of infinite extent to produce an ideal quadrupole field, although rods of circular cross-section are commonly used. As is conventional, opposite rods 12 and 14 are coupled together and brought out to a terminal 22 and opposite rods 16 and 18 are coupled together and brought out to a terminal 24. An electrical potential V(t)=+(U−V cos Ωt) is applied between terminal 22 and ground and an electrical potential V(t)=−(U−V cos Ωt) is applied between terminal 24 and ground. When operating conventionally as a mass filter, as described below, for mass resolution, the potential applied has both a DC and AC component. For operation as a mass filter or an ion trap, the potential applied is at least partially-AC. That is, an AC potential will always be applied, while a DC potential will often, but not always, be applied. As is known, in some cases just an AC voltage is applied. The rod sets to which the positive DC potential is coupled may be referred to as the positive rods and those to which the negative DC potential is coupled may be referred to as the negative rods.

As described above, the motion of a particular ion is controlled by the Mathieu parameters a and q of the mass analyzer. These parameters are related to the characteristics of the potential applied from terminals 22 and 24 to ground as follows:

$$a_x = -a_y = a = \frac{8\ \text{eU}}{m_{ion}\Omega^2 r_0^2} \text{ and } q_x = -q_y = q = \frac{4\ \text{eV}}{m_{ion}\Omega^2 r_0^2} \tag{7}$$

where e is the charge on an ion, $m_{ion}$ is the ion mass, Ω=2πf where f is the AC frequency, U is the DC voltage from a pole to ground and V is the zero to peak AC voltage from each pole to ground. Combinations of a and q which give stable ion motion in both the X and Y directions are shown on the stability diagram of FIG. 2. The notation of FIG. 2 for the regions of stability is taken from P. H. Dawson ed., "Quadrupole Mass Spectrometry and Its Applications", 1976, Elsevier, Amsterdam, 19–23 and 70. The "first" stability region refers to the region near (a,q)=(0.2, 0.7), the "second" stability region refers to the region near (a,q)=(0.02, 7.55) and the "third" stability region refers to the region near (a,q)=(3,3). It is important to note that there are many regions of stability (in fact an unlimited number). Selection of the desired stability regions, and selected tips or operating points in each region, will depend on the intended application.

Ion motion in a direction u in a quadrupole field can be described by the equation $$u(\xi) = A\sum_{n=-\infty}^{\infty} C_{2n}\cos[(2n+\beta)\xi] + B\sum_{n=-\infty}^{\infty} C_{2n}\sin[(2n+\beta)\xi] \tag{8}$$

where $$\xi = \frac{\Omega t}{2}$$

and t is time, $C_{2n}$ depend on the values of a and q, and A and B depend on the ion initial position and velocity (see, for example, R. E. March and R. J. Hughes, *Quadrupole Storage Mass Spectrometry*, John Wiley and Sons, Toronto, 1989, page 41). The value of β determines the frequencies of ion oscillation, and β is a function of the a and q values (P. H. Dawson ed., *Quadrupole Mass Spectrometry and Its Applications*, Elsevier, Amsterdam, 1976, page 70). From equation 8, the angular frequencies of ion motion in the X ($\omega_x$) and Y ($\omega_y$) directions in a two-dimensional quadrupole field are given by $$\omega_x = (2n + \beta_x)\frac{\Omega}{2} \tag{9}$$

$$\omega_y = (2n + \beta_y)\frac{\Omega}{2} \tag{10}$$

where n=0, ±1, ±2, ±3 . . . $0 \leqq \beta_x \leqq 1$, $0 \leqq \beta_y \leqq 1$, and $\beta_x$ and $\beta_y$ are determined by the Mathieu parameters a and q for motion in the X and Y directions respectively (equation 7).

When higher field harmonics are present in a linear quadrupole, so called nonlinear resonances may occur. As shown for example by Dawson and Whetton (P. H. Dawson and N. R. Whetton, "Non-Linear Resonances in Quadrupole Mass Spectrometers Due to Imperfect Fields", *International Journal of Mass Spectrometry and Ion Physics,* 1969, Vol. 3, 1–12) nonlinear resonances occur when $$\frac{\beta_x}{2}K + (N - K)\frac{\beta_y}{2} = 1 \tag{11}$$

where N is the order of the field harmonic and K is an integer that can have the values N, N−2, N−4 . . . Combinations of $\beta_x$ and $\beta_y$ that produce nonlinear resonances form lines on the stability diagram. When a nonlinear resonance occurs, an ion, which would otherwise have stable motion, has unstable motion and can be lost from the quadrupole field. These effects are expected to be more severe when a linear quadrupole is used as an ion trap as compared to when the linear quadrupole is used as a mass filter. When the linear quadrupole is used as an ion trap, the non-linear resonances have longer times to build up. Thus, in the past it has been believed that the levels of hexapoles and other higher order multipoles present in a two-dimensional quadrupole field should be as small as possible.

We have determined, as described below, that two-dimensional quadrupole fields used in mass spectrometers can be improved in terms of ion fragmentation without losing the ability to mass analyze ions as a mass filter, by adding a hexapole component to the field. The added hexapole component is far larger than hexapole components arising from instrumentation or measurement errors. Specifically, hexapole components resulting from these errors are typically well under 0.1%. In contrast, the hexapole component $A_3$ according to the present invention is typically in the range of 1 to 6% of $A_2$, and may be as high as 20% of $A_2$ or even higher. Accordingly, to realize the advantages from introducing a hexapole component to a main trapping quadrupole field, it is desirable to construct an electrode system in which a certain level of hexapole field imperfection is deliberately introduced into the main trapping quadrupole field, while limiting the introduction of other field imperfections. Methods to deliberately introduce a substantial hexapole component to a linear quadrupole while at the same time minimizing contributions from other higher harmonics have not been described. As described below, a hexapole field can be provided by suitably shaped electrodes or by constructing a quadrupole system in which the two Y rods have been rotated in opposite directions to be closer to one of the X rods than to the other X rod.

We have also determined, as described below, that two-dimensional quadrupole fields used in mass spectrometers can be improved in terms of ion fragmentation without losing the ability to mass analyze ions as a mass filter by adding both hexapole and octopole components to the field. Again, as described below, both the hexapole and octopole components will typically be well above 0.1%, which is typically the upper limit for hexapole or octopole components introduced through instrumentation or measurement errors. As described below, a substantially two-dimensional quadrupole field with both an octopole and hexapole component can be provided by suitably shaped electrodes, or by constructing a quadrupole system in which the two Y rods have been rotated in opposite directions to be closer to one of the X rods and farther from the other X rod, and in which the Y rods and X rods are of different radius.

Shaping the Electrodes to Provide a Hexapole Component

A quadrupole field with an added hexapole component can be described as follows:

$$\Phi(x, y, t) = \left[A_2\left(\frac{x^2 - y^2}{r_0^2}\right) + A_3\left(\frac{x^3 - 3xy^2}{r_0^3}\right)\right](U - V\cos\Omega t) \tag{12}$$

where $A_2$ is the amplitude of the quadrupole component, $A_3$ is the amplitude of the hexapole component, U is the DC voltage applied from pole to ground, V is the zero to peak radio frequency voltage applied pole to ground, $$\frac{r_0}{\sqrt{A_2}}$$

is the distance from the quadrupole axis to the Y electrode when x=0 and ω is the angular frequency of the AC voltage. In equation 12, the X direction is the direction in which the potential becomes more positive as the distance from the center increases when $A_2>0$, $A_3>0$ and $U-V\cos\Omega t$ is positive. It can also be seen from equation 12 that the X direction is the direction in which the magnitude of the potential increases more rapidly than a pure quadrupole potential for displacements in one direction from the axis, and less rapidly than a pure quadrupole potential for displacements from the center in the opposite direction. The Y direction can be defined as the direction in which the potential equals that of a pure quadrupole field provided the other coordinate is zero. These latter definitions are independent of the sign of the applied potentials and the signs of $A_2$ and $A_3$.

The rod shapes of quadrupoles with added 1% to 10% hexapoles are calculated as follows:

$$A_2\left(\frac{x^2 - y^2}{r_0^2}\right) + A_3\left(\frac{x^3 - 3xy^2}{r_0^3}\right) = \pm\text{constant} \tag{12.1}$$

Assuming $r_0=1$ and constant=1, this yields $$A_2(x^2-y^2)+A_3(x^3-3xy^2)=\pm 1 \tag{12.2}$$

or:

$$y = \pm\sqrt{\frac{A_3x^3 + A_2x^2 \mp 1}{3A_3x + A_2}} \tag{12.3}$$

For a quadrupole, including, say, a 2% hexapole component, $A_2$=0.98, $A_3$=0.02, and equation (12.3) can be rewritten as follows:

$$y = \pm\sqrt{\frac{0.02x^3 + 0.98x^2 \mp 1}{0.06x + 0.98}} \tag{12.4}$$

Figure 3:
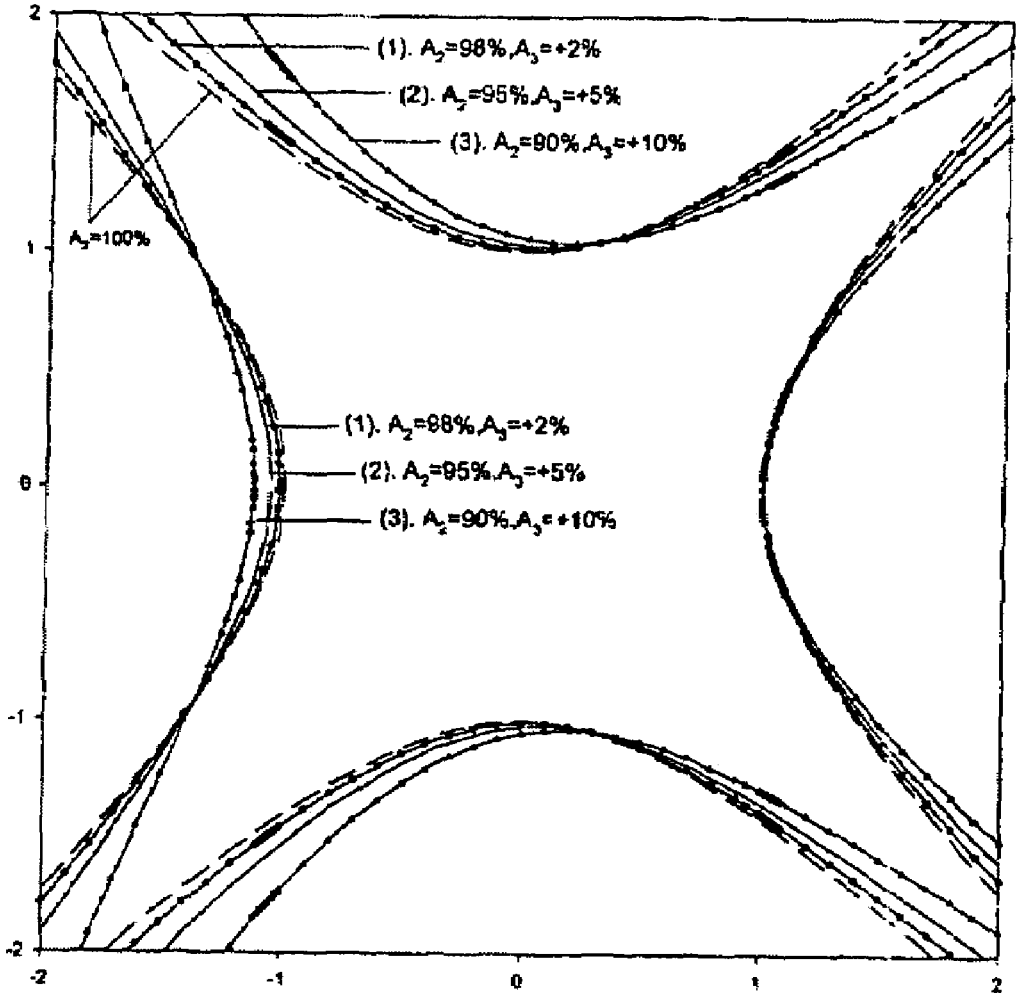
FIG. 3 is a graph illustrating electrode shapes suitable for providing a substantially quadrupole field having 0%, 2%, 5% and 10% hexapole components.

Referring to FIG. 3, four curves for the four possible combinations of the ± and ∓ are shown to illustrate the shape of the electrodes suitable for providing substantially quadrupole fields, each having a selected hexapole component.

Figure 4:
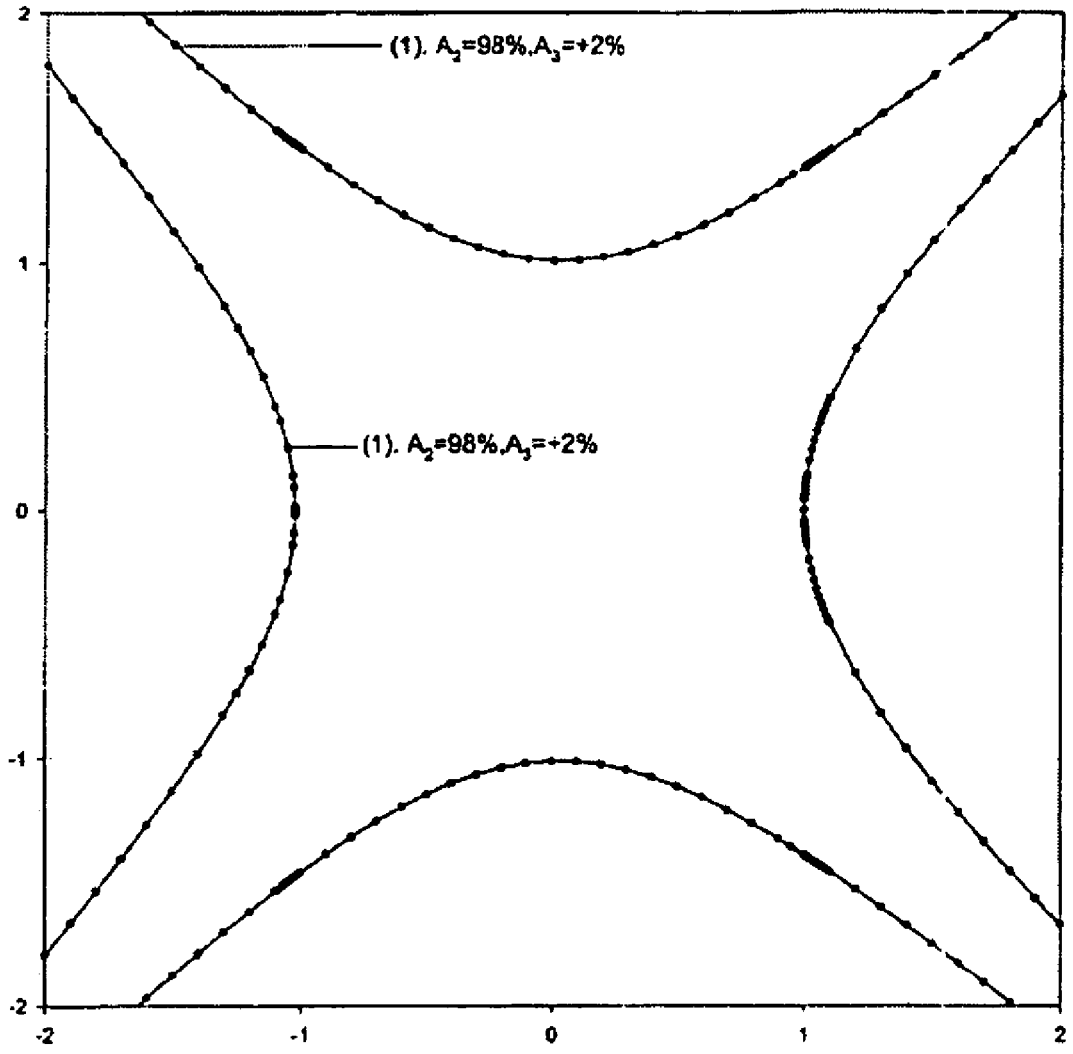
FIG. 4 is a graph illustrating electrode shapes suitable for providing a substantially quadrupole field having a +2.0% hexapole component.

FIG. 3 shows the electrode shapes for a pure quadrupole field, and for quadrupole fields with added 2%, 5% and 10% hexapole fields. FIG. 4 shows the electrode shapes for a quadrupole field with added 2% hexapole field. With an added hexapole, the rod sets are symmetric under the transformation y→−y but not under the transformation x→−x. (This can be seen from equation 12 and 12.1 as well as in FIGS. 3 and 4). This contrasts to quadrupoles that have added octopole fields, which have electrodes and fields that remain symmetric under both of these transformations (as can be seen from equations 4 and 6).

Figure 5:
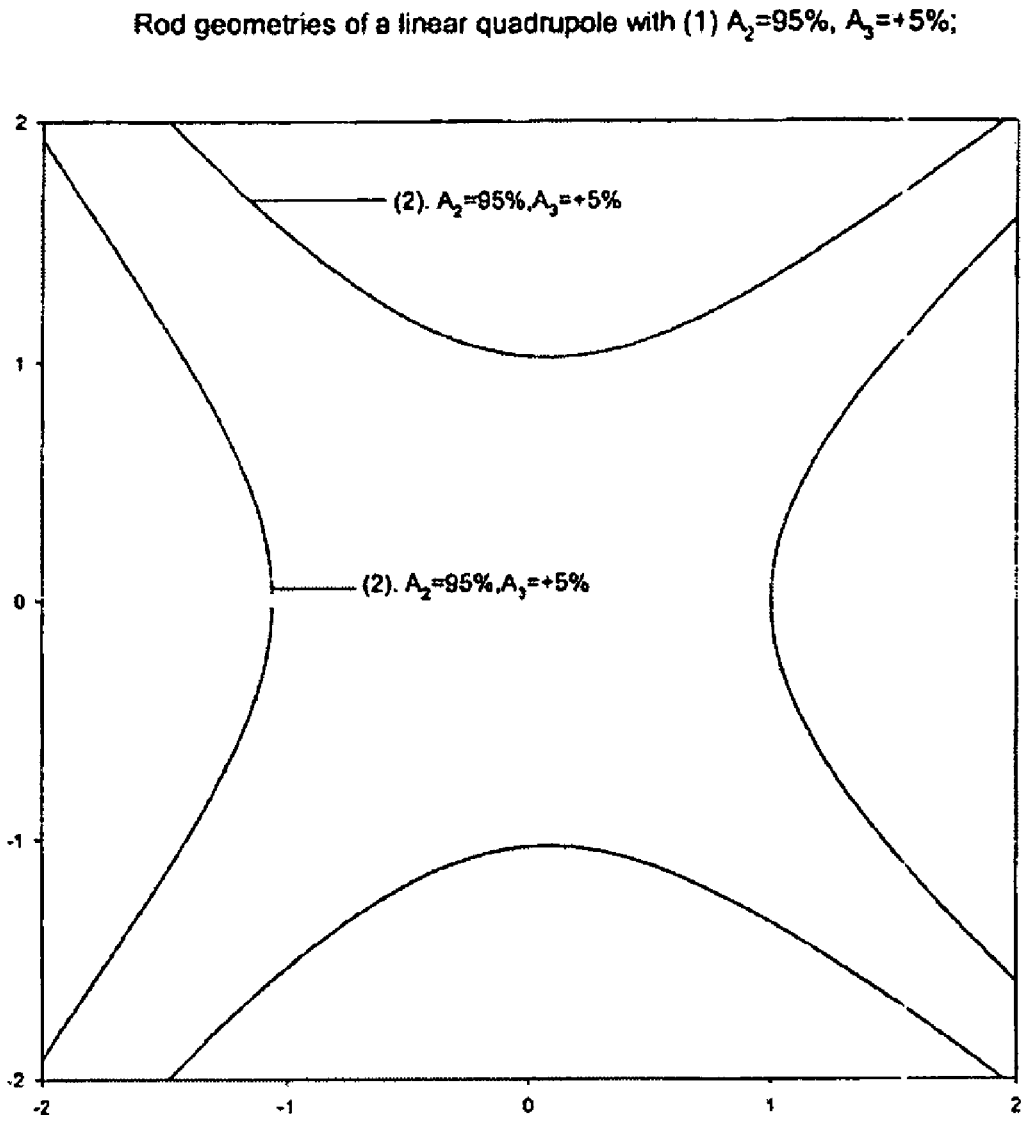
FIG. 5 is a graph illustrating electrode shapes suitable for producing a substantially quadrupole field having a +5.0% hexapole component.
Figure 6:
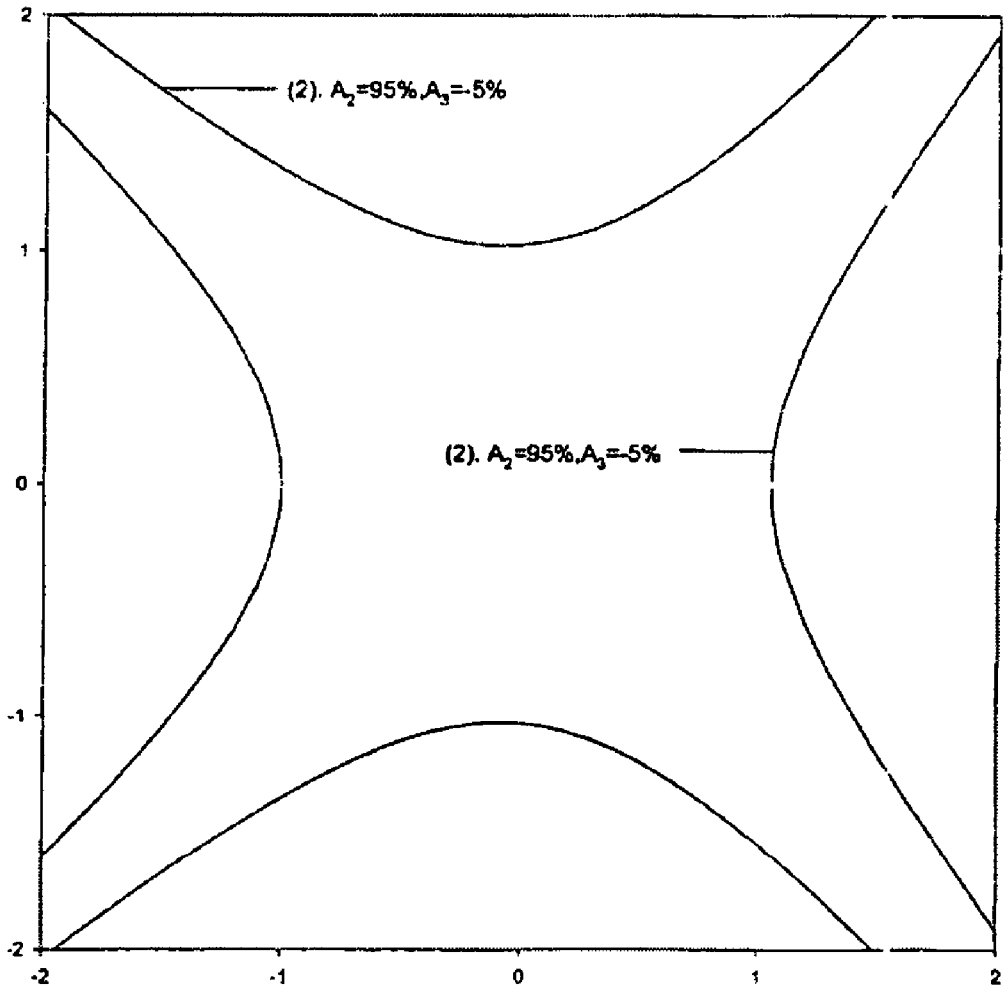
FIG. 6 is a graph illustrating electrode shapes suitable for producing a substantially quadrupole field having a −5.0% hexapole component.

From equation 12 it can be seen that changing the sign of $A_3$ is equivalent to the mathematical transformation x→−x. Thus rod sets constructed with a hexapole component $+A_3$ and hexapole component $-A_3$ will differ only by a reflection in the Y axis. This can be seen explicitly by comparing FIGS. 5 and 6. FIG. 5 shows electrodes that give a quadrupole field with an added hexapole with $A_3$=+0.050, and FIG. 6 electrodes that give a quadrupole field with an added hexapole with $A_3$=−0.050. The electrodes differ only by a reflection in the Y axis. Physically, the same transformation can be obtained by removing the electrodes from a system and interchanging the entrance and exit ends. This gives essentially the same rod set with the same potentials applied to the X and Y rod pairs. The character of the ion trajectories is not expected to change, and thus the performance of the rod set is not expected to be changed by changing the sign of $A_3$. This contrasts to the case of an added octopole field where changing the sign of $A_4$ is equivalent to interchanging the connections to the X and Y rods. Because the X and Y rods are physically different and have different potentials applied, changing the sign of $A_4$ changes the character of the ion trajectories and the performance of the rod set as a mass filter. However with an added hexapole field the ion trajectories are expected to differ if the sign of the DC potential applied between the rod pairs is reversed.

Adding A Hexapole Component by Angular Displacement of A Rod Pair

To produce a quadrupole with added hexapole field, electrodes with the shapes given by equation 12.3 can be manufactured. This is expensive. However, a hexapole field can also be added to a quadrupole set having round rods. Specifically, an angular displacement of one rod introduces higher harmonics and the greatest of these is the $A_3$ term, as described by Douglas et al., in *Russian Journal of Technical Physics,* 1999, Vol. 69, 96–101 at FIG. 5. However, while a substantial hexapole component is added, there are significant contributions from other higher order quadrupoles.

Figure 7:
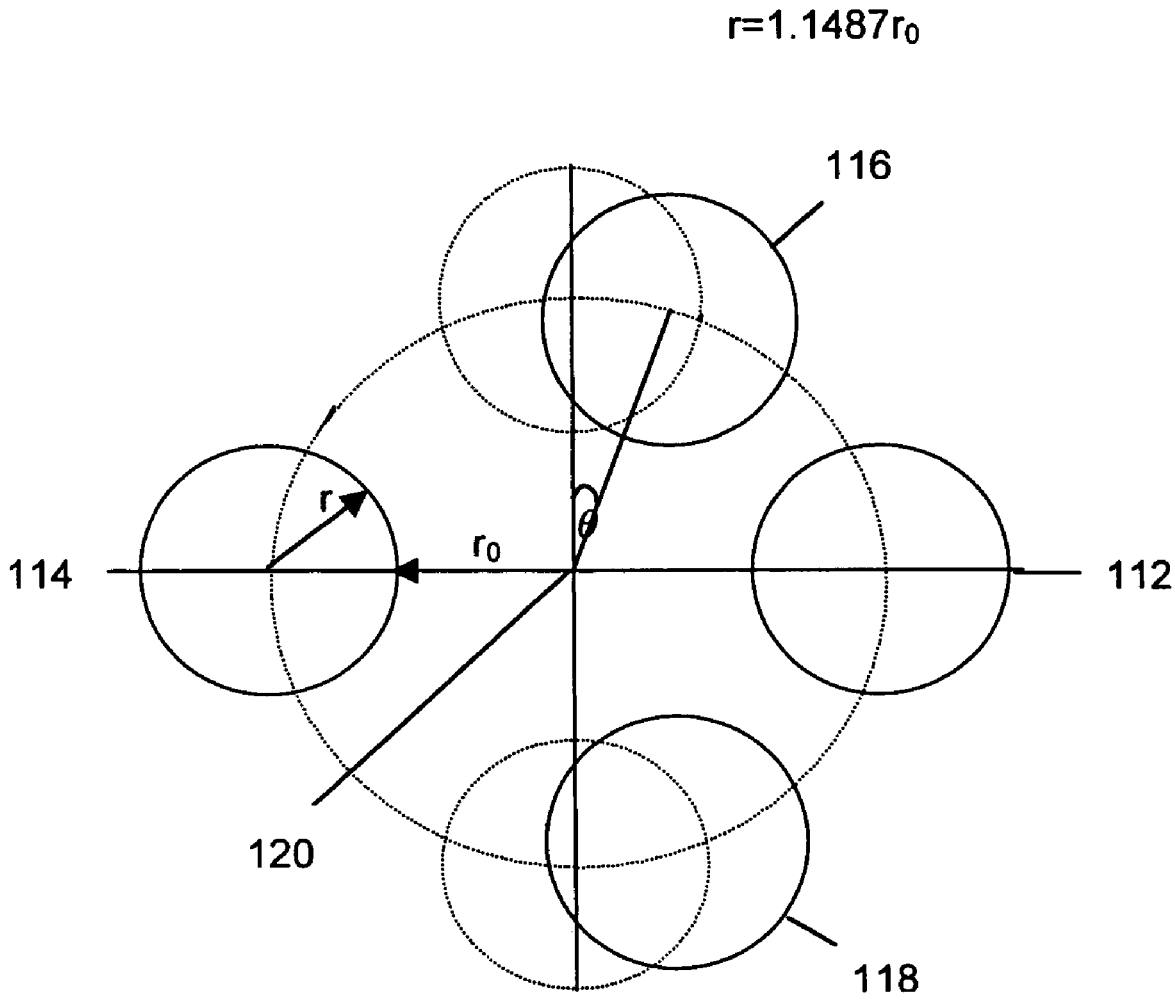
FIG. 7 is a sectional view showing rotation of the Y rods toward one of the X rods and away from the other of the X rods, which is suitable to add a hexapole component to a substantially quadrupole field.

A hexapole component may be added to a quadrupole field by rotating the Y rods in opposite directions towards one of the X rods. Referring to FIG. 7 there is illustrated in a sectional view, a set of quadrupole rods including Y rods that have undergone such a rotation. The set of quadrupole rods includes X rods 112 and 114, Y rods 116 and 118, and quadrupole axis 120. All of the rods 112, 114, 116, 118 have a radius r and are a radial distance $r_0$ from the quadrupole axis. The Y rods have been rotated through an angular displacement, θ, towards X rod 112 and away from X rod 114. For small angular displacements the magnitude of the hexapole component added to the field is directly proportional to the magnitude of the angular displacement of the Y rods.

Figure 8:
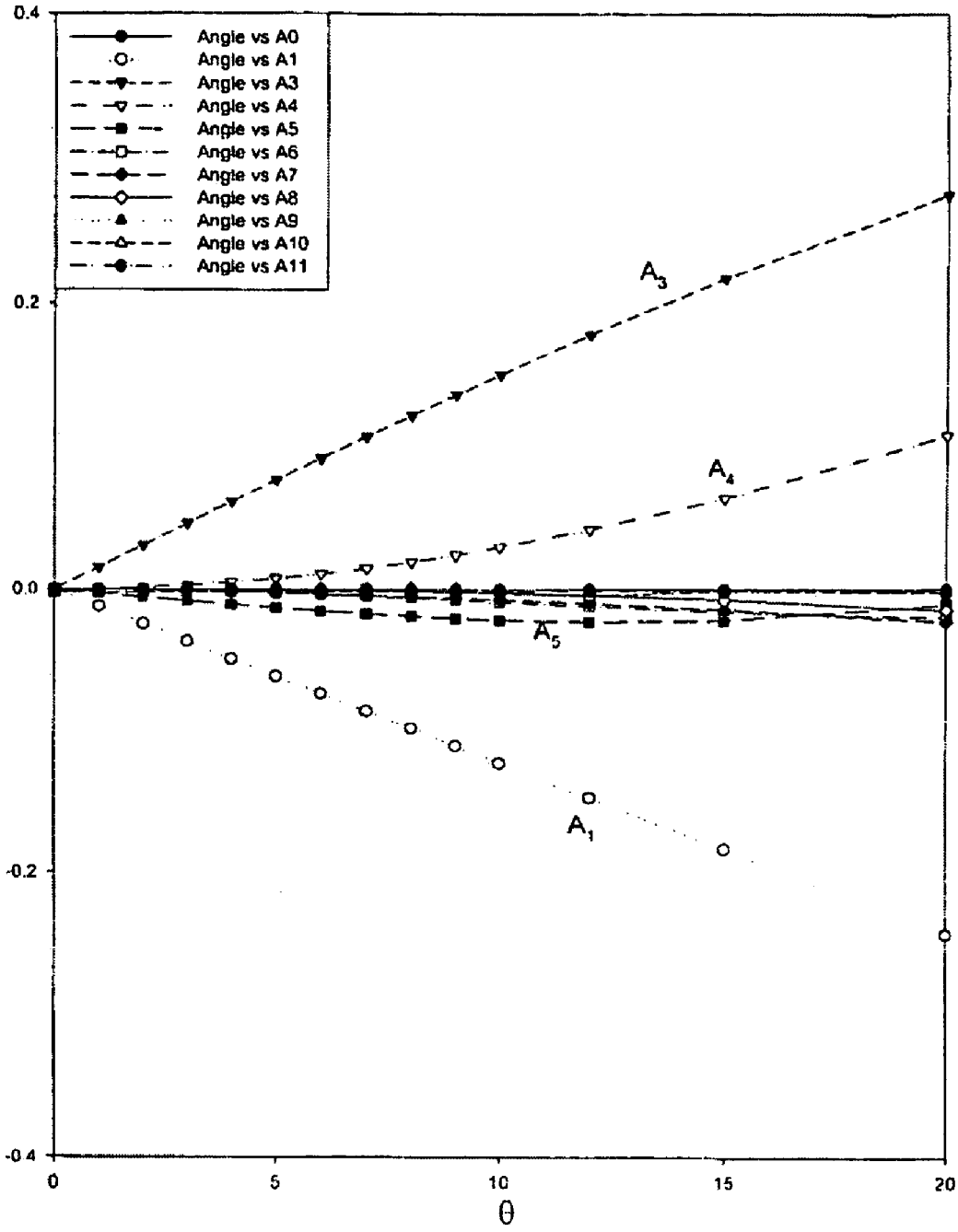
FIG. 8 is a graph of harmonic amplitudes vs. angular displacement of two Y rods for angles between 0 and 20.0 degrees.
Figure 9:
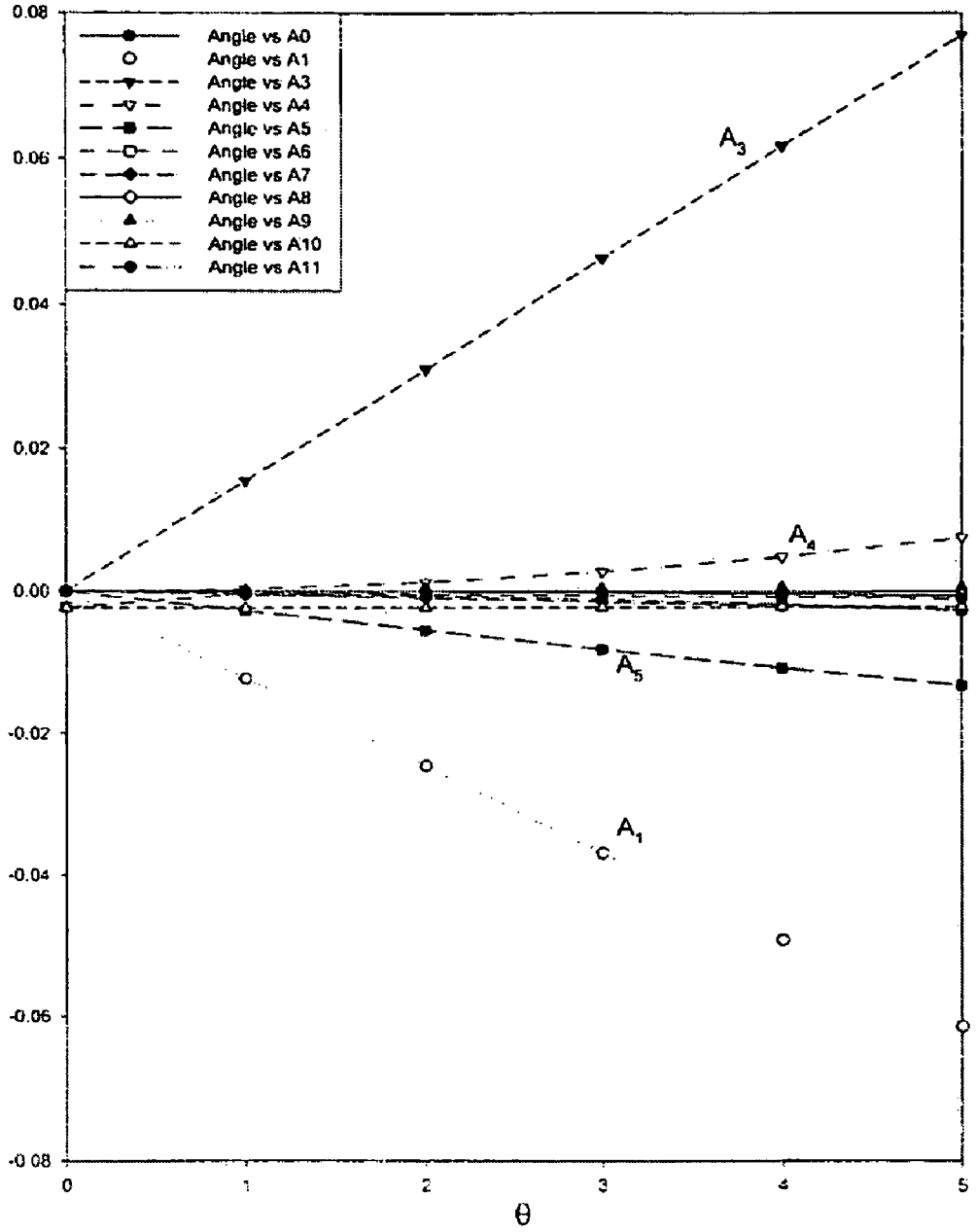
FIG. 9 is a graph of harmonic amplitudes vs. angular displacement of two Y rods for angles between 0 and 5.0 degrees.

The amplitudes of the harmonics produced by rotating two Y rods toward the X rods are shown in FIG. 8 for angles between 0 and 20 degrees. For this calculation the ratio of rod radius, r, to field radius, $r_0$, was $R/r_0$=1.1487 because this ratio produces low levels of the higher harmonics when the rotation is zero (i.e. without an added hexapole) (R. E. March and R. J. Hughes, *Quadrupole Storage Mass Spectrometry*, John Wiley and Sons, Toronto, 1989, page 42). The method of calculation of the harmonic amplitudes is given by Douglas et al., in *Russian Journal of Technical Physics,* 1999, Vol. 69, 96–101. It can be seen that a significant hexapole component (amplitude $A_3$) is produced. As well a significant dipole component $A_1$, having both DC and AC subcomponents, is added to the field. However, the AC subcomponent of the dipole component is at the frequency of the quadrupole AC and will not excite ions. Because the hexapole is added by displacing two rods, not by changing rod diameters, similar results are obtained for a broad range of ratios $r/r_0$, although with other ratios the higher harmonic amplitudes can be somewhat higher. FIG. 9 shows in more detail the harmonic amplitudes for rotations between 0 and 5.0 degrees. A hexapole amplitude of up to 0.075 can be produced, while amplitudes of higher multipoles remain small. For example with a rotation of the two Y rods of 3.0 degrees the amplitudes are $A_0=3.73\times10^{-5}$, $A_1=-3.68\times10^{-2}$, $A_2$=1.0011, $A_3=4.64\times10^{-2}$, $A_4=2.77\times10^{-3}$, $A_5=-8.18\times10^{-3}$, $A_6=-1.098\times10^{-3}$, $A_7=-1.43\times10^{-3}$, $A_8=-1.54\times10^{-4}$, $A_9=5.00\times10^{-4}$ and $A_{10}=-2.29\times10^{-3}$.

A hexapole component can also be added by displacing two Y rods linearly in the X direction. For small displacements the magnitude of the hexapole component added to the field is directly proportional to the magnitude of the displacement of the Y rods. A graph of harmonic amplitudes vs. displacement is very similar to FIG. 8 except that the higher harmonics have somewhat greater amplitudes.

The dipole potential, with amplitude $A_1$, can be removed by applying different voltages to each of the X rods 112 and 114. The following table shows, in column two, the amplitudes of each of the first ten harmonics when $r/r_0$=−1.1487, the angular displacements of the Y rods 116, 118 towards X rod 112, are 3 degrees and with voltages of equal magnitudes applied to all rods. Column three shows the amplitudes for the same geometry but when X rod 112 has the magnitude of the applied voltage increased by a factor of 1.0943, relative to the magnitude of the voltages applied to X rod 114 and the Y rods 116 and 118. Column four shows the harmonics when the Y rods and X rod 112 have voltages of the same magnitude and the X rod 114 has its voltage decreased by a factor 0.9099.

| Harmonic | Equal voltages | Voltage increase 112 × 1.0943 | Voltage decrease 114 × 0.9099 |
|---|---|---|---|
| $A_0$ | 0.0003 | 0.0229 | −0.02314 |
| $A_1$ | −0.03681 | −0.000002 | −0.00001609 |
| $A_2$ | 1.001 | 1.025 | 0.9789 |
| $A_3$ | 0.04368 | 0.057 | 0.05479 |
| $A_4$ | 0.00277 | 0.0034 | 0.003276 |
| $A_5$ | −0.00818 | −0.0091 | −0.008702 |
| $A_6$ | −0.0011 | −0.0014 | −0.001351 |
| $A_7$ | −0.0014 | −0.0016 | −0.001017 |
| $A_8$ | −0.0015 | −0.00007 | −0.00007387 |
| $A_9$ | 0.0005 | 0.004 | 0.0004207 |
| $A_{10}$ | −0.0023 | −0.0024 | −0.00226 |

It can be seen that the dipole term is reduced by many orders of magnitude by applying different voltages to the X rods 112 and 114. At the same time the amplitudes of the higher multipoles remain low. A substantial axis potential with amplitude $A_0$ is added to the potential but this does not affect ion motion within the rod set, only injection and extraction of ions. For any given angle of rotation, a voltage increase to the X rod 112 or a voltage decrease to the X rod 114 that makes the amplitude $A_1$, of the dipole zero can be found.

When equal voltages are applied to all the rods, and the two Y rods 116, 118 are rotated an angle θ towards X rod 112, the amplitude of the hexapole is given approximately by $A_3=0.01545\theta$. When the voltage on X rod 112 is increased to make the dipole term zero, while the magnitude of the voltage on X rod 114 is equal to the magnitude of the Y rods voltage, the amplitudes of the higher harmonics change somewhat and $A_3$ is given approximately by $A_3=0.0191\theta$. When the voltage on rod 114 is decreased to make the dipole term zero and the magnitude of the voltage on X rod 114 is equal to the magnitude of the Y rods, the harmonic amplitudes again change and $A_3$ is given approximately by $A_3=0.0183\theta$.

To make $A_1=0$, when the magnitude of the voltage on X rod 114 is equal to the magnitude of the voltage applied to the Y rods, the voltage on X rod 112 is increased by a factor $1+\delta_1$ where $\delta_1$ is given approximately by $\delta_1=0.0314\theta$. To make $A_1=0$, when the magnitude of the voltage on X rod 112 is equal to the magnitude of the voltage applied to the Y rods 116, 118, the voltage on X rod 114 is decreased by a factor $1-\delta_2$ where $\delta_2$ is given approximately by $\delta_2=0.0302\theta$. Finally, the increase in voltage to X rod 112 and decrease in voltage to X rod 114 can be combined. If a fraction a of the calculated increase $\delta_1$ is applied to X rod 112 (voltage increased by a factor of $(1+\alpha\delta_1)$ the remaining fraction $1-\alpha$ a of the calculated decrease $\delta_2$ can be applied to X rod 114 (factor $(1-(1-\alpha)\delta_2)$ to make $A_1=0$.

Ion Fragmentation

Adding a hexapole component to the two-dimensional quadrupole field allows ions to be excited for longer periods of time without ejection from the field. In general, in the competition between ion ejection and ion fragmentation, this favors ion fragmentation.

When ions in a pure quadrupole field are excited with a dipole field, the excitation voltage requires a frequency given by equations 9 or 10. As shown in M. Sudakov, N. Konenkov, D. J. Douglas and T. Glebova, "Excitation Frequencies of Ions Confined in a Quadrupole Field With Quadrupole Excitation", *Journal of the American Society for Mass Spectrometry,* 2000, Vol. 11, 10–18, when ions are excited with a quadrupole field the excitation angular frequencies are given by $$\omega(m, k) = |m + \beta|\frac{\Omega}{K} \tag{13}$$

where K=1, 2, 3 . . . and m=0, ±1, ±2, ±3 . . . Of course, when the quadrupole field has small contributions of higher field harmonics added, the excitation fields, dipole or quadrupole, may also contain small contributions from the higher harmonics.

When a simple quadrupole field, lacking any higher order terms, is generated by an electrode system, and when (1) there is no excitation of ion motion, (2) there is a collision gas preset, and (3) the ions have a q value that is not near a stability boundary, then the ions generally have a declining quantity of kinetic energy. Ions move through the two-dimensional quadrupole field and lose energy in the radial and axial directions as discussed for example in D. J. Douglas and J. B. French, "Collisional Focusing Effects in Radio Frequency Quadrupoles", *Journal of the American Society for Mass Spectrometry,* 1992, Vol. 3, 398–408. As a consequence, the ions are confined and move toward the centerline of the quadrupole, and fragmentation is minimal. As the ions oscillate in the field, their kinetic energy varies between zero and a maximum value that decreases with time. The kinetic energy averaged over each period of the ion motion decreases with time.

The average kinetic energy of the ions can be maintained over time, and the motion of the ion increased, by applying a dipole excitation voltage between either pair of the X rods or Y rods. In that event there will be a substantial increase in the amplitude of displacement of the ion in the direction of the axis of the rod pair to which the dipole excitation voltage is applied. As the amplitude of ion displacement increases, the ion kinetic energy averaged over each period of ion motion will also increase. However, the amplitude increases so much, and so much kinetic energy is imparted to the ion, that it will soon strike a rod and be lost. As the excitation of the ion is largely confined to the direction of the axis of the rod pair to which the dipole excitation voltage is applied, the amplitude of oscillation in the direction of the axis of the other rod pair will generally remain small, and the ion will be lost by striking a rod to which the dipole excitation voltage is applied, rather than being lost by striking one of the other rods.

By adding a hexapole component to the substantially quadrupole field, a dipole excitation voltage can be applied to increase ion fragmentation, without thereby increasing ion ejection. That is, as the amplitude of displacement of the ion increases, the resonant frequency of the ion shifts relative to the excitation frequency. The ion motion becomes out of phase with the excitation frequency, thereby reducing the kinetic energy imparted by the field to the ion such that the amplitude of motion of the ion diminishes. As the amplitude of motion decreases once again the resonant frequency of the ion matches the frequency of the excitation field, such that energy is again imparted to the ion and its amplitude once again increases. As with the case in which a pure quadrupole field is used, the movement of the ion is largely confined to the direction of the axis of the rods to which the dipole excitation voltage is applied.

During the excitation, the ion accumulates internal energy through energetic collisions with the background gas and eventually, when it has gained sufficient internal energy, fragments. Thus, to induce fragmentation, it is advantageous to be able to excite ions for long periods of time without having the ions ejected from the field. Of course, it will be appreciated by those skilled in the art that the amount of hexapole field must not be made too large relative to the quadrupole component of the field.

Similar results follow when a quadrupole excitation field is applied to the rods. When the quadrupole field has no added hexapole component, the amplitude of ion oscillation gradually increases over time until the ion strikes a rod and is lost. Further, the kinetic energy averaged over each period of the ion motion received by the ion gradually increases until the ion is lost. However, unlike the case in which a dipole excitation voltage is applied, when a quadrupole excitation voltage is applied, the ion moves throughout the XY plane of the quadrupole, before being lost.

When a hexapole component is added to the substantially quadrupole field, the displacement of the ion gradually increases over time, due to the auxiliary quadrupole excitation, until it reaches a maximum. As the amplitude of displacement of the ion increases, the resonant frequency of the ion shifts and, the ion motion moves out of phase with the frequency of the quadrupole excitation field. Consequently, the displacement diminishes and the ion moves gradually back into phase with the frequency of the quadrupole excitation field, whereupon the amplitude of displacement of the ion once again increases. The kinetic energy averaged over one period of the oscillation of the ion increases until the ion motion moves out of phase with the frequency of the quadrupole excitation field, at which point the kinetic energy diminishes, but again increases as the ion moves back into phase with the quadrupole excitation field. As a quadrupole excitation voltage is applied, the ion moves throughout the XY plane of the quadrupole. Thus with quadrupole excitation, as with dipole excitation, addition of a small hexapole component to the field allows the ion to be excited for much longer periods of time to increase the internal energy that can be imparted to an ion to induce fragmentation.

When an odd multipole field is added, the frequency shift is generally less than when an even multipole is added. More specifically, when a hexapole field is added, the frequency shift for a given amplitude of oscillation is less than when an octopole is added. This can be seen qualitatively from equations 5 and 6. Consider motion in the X direction with an added octopole field. The force on an ion in the X direction increases more rapidly than that of a pure quadrupole field as the distance from the center increases in the both the positive and negative X directions. This causes the frequency to shift up as the amplitude increases in both the positive and negative X directions. With an added hexapole, the force is increased in the positive X direction but decreased in the negative X direction. To a first approximation, these two effects cancel and there is no frequency shift. However when the ion motion is considered in more detail, there is still a frequency shift. The resonant frequency decreases as the amplitude increases, for both positive and negative values of $A_3$.

The frequency shift from an added octopole or hexapole field can be calculated approximately as follows. Motion of an ion of mass $m_{ion}$ in a multipole field with a potential oscillating at frequency $\Omega$ can be modeled approximately as motion in an effective electric potential given by $$V_{eff} = \frac{e\left|\vec{E}\right|^2}{4m_{ion}\Omega^2} \tag{13.1}$$

where the magnitude of the electric field squared is given by $$|\vec{E}|^2=(E_x^2+E_y^2) \tag{13.2}$$

and $E_x$ and $E_y$ are the components of the electric field in the X and Y directions.

Thus motion in a quadrupole field with an added octopole field can be modeled approximately as motion in an effective potential given by $$V_{eff}(x, y) = \frac{qA_2^2V}{4}\left(\frac{x^2+y^2}{r_o^2}\right) + \frac{qA_2A_4V}{1}\left(\frac{x^4-y^4}{r_0^4}\right) + \ldots \tag{14}$$

In equation 14 terms of the form $x^n y^m$ have been omitted because they do not change the calculation of the frequency shift for the X motion when Y=0. Consider motion in the X direction when Y=0. The force on an ion is $$F_x = -e\frac{\partial V_{eff}}{\partial x} = -\frac{eqA_2^2V\ 2x}{4r_0^2} - \frac{4eqA_2A_4V\ x^3}{r_0^4} \tag{15}$$

This gives the equation of motion for x as $$\ddot{x}+\omega_0^2x=-\alpha x^2-\beta x^3 \tag{16}$$

where $$\ddot{x} = \frac{d^2x}{dt^2},\ \omega_0^2 = \frac{eqA_2^2V_{rf}2}{4m_{ion}r_0^2},\ \alpha = 0 \text{ and } \beta = \frac{4eqA_2A_4V_{rf}}{m_{ion}r_0^4}.$$

Landau and Lifshitz (L. Landau and E. M. Lifshitz, *Mechanics*, Third Edition, Pergamon Press, Oxford 1966, pages 84–87) have shown that when motion is determined by equation 16, there is a shift in the resonant frequency from $\omega_0$ by an amount given by $$\Delta\omega = \left(\frac{3\beta}{8\omega_0} - \frac{5\alpha^2}{12\omega_0^3}\right)a^2 \tag{17}$$

where a is the amplitude of ion oscillation. Substituting for $\alpha$ and $\beta$ the frequency shift caused by the octopole term, $\Delta\omega_4$, is $$\Delta\omega_4 = 3\frac{A_4}{A_2}\left(\frac{a^2}{r_0^2}\right)\omega_0 \tag{18}$$

For example if $A_4/A_2=0.02$, and $a=r_0$, then $\Delta\omega_4=0.060\omega_0$.

When an added hexapole is present and the potential is given by equation (12), the ion motion can be described approximately as motion in an effective potential given by $$V_{eff} = \frac{qA_2^2(x^2+y^2)}{4r_0^2}V + \frac{3qA_2A_3x^3}{4r_0^3}V + \frac{9qA_3^2(x^4+y^4)}{16r_0^4}V + \ldots \quad (19)$$

where again terms in $x^n y^m$ have been omitted because they do not change the calculated frequency shift for X motion when y=0. This leads to the equation of motion for an ion $$\ddot{x} + \omega_0^2 x = -\frac{9eqA_2A_3}{4m_{ion}r_0^3}Vx^2 - \frac{36eqA_3^2}{16m_{ion}r_0^4}Vx^3 \quad (19.1)$$

In comparison to equation 16

$$\alpha = \frac{9}{2}\left(\frac{A_3}{A_2}\right)\frac{\omega_0^2}{r_0} \text{ and } \beta = \frac{9A_3^2}{2A_2^2}\frac{\omega_0^2}{r_0^2} \quad (19.2)$$

The frequency shift from the α term is $$\Delta\omega_\alpha = -\frac{5}{12}\frac{81A_3^2}{4A_2^2}\frac{a^2}{r_0^2}\omega_0 \quad (19.3)$$

If $A_3$=0.020 and $A_2$=1.00, a=$r_0$, then the frequency shift from this term is $\Delta\omega_\alpha = -3.38\times10^{-3}\omega_0$. The frequency shift from the β term is $$\Delta\omega_\beta = \frac{3\beta}{8\omega_0}a^2 = \frac{27A_3^2}{16A_2^2}\frac{a^2}{r_0^2}\omega_0 \quad (19.4)$$

and for the same values of the parameters is $\Delta\omega_\beta = +6.75\times10^{-4}\omega_0$.

The combined frequency shift for X motion is $-2.71\times10^{-3}\omega_0$ or about 22 times less than that from a 2% octopole field.

The Y motion is determined by $$\ddot{y} + \omega_0^2 y = -\frac{36eqA_3^2}{16m_{ion}r_0^4}Vy^3 \quad (19.5)$$

and there is a shift up in frequency $$\Delta\omega_y = \frac{27A_3^2}{16A_2^2}\frac{a^2}{r_0^2}\omega_0 \quad (19.6)$$

When $A_3$=0.020, $A_2$=1.00 and a=$r_0$, this shift is $+1.35\times10^{-3}\omega_0$, or about four times less than the total shift in the X frequency.

Operation as a Mass Filter

The above-described quadrupole fields having significant hexapole components can be useful as quadrupole mass filters. The term "quadrupole mass filter" is used here to mean a linear quadrupole operated conventionally to produce a mass scan as described, for example, in P. H. Dawson ed., *Quadrupole Mass Spectrometry and its Applications*, Elsevier, Amsterdam, 1976, pages 19–22. The voltages U and V are adjusted so that ions of a selected mass to charge ratio are just inside the tip of a stability region such as the first region shown in FIG. 2. Ions of higher mass have lower a,q values and are outside of the stability region. Ions of lower mass have higher a,q values and are also outside of the stability region. Therefore ions of the selected mass to charge ratio are transmitted through the quadrupole to a detector at the exit of the quadrupole. The voltages U and V are then changed to transmit ions of different mass to charge ratios. A mass spectrum can then be produced. Alternatively the quadrupole may be used to "hop" between different mass to charge ratios as is well known. The resolution can be adjusted by changing the ratio of DC to AC voltages (U/V) applied to the rods.

It has been expected that for operation as a mass filter, the potential in a linear quadrupole should be as close as possible to a pure quadrupole field. Field distortions, described mathematically by the addition of higher multipole terms to the potential, have generally been considered undesirable (see, for example, P. H. Dawson and N. R. Whetton, "Non-linear Resonances in Quadrupole Mass Spectrometers Due to Imperfect Fields", *International Journal of Mass Spectrometry and Ion Physics,* 1969, Vol. 3, 1–12, and P. H. Dawson, "Ion Optical Properties of Quadrupole Mass Filters", *Advances in Electronics and Electron Optics,* 1980, Vol. 53, 153–208). Empirically, manufacturers who use round rods to approximate the ideal hyperbolic rod shapes, have found that a geometry that adds small amounts of 12-pole and 20-pole potentials, gives higher resolution and gives peaks with less tailing than quadrupoles constructed with a geometry that minimizes the 12-pole potential. It has been shown that this is due to a cancellation of unwanted effects from the 12- and 20-pole terms with the optimized geometry. However the added higher multipoles still have very low magnitudes (ca. $10^{-3}$) compared to the quadrupole term (D. J. Douglas and N. V. Konenkov, "Influence of the $6^{th}$ and $10^{th}$ Spatial Harmonics on the Peak Shape of a Quadrupole Mass Filter with Round Rods", *Rapid Communications in Mass Spectrometry,* 2002, Vol. 16, 1425–1431).

The inventors have considered substantially quadrupole fields, as described above, that contain significant hexapole components (typically between 2 to 10% of $A_2$). In view of all the previous literature on the effects of field imperfections on mass analysis, it would not be expected that these rod sets would be capable of mass analysis in the conventional manner.

Figure 10:
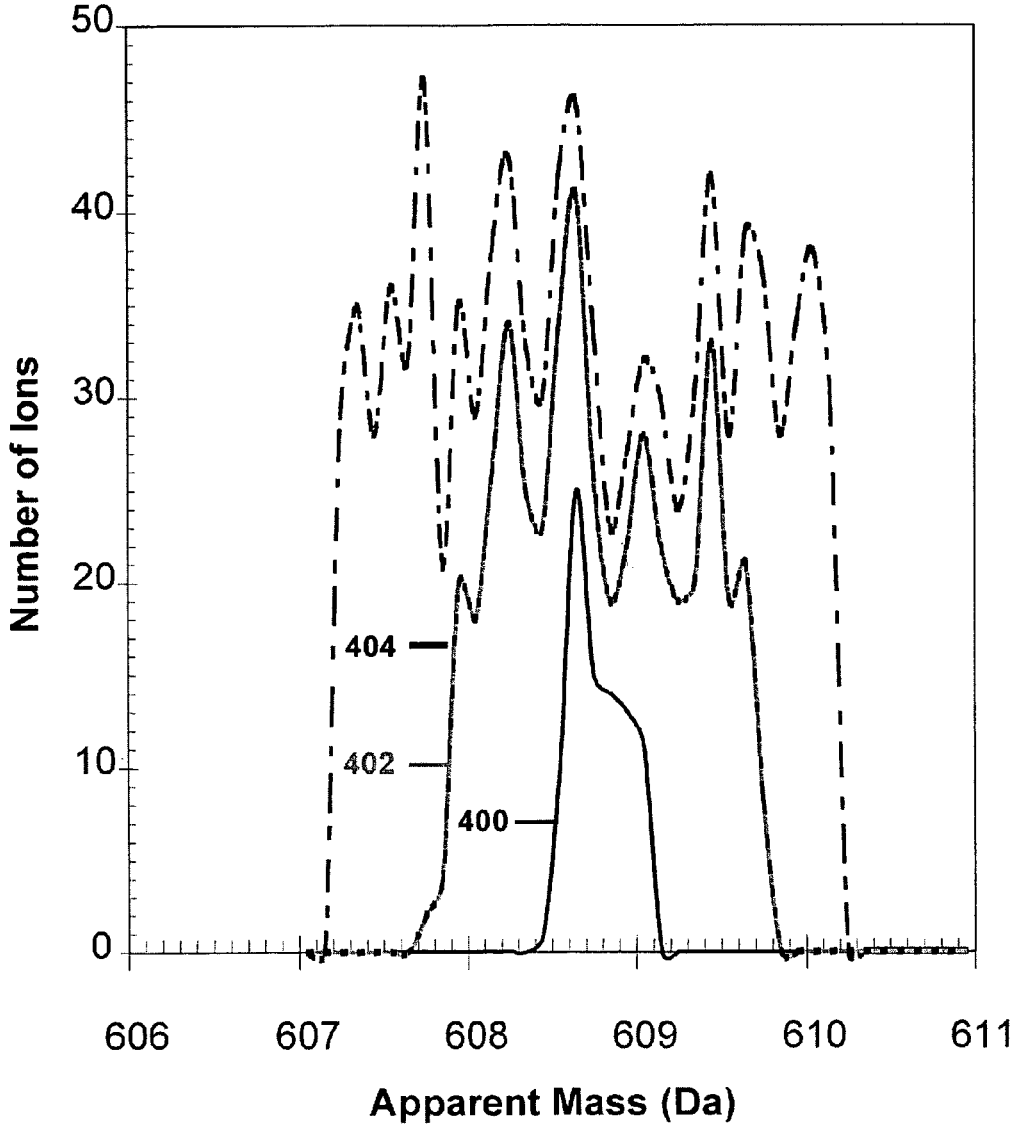
FIG. 10 is a graph of ion transmission through mass filters with a pure quadrupole field, a quadrupole field with added +2.0% hexapole and a quadrupole field with added −2.0% hexapole.

FIG. 10 shows a simulation of the ion transmission through a pure quadrupole field and through a quadrupole field with hexapole components with $A_3$=+0.02 and $A_3$=−0.02. For this simulation an initial population of 1000 singly charged ions was distributed uniformly in a planar disk of radius 0.1 mm with thermal radial speeds. These ions were input to a 200 mm long two-dimensional, nominally quadrupole field with an additional 1 eV of axial energy. Fringing field effects at each end were ignored.

The ions were assigned stability co-ordinates such that they were distributed randomly along a scan-line of nominal resolution 1000 between apparent masses of 607.2 and 610.2 Da. For the most direct comparison, the same mass window was used for all simulations and the mass window was chosen sufficiently wide that none of the peaks were truncated. Three simulations were carried out corresponding to −2%, 0% and +2% hexapole added to a nominally quadrupole potential. In terms of a multipole expansion, the quadrupole coefficient was $A_2$=1.0 in all cases, with the hexapole coefficient taking on values of $A_3$=−0.02, 0.00 and 0.02. For this simulation the positive DC was applied to the X rods and the negative DC to the Y rods.

Figure 11:
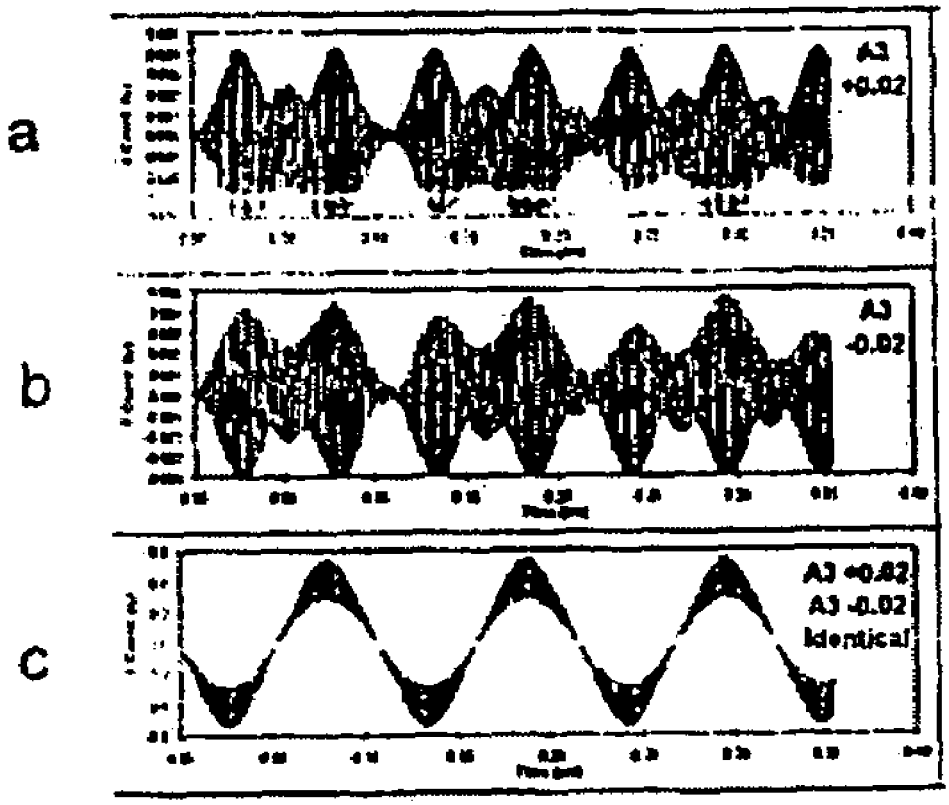
FIG. 11 shows the trajectories of an ion in the X and Y directions through a quadrupole field with added +2.0% and −2.0% hexapole fields.

The results of simulations of RF/DC performance when ±2% hexapole was added to a nominally quadrupolar potential are shown in FIG. 10. The curve 400 shows the transmission and peak shape through a pure quadrupole field. The curves 402 and 404 show the transmission through a quadrupole field with added hexapole with amplitudes $A_3$=+0.020 and $A_3$=−0.020 respectively. The peak shapes corresponding to $A_3$=−0.020 and $A_3$=+0.020 are identical as expected from the discussion above. FIG. 11 shows trajectories for one ion through fields with $A_3$=+0.020 and $A_3$=−0.020. FIG. 11*a* shows the X motion with $A_3$=+0.020 and FIG. 11*b* shows the X motion with $A_3$=−0.020. The trajectories would be identical if the sign of X was changed. The Y motion is shown in FIG. 11*c* and is identical for $A_3$=+0.020 and $A_3$=−0.020.

Figure 12:
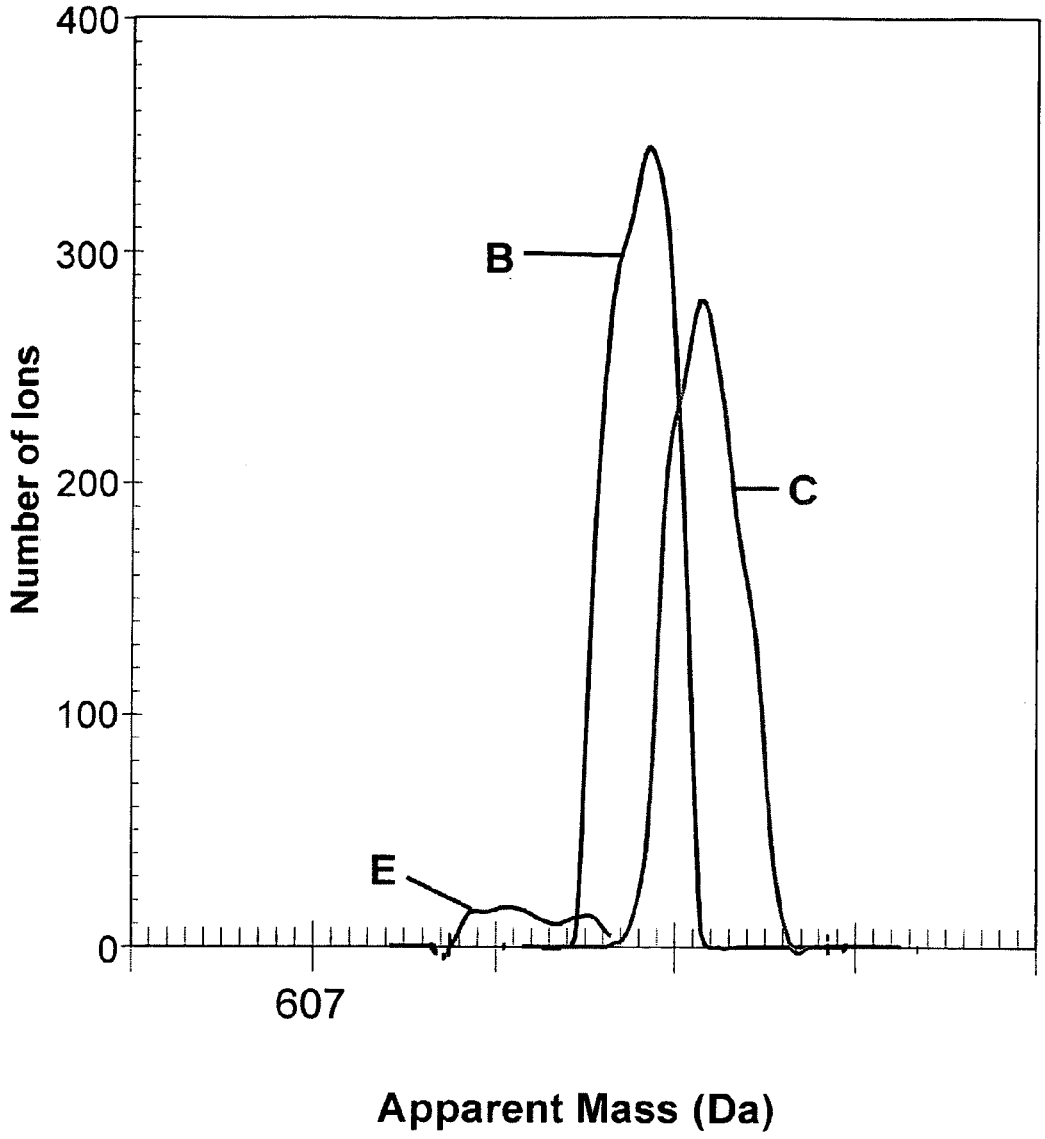
FIG. 12 shows the peak shape and ion transmission of a quadrupole mass filter with a pure quadrupole field, a quadrupole field with an added +2.0% hexapole field and positive DC applied to the X rods, and a quadrupole field with an added +2.0% hexapole field and negative DC applied to the X rods.

In FIG. 10 it can be seen that addition of a hexapole component causes the peak to broaden. However, for a quadrupole with an added hexapole field, a narrow peak with resolution comparable to that of a pure quadrupole field can be produced by increasing the ratio of DC to AC voltage applied between the rod pairs, provided the DC is applied with the correct polarity. This is shown in FIG. 12, which shows a peak shape B for a pure quadrupole field, a peak shape C for a quadrupole field with an added hexapole field of amplitude $A_3$=+0.020 and positive DC applied to the X rods and negative DC applied to the Y rods, and a peak shape E for a quadrupole field with an added hexapole field of amplitude $A_3$=+0.020 and negative DC applied to the X rods and positive DC applied to the Y rods. For this simulation, an ion list of 10,000 singly charged positive ions of mass 609 was prepared. Following thermalization with nitrogen gas at 300 K, the ions' axial co-ordinates were reset to zero and 1 eV was added to their thermal axial energies. These ions were input to a two-dimensional 200-mm AC/DC mass filter. The theoretical DC/AC ratio for a resolution of 1000 in a pure quadrupole of 0.1677 was maintained for the 0% hexapole case. For the 2% hexapole case, with positive DC applied to the X rods, the ratio of DC/AC was increased to 0.1680 to obtain a peak width at half-maximum, which was comparable to the pure quadrupole case. A scan line for which DC/AC=0.1680 does not intersect the first stability region of a pure quadrupole. To improve the efficiency of the calculation, the mass window used to obtain the data of FIG. 12 was reduced to span the range 608.2 to 610.2 Da. From FIG. 12, it can be seen that the quadrupole with added hexapole field can produce a peak with comparable resolution to that of a pure quadrupole field, provided the AC/DC ratio is set correctly. In FIG. 12, the resolution at half maximum of the peak produced by the pure quadrupole field is 1150 and the resolution of the peak with the added hexapole field is 1130. When the hexapole field is added, an increased DC/AC ratio is required because the boundaries of the stability diagram shift outwards slightly. When the negative DC is applied to the X rods, a peak with resolution and transmission comparable to that produced by a pure quadrupole field cannot be obtained for positive ions. In FIG. 12, the broad peak E was obtained when the negative DC was applied to the X rods and the positive DC applied to the Y rods. To obtain this peak the DC level was reduced. Attempts to increase the resolution by increasing the DC voltage simple led to losses of ion transmission. For negative ions, to obtain peak shape and transmission comparable to that of a pure quadrupole field the polarity of the DC should be reversed; the negative DC should be applied to the X rods and the positive DC applied to the Y rods.

Axial Ejection

According to a further preferred embodiment of the invention, a hexapole component is included in a two dimensional substantially quadrupole field provided in a mass spectrometer as described in U.S. Pat. No. 6,177,668, issued Jan. 23, 2001 to MDS Inc., which is incorporated by reference. That is, aspects of the present invention may usefully be applied to mass spectrometers utilizing axial ejection.

Figure 13:
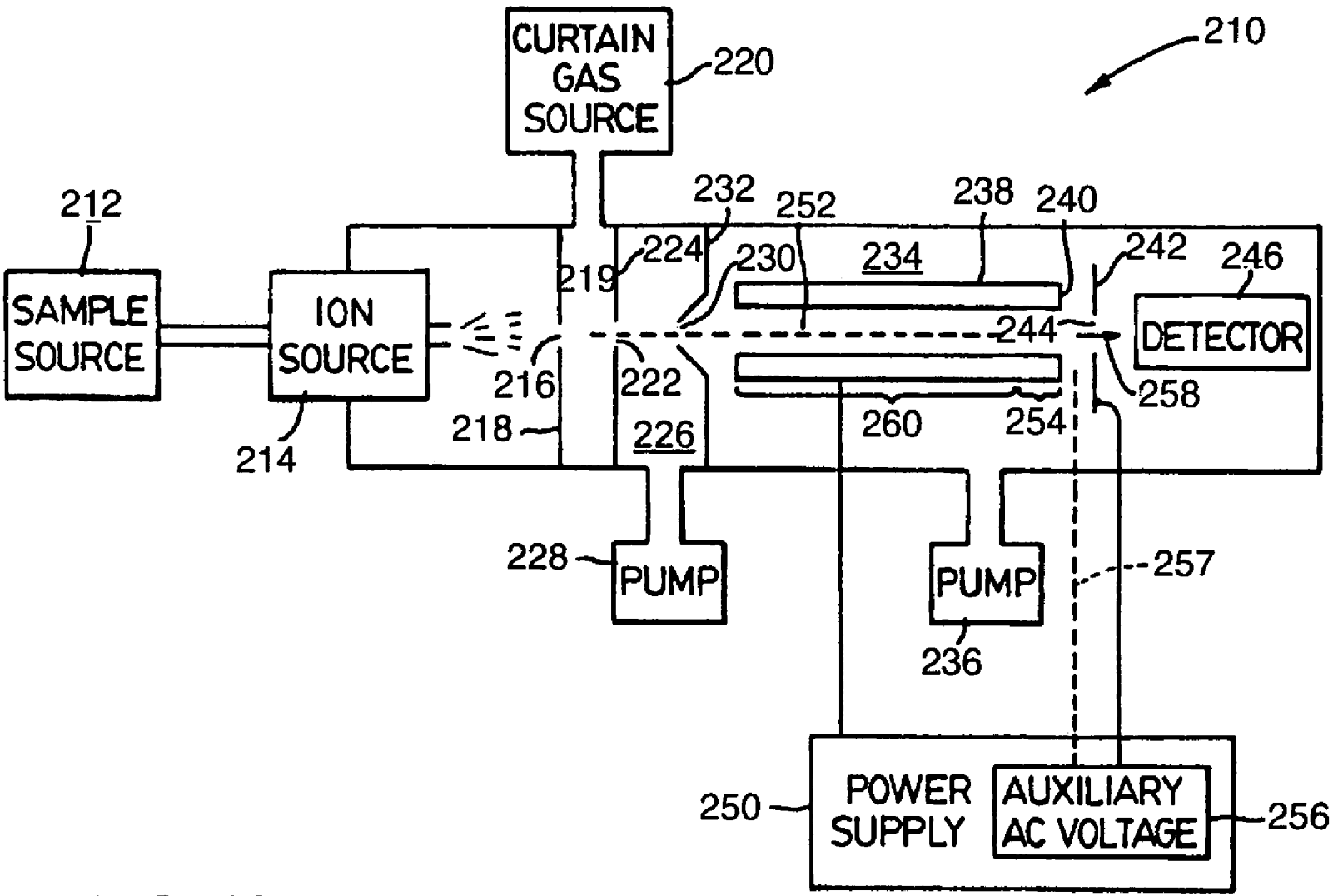
FIG. 13 is a diagrammatic view of a mass spectrometer system in which an aspect of the invention involving axial ejection may be implemented.

Referring to FIG. 13, there is illustrated a mass analyzer system 210, which is configured to permit axial ejection. The system 210 includes a sample source 212 (normally a liquid sample source such as a liquid chromatography from which a sample is supplied to an ion source 214. Ion source 214 may be an electrospray, an ion spray, or a corona discharge device, or any other ion source. An ion spray device of the kind shown in U.S. Pat. No. 4,861,988 issued Aug. 29, 1989 to Cornell Research Foundation Inc. is suitable.

Ions from ion source 214 are directed through an aperture 216 in an aperture plate 218. Plate 218 forms one wall of a gas curtain chamber 219, which is supplied with curtain gas from a curtain gas source 220. The curtain gas can be argon, nitrogen or other inert gas. The ions then pass through an orifice 222 in an orifice plate 224 into a first stage vacuum chamber 226 evacuated by a pump 228 to a pressure of about 1 Torr.

The ions then pass through a skimmer orifice 230 in a skimmer, which is mounted on skimmer plate 232 and into a main vacuum chamber 234 evacuated to a pressure of about 2 milli-Torr by a pump 236.

The main vacuum chamber 234 contains a set of four linear quadrupole rods 238. Located about 2 mm past exit ends 240 of the rods 238 is an exit lens 242. The lens 242 is simply a plate with an aperture 244 therein, allowing passage of ions through aperture 244 to a conventional detector 246 (which may for example be a channel electron multiplier of the kind conventionally used in mass spectrometers).

The rods 238 are connected to the main power supply 250, which applies AC voltage between the rods. The power supply 250 and the power supplies for the ion source 214, the aperture and orifice plates 218 and 224, the skimmer plate 232, and the exit lens 242 are connected to common reference ground (connections not shown).

By way of example, for positive ions the ion source 214 may typically be at +5,000 volts, the aperture plate 218 may be at +1,000 volts, the orifice plate 224 may be at +250 volts, and the skimmer plate 232 may be at ground (zero volts). The DC offset applied to rods 238 may be −5 volts. The axis of the device is indicated at 252.

Thus, ions of interest, which are admitted into the device from ion source 214, move down a potential and are allowed to enter the rods 238. Ions that are stable in the main AC field applied to the rods 238 travel the length of the device undergoing numerous momentum dissipating collisions with the background gas. However a trapping DC voltage, typically −2 volts DC (for positive ions a 3 volts barrier relative to the −5 volt rod offset), is applied to the exit lens 242. Normally the ion transmission efficiency between the skimmer 232 and the exit lens 242 is very high and may approach 100%. Ions that enter the main vacuum chamber 234 and travel to the exit lens 242 are thermalized due to the numerous collisions with the background gas and have little net velocity in the direction of axis 252. The ions also experience forces from the main AC field, which confine them radially. Typically the AC voltage applied is in the order of about 450 volts, peak-to-peak between pairs of rods (unless it is scanned with mass), and is of a frequency of the order of about 816 kHz. No resolving DC field is applied to rods 238.

When an axial DC potential barrier is created at the exit lens 242 by applying a DC offset voltage which is higher than that applied to the rods 238, the ions stable in the AC field applied to the rods 238 are effectively trapped.

However ions in region 254 in the vicinity of the exit lens 242 will experience fields that are significantly distorted due to the nature of the termination of the main AC and DC fields near the exit lens. Such fields, commonly referred to as fringing fields, will tend to couple the radial and axial degrees of freedom of the trapped ions. This means that there will be axial and radial components of ion motion that are not mutually independent. This is in contrast to the situation at the center of rod structure 238 further removed from the exit lens and fringing fields, where the axial and radial components of ion motion are not coupled or are minimally coupled.

Because the fringing fields couple the radial and axial degrees of freedom of the trapped ions, ions may be scanned mass dependently axially out of the ion trap including the rods 238, by the application to the exit lens 242 of a low voltage auxiliary AC field of appropriate frequency. The auxiliary AC field may be provided by an auxiliary AC supply 256, which for illustrative purposes is shown as forming part of the main power supply 250.

The auxiliary AC field is an addition to the trapping DC voltage supplied to exit lens 242, and excites both the radial and axial ion motions. The auxiliary AC field is found to excite the ions sufficiently that they surmount the axial DC potential barrier at the exit lens 242, so that they can leave approximately axially in the direction of arrow 258. The deviations in the field in the vicinity of the exit lens 242 lead to the above-described coupling of axial and radial ion motions thereby enabling axial ejection. This is in contrast to the situation existing in a conventional three-dimensional ion trap, where excitation of radial secular motion will generally lead to radial ejection and excitation of axial secular motion will generally lead to axial ejection, unlike the situation described above.

Therefore, ion ejection in a sequential mass dependent manner can be accomplished by scanning the frequency of the low voltage auxiliary AC field. When the frequency of the auxiliary AC field matches a resonant frequency of an ion in the vicinity of the exit lens 242, the ion will absorb energy and will now be capable of traversing the potential barrier present on the exit lens due to the radial/axial motion coupling. When the ion exits axially, it will be detected by detector 246. After the ion is ejected, other ions upstream of the region 254 in the vicinity of the exit enter the region 254 and are excited by subsequent AC frequency scans.

When the AC field applied to the rods is a substantially quadrupole field without an added hexapole, ion ejection by scanning the frequency of the auxiliary AC voltage applied to the exit lens is desirable because it does not empty the trapping volume of the entire elongated rod structure 238. In a conventional mass selective instability scan mode for rods 238, the AC voltage on the rods would be ramped up and ions would be ejected from low to high masses along the entire length of the rods when the q value for each ion reaches a value of 0.908. After each mass selective instability scan, time is required to refill the trapping volume before another analysis can be performed. In contrast, when an auxiliary AC voltage is applied to the exit lens as described above, ion ejection will normally only happen in the vicinity of the exit lens because this is where the coupling of the axial and radial ion motions occurs and where the auxiliary AC voltage is applied. The upstream portion 260 of the rods serves to store other ions for subsequent analysis. The time required to refill the volume 254 in the vicinity of the exit lens with ions will always be shorter than the time required to refill the entire trapping volume.

As an alternative, instead of scanning the auxiliary AC voltage applied to end lens 242, the auxiliary AC voltage on end lens 242 can be fixed and the main AC voltage applied to rods 238 can be scanned in amplitude, as will be described. While this does change the trapping conditions, a q of only about 0.2 to 0.3 is needed for axial ejection, while a q of about 0.908 is needed for radial ejection. Therefore, few if any ions are lost to radial ejection within the rod set in region 260 if the AC voltage is scanned through an appropriate amplitude range, except possibly for very low mass ions.

As a further alternative, and instead of scanning either the AC voltage applied to rods 238 or the auxiliary AC voltage applied to end lens 242, a further supplementary or auxiliary AC dipole voltage or quadrupole voltage may be applied to rods 238 (as indicated by dotted connection 257 in FIG. 13) and scanned, to produce varying fringing fields which will eject ions axially in the manner described. Alternatively, dipole excitation may be applied between the X pair and at the same time additional dipole excitation may be applied between the Y rod pair. This is of particular advantage when the trapping field provided by the AC voltage applied to the rods has an added hexapole component. That is, with a conventional rod set, only about 20% of the ions confined in the linear trap can be axially ejected; the remaining 80% appear to be lost by striking the rods (J. Hager, "A New Linear Ion Trap Mass Spectrometer", *Rapid Communications in Mass Spectrometry,* 2002, Vol. 16, 512). However, as described above, with a linear quadrupole having an added hexapole field, a greater excitation voltage is required to cause ions to strike the rods, and ions can be continuously excited without striking the rods. Thus, the percentage of ions that are axially ejected is increased and the percentage of ions that strike the rods is reduced.

Alternatively, a combination of some or all of the above three approaches (namely scanning an auxiliary AC field applied to the end lens 242, scanning the AC voltage applied to the rod set 238 while applying a fixed auxiliary AC voltage to end lens 242, and applying an auxiliary AC voltage or voltages to the rod set 238 in addition to that on lens 242 and the AC on rods 238) can be used to eject ions axially and mass dependently past the DC potential barrier present at the end lens 242.

Depending on the context, it is sometimes better to have unbalanced AC applied between the rods. In other contexts, it is also advantageous to have DC between the rods, typically 0.5 to 50 volts (see J. Hager, "Performance Optimization and Fringing Field Modification of a Twenty-Four Millimeter Long RF Only Quadrupole Mass Spectrometer", *Rapid Communications in Mass Spectrometry,* 1999, Vol. 13, 740; see also U.S. Pat. No. 6,177,668). It depends on the context. Accordingly, it is advantageous to have as many different modes of operation as possible, as different modes of operation may be preferred in different contexts.

As the rod sets according to the present invention that have added hexapole fields do not have four-fold symmetry about this central axis, there are more modes of operation for axial ejection than with a conventional rod set, which has four-fold symmetry. The excitation can be applied as a voltage to the exit aperture, as dipole excitation between the X rods or between the Y rods, as quadrupole excitation or as dipole excitation applied between the X rods with, at the same time, dipole excitation applied between the Y rods. In addition, the trapping field can be AC-only with the AC balanced or unbalanced, or contain a DC component with positive DC applied to the X rods or with positive DC applied to the Y rods. Several modes of operation with positive ions are shown below:

| Trapping Voltage | DC Between Rods | Excitation Mode |
|---|---|---|
| AC balanced | None | Aperture |
| AC unbalanced, greater V provided to the X rods | +X rods | Dipole X rods |
| AC unbalanced, greater V provided to the Y rods | +Y rods | Dipole Y rods |
| | | Quadrupole |
| | | Auxiliary AC voltage applied to aperture and X rods |
| | | Auxiliary AC voltage applied to aperture and Y rods |
| | | Auxiliary AC quadrupole voltage applied to aperture and all rods |
| | | Dipole X rods and dipole Y rods |
| | | Dipole X rods and dipole Y rods and auxiliary AC voltage applied to aperture |

In principle, any of the three trapping voltages can be combined with any of the three methods of applying DC between the rods, which could be used with any of the nine excitation modes. Thus, there are 3×3×9=81 modes of operation for positive ions. With each of these modes, either the AC amplitude is scanned to bring ions sequentially into resonance with the AC excitation field or fields, or else the frequency of the modulation is scanned so that again, when such frequency matches a resonant frequency of an ion in the fringing fields in the vicinity of the exit lens, the ion will absorb energy and be ejected axially for detection. Thus there are 81×2=162 methods of scanning to mass selectively eject ions axially.

The device illustrated may be operated in a continuous fashion, in which ions entering the main AC containment field applied to rods 238 are transported by their own residual momentum toward the exit lens 242 and ultimate axial ejection. Thus, the ions which have reached the extraction volume in the vicinity of the exit lens have been preconditioned by their numerous collisions with background gas, eliminating the need for an explicit cooling time (and the attendant delay) as is required in most conventional ion traps. At the same time as ions are entering the region 260, ions are being ejected axially from region 254 in the mass dependent manner described.

As a further alternative, the DC offset applied to all four rods 238 (which in the example given is −5 volts) can be modulated at the same frequency as the AC that would have been applied to exit lens 242. In that case no AC is needed on exit lens 242 since modulating the DC offset is equivalent to applying an AC voltage to the exit lens, in that it creates an AC field in the fringing region. Of course the DC potential barrier is still applied to the exit lens 242. The amplitude of the modulation of the DC offset will be the same as the amplitude of the AC voltage which otherwise would have been applied to the exit lens 242, i.e. it is set to optimize the axially ejected ion signal. Then, either the AC amplitude is scanned to bring ions sequentially into resonance with the AC field created by the DC modulation, or else the frequency of the modulation is scanned so that again, when such frequency matches a resonant frequency of an ion in the fringing fields in the vicinity of the exit lens, the ion will absorb energy and be ejected axially for detection. Preferably, the rod offset would not be modulated until after ions have been injected and trapped within the rods, since the modulation would otherwise interfere with ion injection, so this process would be a batch process. This is in contrast to the continuous process possible when AC is placed on the exit lens, in which case ions can be ejected from the extraction region 254 at the same time as ions are entering region 260 (because the AC field on exit lens 242 does not affect ion injection).

Quadrupoles with Combined Hexapole and Octopole Fields Added

Quadrupoles may also be constructed that have both hexapole and octopole fields added. In this case the frequency of ion motion also shifts as the amplitude of ion motion increases. The frequency shift will depend on the signs and magnitudes of the amplitudes of the added hexapole and octopole fields. When both hexapole and octopole fields are added, the potential is given by $$\Phi(x, y, t) = \left[A_2\left(\frac{x^2 - y^2}{r_0^2}\right) + A_3\left(\frac{x^3 - 3xy^2}{r_0^3}\right) + A_4\left(\frac{x^4 - 6x^2y^2 + y^4}{r_0^4}\right)\right](U - V\cos\Omega t) \tag{19.7}$$

The rod shapes that give this field are calculated as follows $$\left[A_2\left(\frac{x^2 - y^2}{r_0^2}\right) + A_3\left(\frac{x^3 - 3xy^2}{r_0^3} + A_4\left(\frac{x^4 - 6x^2y^2 + y^4}{r_0^4}\right.\right.\right] = \pm\text{constant} \tag{19.8}$$

Figure 14:
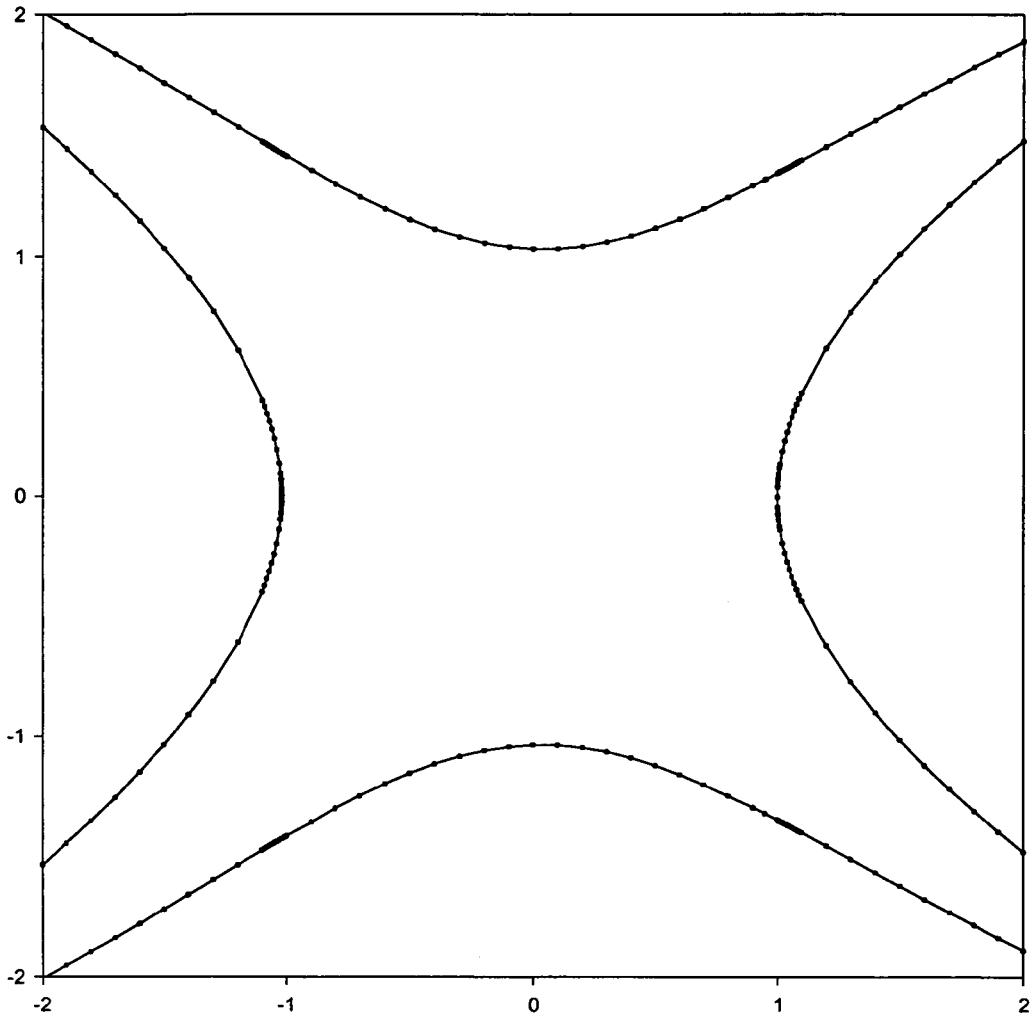
FIG. 14 is a graph illustrating electrode shapes suitable for producing a substantially quadrupole field having a 2% hexapole component and 2% octopole component.

An example is shown in FIG. 14 which shows the electrodes for a quadrupole with $A_2$=+0.96, $A_3$=+0.02 and $A_4$=+0.02. Solutions of equation 19.8 will give exactly the field of equation 19.7. However it is preferable to construct the electrodes with round (cylindrical) electrodes because these can be manufactured to high precision at lower cost.

In equation 19.7 each of $A_2$, $A_3$ and $A_4$ may be positive or negative. As well the DC voltage applied to the X rods may be positive or negative (equivalent to a positive or negative Mathieu parameter, a, in equation 7). Thus there are $2^4$=16 possible combinations of $A_n$ and DC polarities. However these are not all physically different. For example changing the sign of all $A_n$ is equivalent to changing the sign of a.

As described in US patent application "Improved Geometry for Generating a Substantially Quadrupole Field, Michael Sudakov, Chuan-Fan Ding and D. J. Douglas, U.S. application Ser. No. 10/211,238, filed Aug. 5, 2002, an octopole component can be added to a quadrupole field by constructing the rod set with the rods of one pair different in diameter from the other pair. For example if the Y rods have greater diameter than the X rods, there is a positive octopole component ($A_4$>0) and all other higher multipoles remain small.

Both an octopole and hexapole component can be added to a quadrupole field by constructing the rod set with the rods of one pair different in diameter from the other pair, and then rotating the rods of one pair toward one rod of the other pair. This can be done in two ways. The larger rods can be rotated toward one of the smaller rods, or the smaller rods can be rotated toward one of the larger rods.

Figure 15:
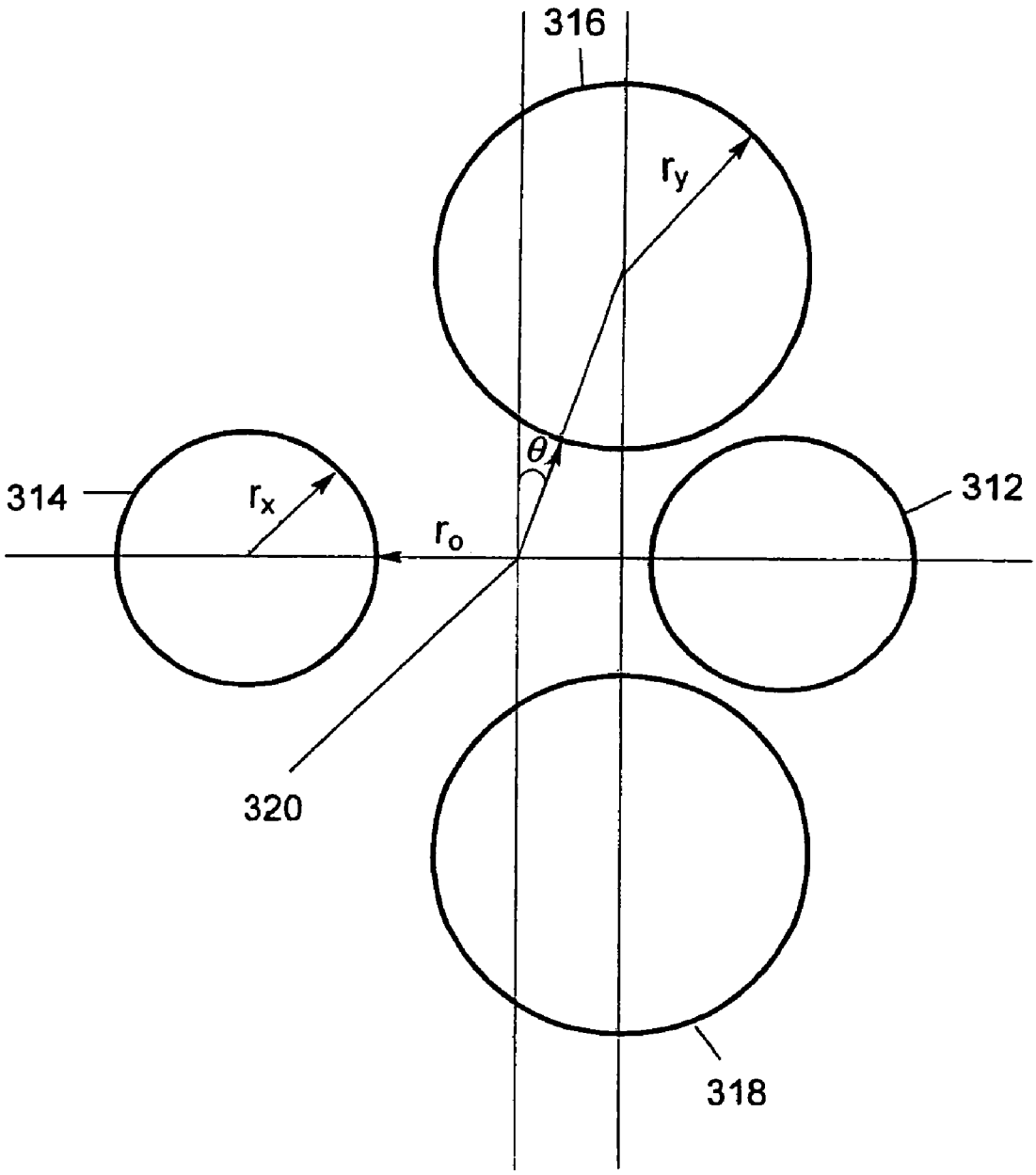
FIG. 15 is sectional view showing rotation of the Y rods towards one of the X rods and away from the other of the X rods, and also showing the increased radius of the Y rods relative to the X rods.

Referring to FIG. 15 there is illustrated in a sectional view, a set of quadrupole rods including Y rods that have undergone such a rotation through an angle θ. The set of quadrupole rods includes X rods 312 and 314, Y rods 316 and 318, and quadrupole axis 320. The Y rods have radius $r_y$ and the X rods radius $r_x$. All rods are a distance $r_0$ from the central axis 320 and $r_x=r_0$. The radius of the Y rods is greater than the radius of the X rods ($r_y>r_x$). When the Y rods are rotated toward the X rods, a dipole potential of amplitude $A_1$ is created. This can be removed by increasing the magnitude of the voltage on X rod 312 relative to the magnitude of the voltage applied to X rod 314 and Y rods 316 and 318, as described above for the case where a hexapole field is added to a quadrupole field by rotating two rods of one rod pair toward a rod of the second rod pair.

FIGS. 16 to 20 inclusively show the amplitudes of the higher spatial harmonics for rotation angles, θ, between about 0.5 and 3.5 degrees. The ratios of Y rod radius to X rod radius in these figures are $r_y/r_x$ of 1.20, 1.40, 1.60, 1.80, and 2.00 respectively. For each angle of rotation, a ratio of the voltage applied to X rod 312 relative to X rod 314 and Y rods 316 and 318 was chosen to make $A_1$ small. The angle was then adjusted slightly to make $A_1<1\times10^{-5}$ i.e. to make $A_1$ very close to zero. Thus, FIGS. 16 to 20 show the amplitudes of the harmonics for the case where $A_1\approx0$. FIGS. 16 to 20 show that an octopole component in the range +0.02 to +0.06 can be provided. If desired, a larger octopole component could be added. The octopole component is mostly determined by the ratio of rod radii, and changes little with rotation angle. At the same time, the rotation introduces a hexapole component in the range 0 (at θ=0) to +0.06 for the range of angles illustrated. When the larger rods are rotated toward the smaller rods, the hexapole and octopole components have the same sign (positive in this case).

Figure 16:
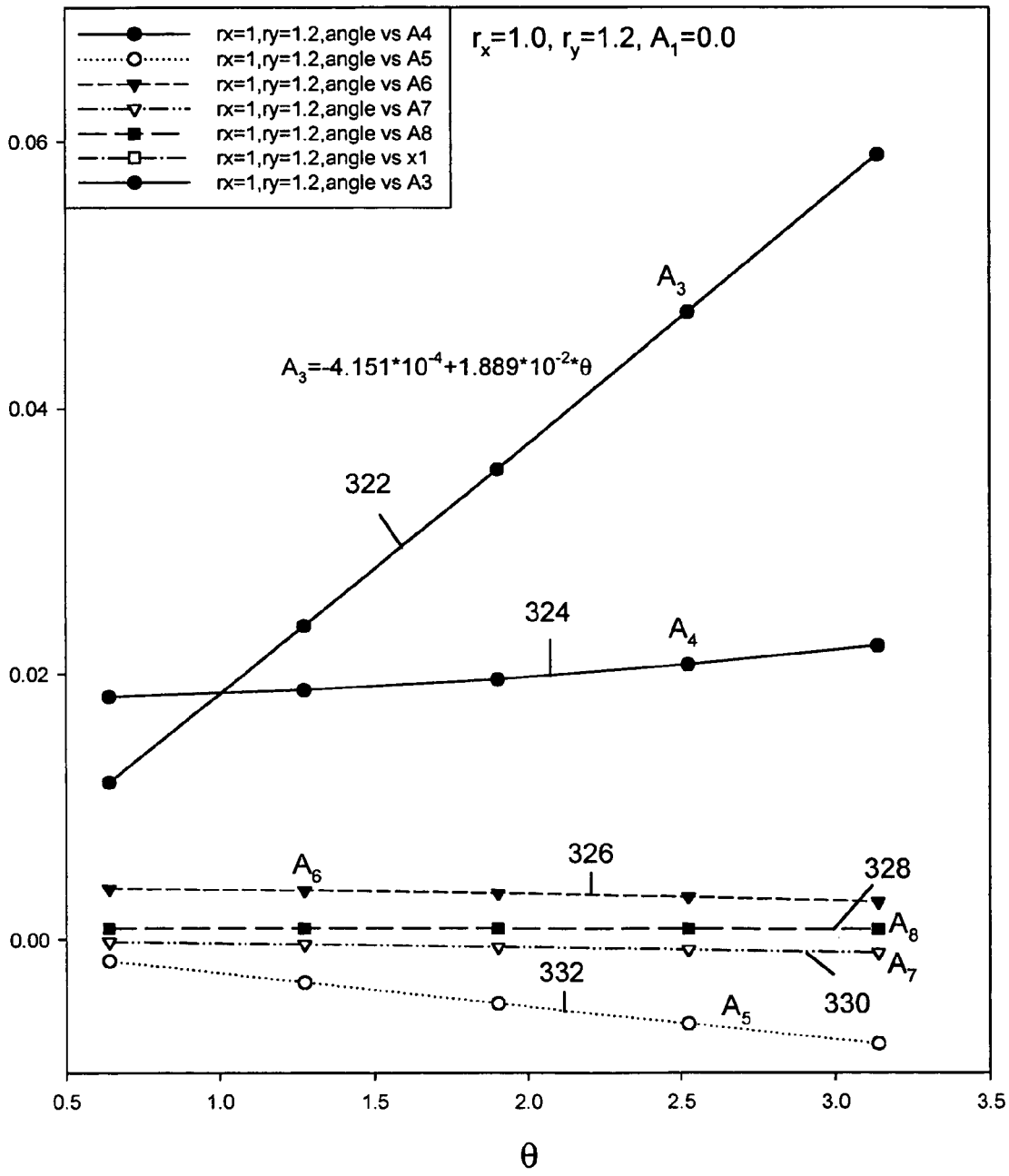
FIG. 16 is a graph plotting change in higher spatial harmonic amplitude against change in rotation angle for the quadrupole of FIG. 15 in which the ratio of Y rod radius to X rod radius is 1.2.

Referring to FIG. 16, the amplitudes of higher spatial harmonics are plotted in a graph for different rotation angles θ when the ratio of Y rod radius to X rod radius is 1.2. Specifically, line 322 indicates that the hexapole harmonic $A_3$ increases nearly linearly and significantly with increases in the rotation angle θ. In contrast, as indicated by line 324, the amplitude $A_4$ of the octopole component increases only slightly with increases in the angle θ. Lines 326, 328 and 330 representing the amplitudes $A_6$, $A_8$ and $A_7$ respectively of various higher order components of the field are left substantially unchanged by increases in θ. As indicated by line 332, amplitude $A_5$ becomes slightly more negative with increases in θ.

Figure 17:
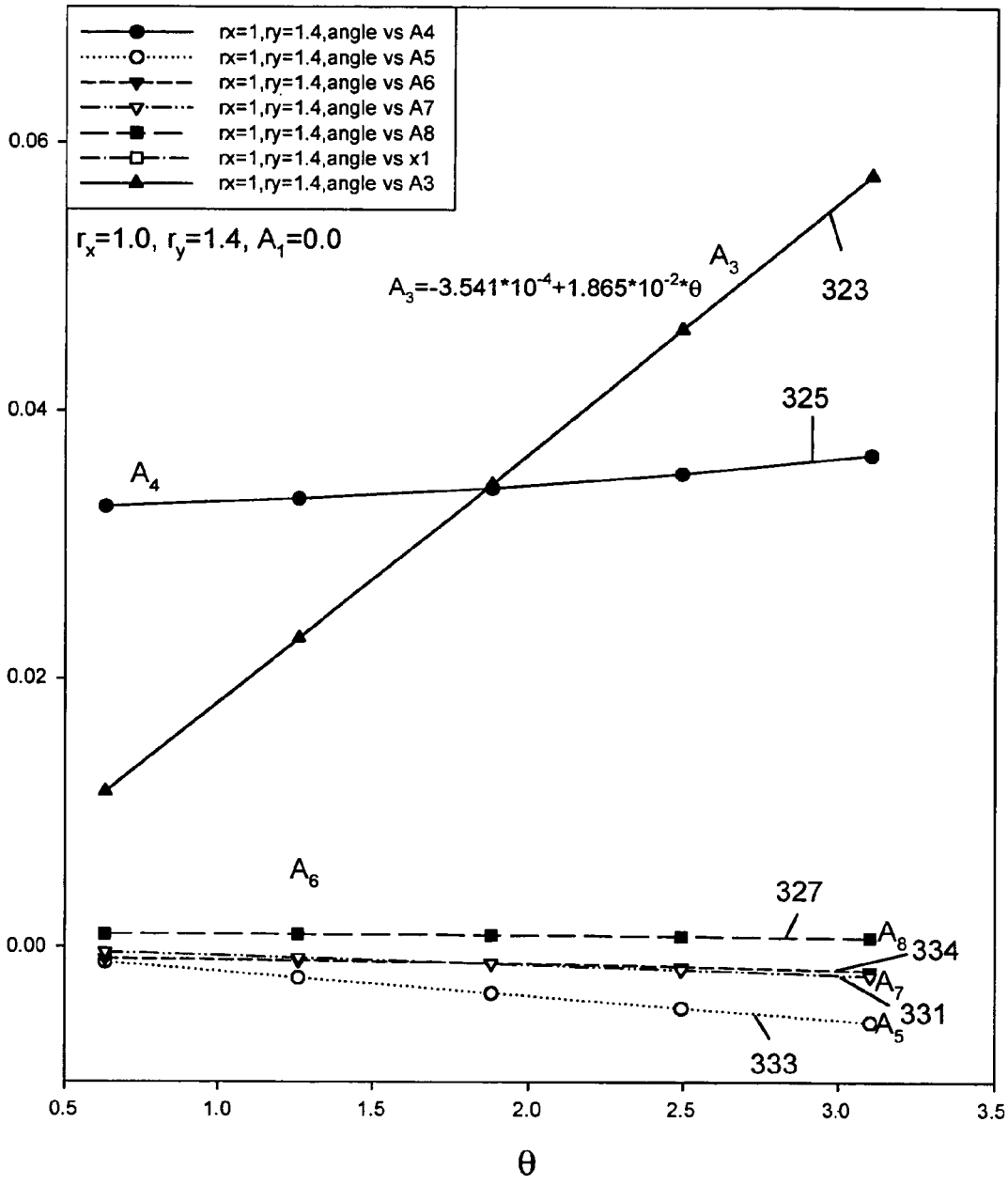
FIG. 17 is a graph plotting change in higher spatial harmonic amplitude against change in rotation angle for the quadrupole of FIG. 15 in which the ratio of Y rod radius to X rod radius is 1.4.

Referring to FIG. 17, the harmonic amplitude for higher spatial harmonics is plotted against the rotation angle θ for quadrupoles in which the ratio of the Y rod radius to X rod radius is 1.4. As indicated by line 323, the amplitude $A_3$ of the hexapole component of the field increases substantially and nearly linearly with increases in the rotation angle θ. As indicated by line 325, the amplitude $A_4$ of the octopole component increases very slightly with increases in θ. Lines 327, 334 and 331 representing the amplitudes $A_8$, $A_6$ and $A_7$ respectively, are substantially flat indicating that these amplitudes remain substantially the same despite increases in the rotation angle θ. As indicated by line 333, amplitude $A_5$ becomes slightly more negative with increases in the rotation angle θ.

Figure 18:
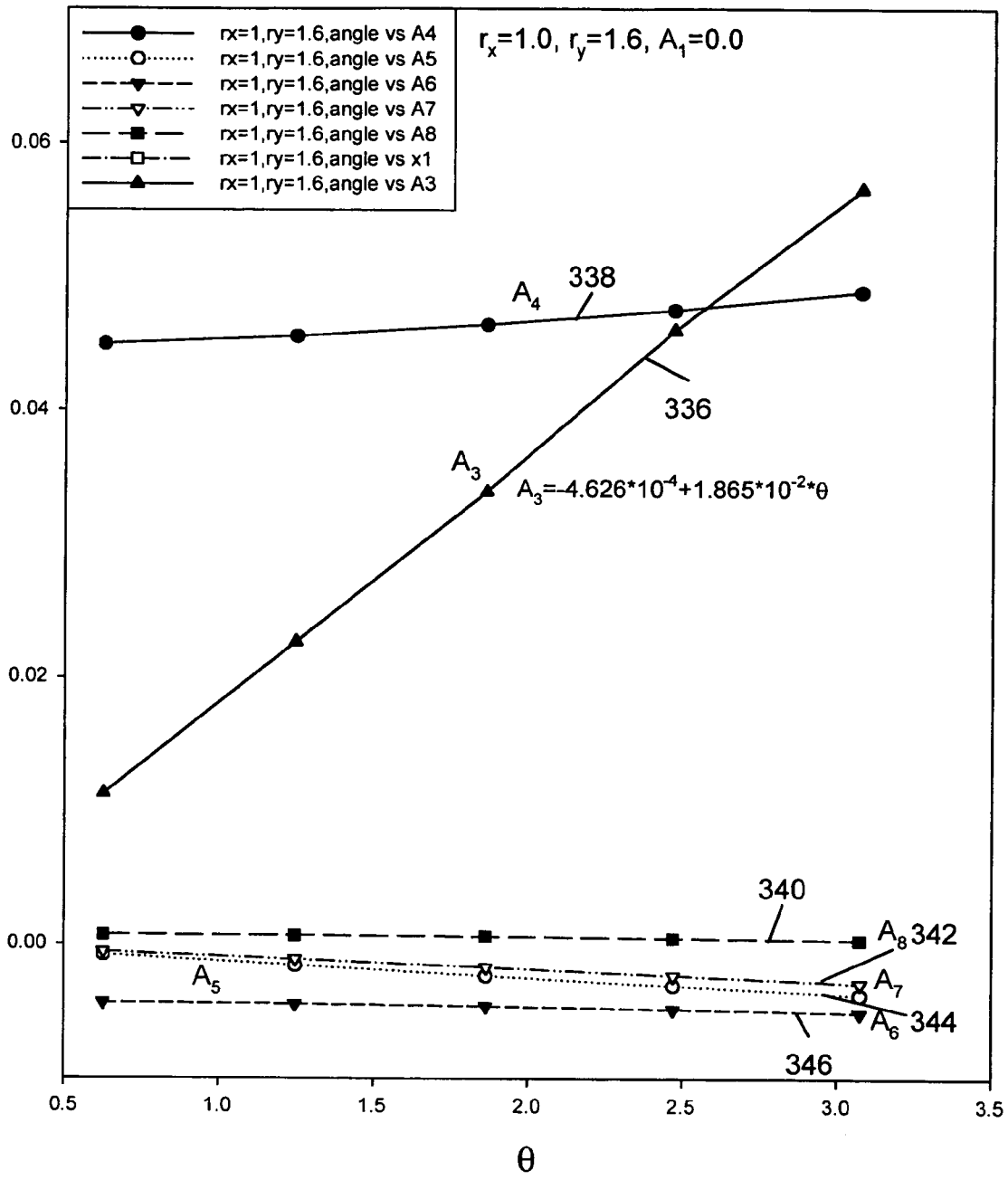
FIG. 18 is a graph plotting change in higher spatial harmonic amplitude against change in rotation angle for the quadrupole of FIG. 15 in which the ratio of Y rod radius to X rod radius is 1.6.

In FIG. 18 the amplitudes of higher spatial harmonics are plotted against the rotation angle θ where the ratio of the Y rod radius to the X rod radius is 1.6. As shown in FIG. 18, the relationship is substantially the same as in FIGS. 16 and 17. Specifically, line 336 representing hexapole amplitude $A_3$ has a relatively steep slope, indicating that $A_3$ increases substantially with increases in the rotation angle θ. Line 338 representing octopole amplitude $A_4$ has only a very slight slope, indicating a very slight increase in the octopole amplitude $A_4$ due to increases in the rotation angle θ. Lines 340 and 346, representing amplitudes $A_8$ and $A_6$ respectively, are substantially flat, indicating that these amplitudes are left largely unchanged by increases in the rotation angle θ. Lines 342 and 344 representing the amplitudes $A_7$ and $A_5$ have slight negative slopes, indicating that these amplitudes become slightly more negative with increases in the rotation angle θ.

Figure 19:
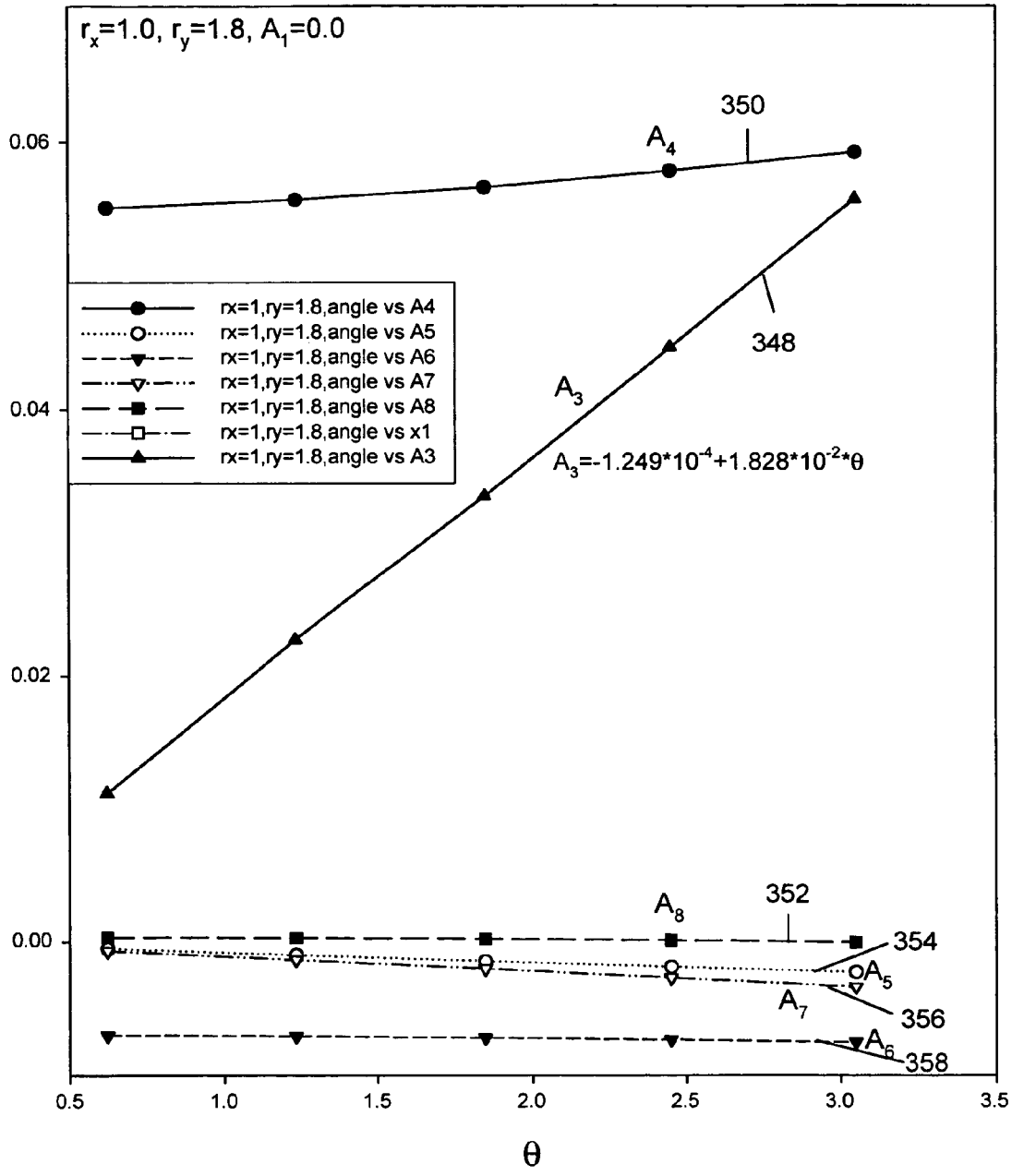
FIG. 19 is a graph plotting change in higher spatial harmonic amplitude against change in rotation angle for the quadrupole of FIG. 15 in which the ratio of Y rod radius to X rod radius is 1.8.

FIG. 19 plots the amplitudes of the higher spatial harmonics against the rotation angle θ for quadrupoles in which the ratio of Y rod radius to X rod radius is 1.8. The relationships are similar to those described in FIG. 18. Specifically, line 348 representing hexapole amplitude $A_3$ has a steep slope indicating that this amplitude increases markedly with increases in the rotation angle θ. Line 350 representing the octopole amplitude $A_4$ has a very slight slope, indicating that $A_4$ increases only slightly with increases in rotation angle θ. Line 352 and 358 representing amplitudes $A_8$ and $A_6$ respectively are substantially flat, indicating that these amplitudes are left substantially unchanged as a result of increases in the rotation angle θ. Lines 354 and 356 representing amplitudes $A_5$ and $A_7$ have slight negative slopes indicating that these amplitudes become slightly more negative as a result of increases in the rotation angle θ.

Figure 20:
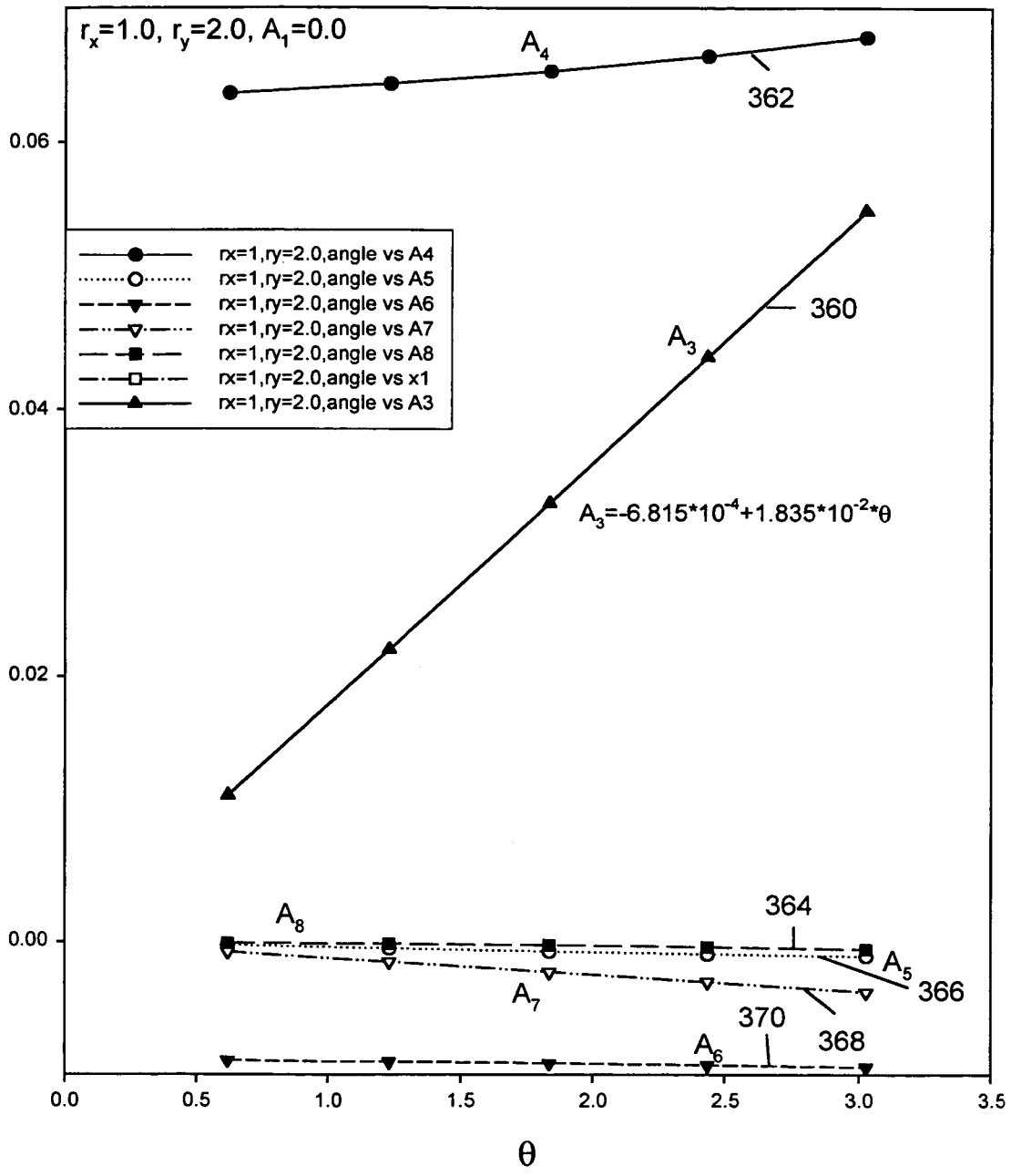
FIG. 20 is a graph plotting change in higher spatial harmonic amplitude against change in rotation angle for the quadrupole of FIG. 15 in which the ratio of Y rod radius to X rod radius is 2.0.

Referring to FIG. 20, the amplitudes of the higher spatial harmonics is plotted against the rotation angle θ where the ratio of Y rod radius to X rod radius is 2.0. The relationships are similar to those described in FIG. 19. Specifically, line 360 representing hexapole amplitude $A_3$ has a steep slope indicating that this amplitude increases markedly with increases in the rotation angle θ. Line 362 representing the octopole amplitude $A_4$ has a very slight slope, indicating that $A_4$ increases only slightly with increases in rotation angle θ. Line 364 and 370 representing amplitudes $A_8$ and $A_6$ respectively are substantially flat, while lines 366 and 368 representing amplitudes $A_5$ and $A_7$ have slight negative slopes indicating that these amplitudes are left either unchanged or become slightly more negative as a result of increases in the rotation angle θ.

Figure 21:
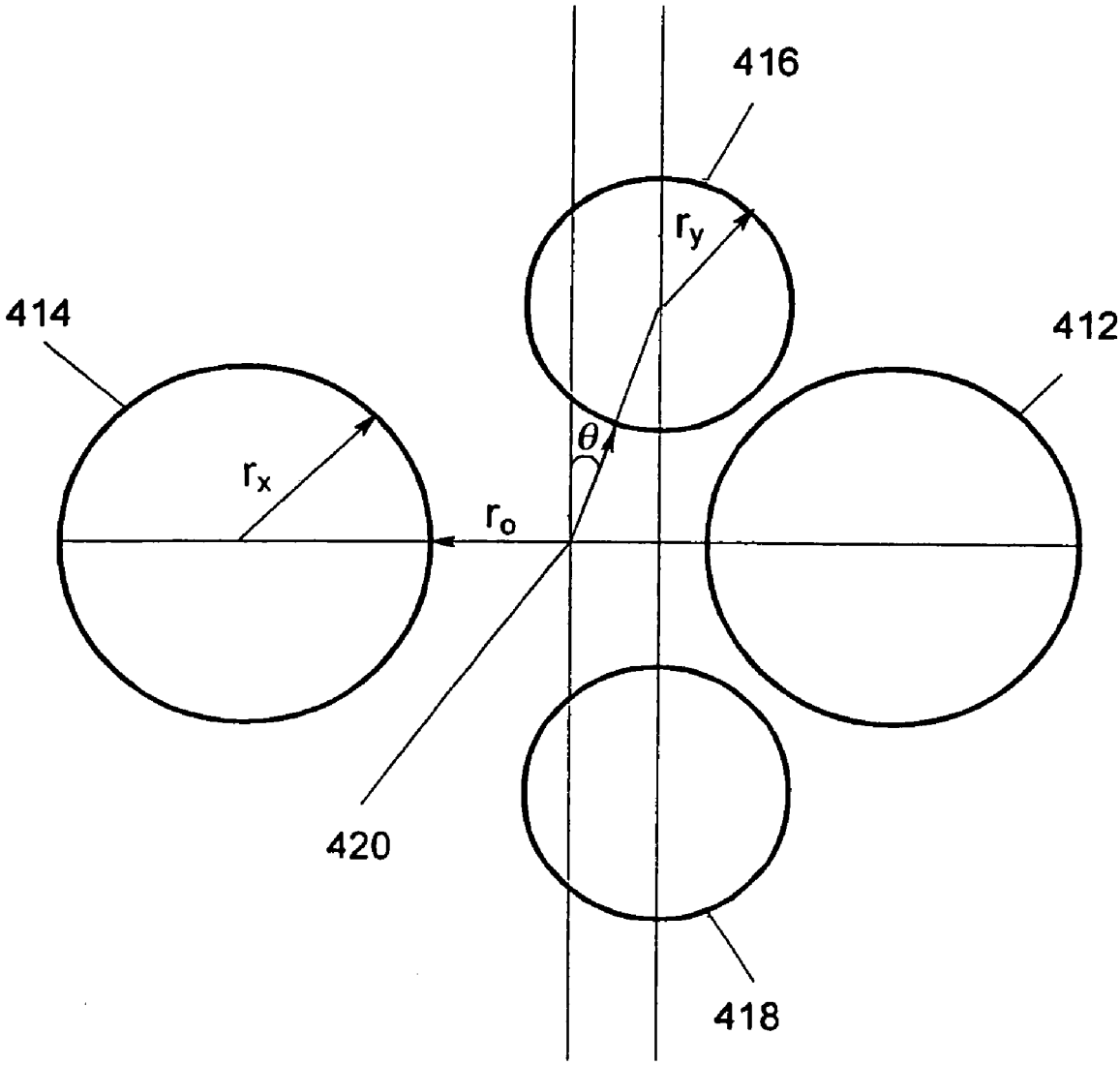
FIG. 21 is a sectional view showing rotation of the Y rods towards one of the X rods and away from the other of the X rods, and in which the radius of the X rods has been enlarged relative to the radius of the Y rods.

Referring to FIG. 21 there is illustrated in a sectional view, another set of quadrupole rods including Y rods that have undergone a rotation through an angle θ about a quadrupole axis 420. The set of quadrupole rods includes X rods 412 and 414, Y rods 416 and 418, and quadrupole axis 420. The Y rods have radius $r_y$ and the X rods radius $r_x$. All rods are a distance $r_0$ from the central axis 420 and $r_y=r_0$. In this case the radius of the X rods is greater than the radius of the Y rods ($r_x>r_y$). The Y rods have been rotated towards the X rod 412. FIGS. 22 to 26 show the amplitudes of the higher harmonics for different rotation angles for ratios $r_x/r_y$ of 1.20, 1.40, 1.60, 1.80, and 2.0 respectively for the quadrupole of FIG. 21. For each angle of rotation, a ratio of the voltage applied to X rod 412 relative to X rod 414 and Y rods 416 and 418 was chosen to make $A_1$ small. The angle was then adjusted slightly to make $A_1<1\times10^{-5}$—i.e. to make $A_1$ very close to zero. Thus, FIGS. 22 to 26 show the amplitudes of the harmonics for the case where $A_1\approx0$. FIGS. 22 to 26 show an octopole component in the range −0.02 to −0.06. If desired, a larger octopole component could be added. The octopole component is mostly determined by the ratio of rod radii, and changes little with rotation angle. At the same time, the rotation introduces a hexapole component in the range 0 (at θ=0) to +0.06 for the range of angles illustrated. However in this case the octopole and hexapole components have opposite signs ($A_3>0$ and $A_4<0$).

Figure 22:
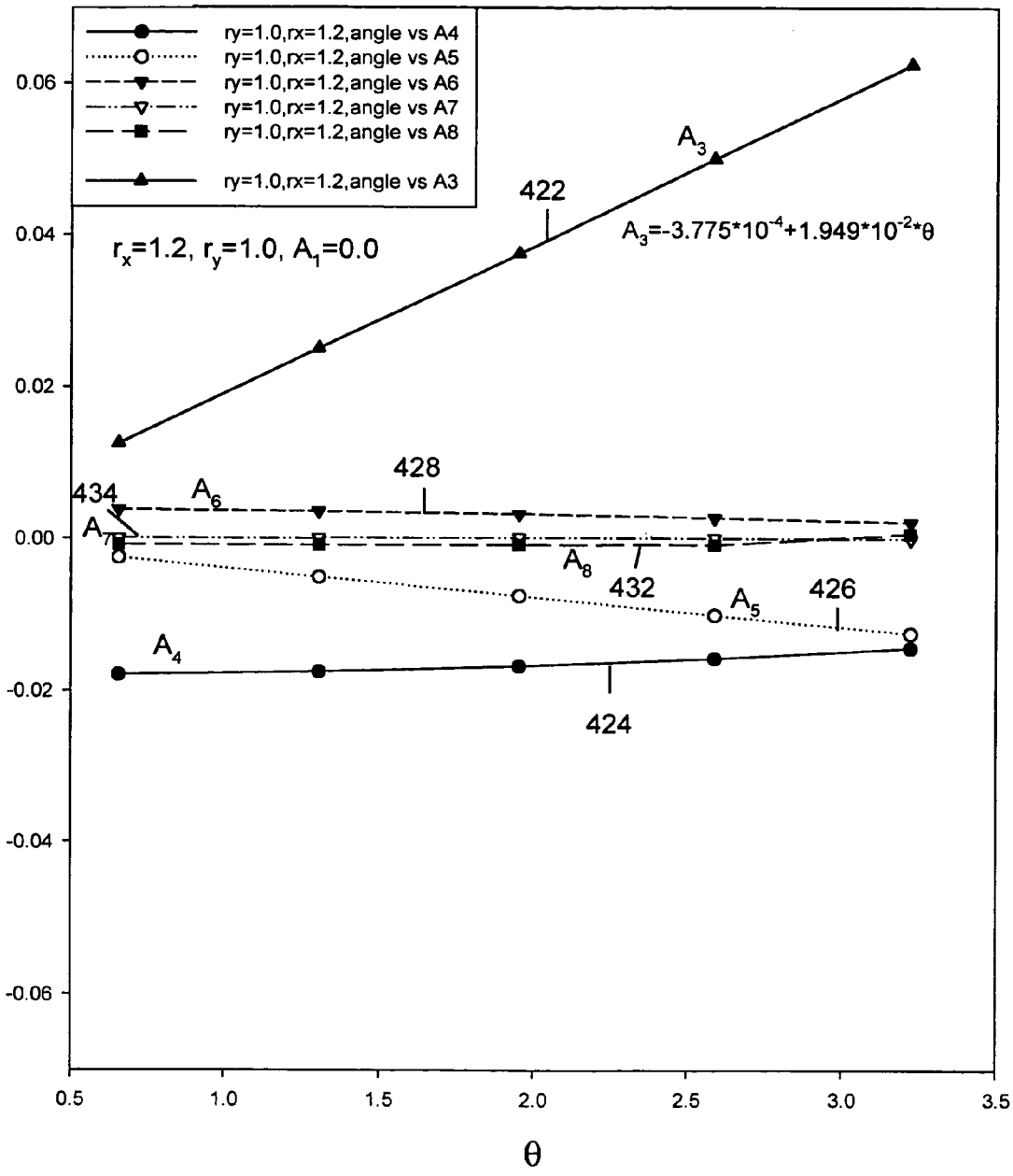
FIG. 22 is a graph plotting change in higher spatial harmonic amplitudes against change in rotation angle for the quadrupole of FIG. 21 in which the ratio of X rod radius to Y rod radius is 1.2.

In FIG. 22, the amplitudes of higher spatial harmonics are plotted against the rotation angle, θ, shown in FIG. 21, where the ratio of the X rod radius to the Y rod radius is 1.2. Line 422, representing a hexapole amplitude $A_3$, has a relatively positive and steep slope, indicating that $A_3$ increases substantially with increases in the rotation angle θ. Line 424, representing octopole amplitude $A_4$, has only a very slight slope, indicating $A_4$ becomes slightly less negative with increases in the rotation angle θ. Lines 426, representing amplitude $A_5$, has a slight negative slope, indicating that this amplitude becomes slightly more negative with increases in rotation angle θ. Lines 432, 434 and 428 representing amplitudes $A_8$, $A_7$ and $A_6$ respectively, are relatively flat, indicating that these amplitudes remain small with increases in rotation angle θ.

Figure 23:
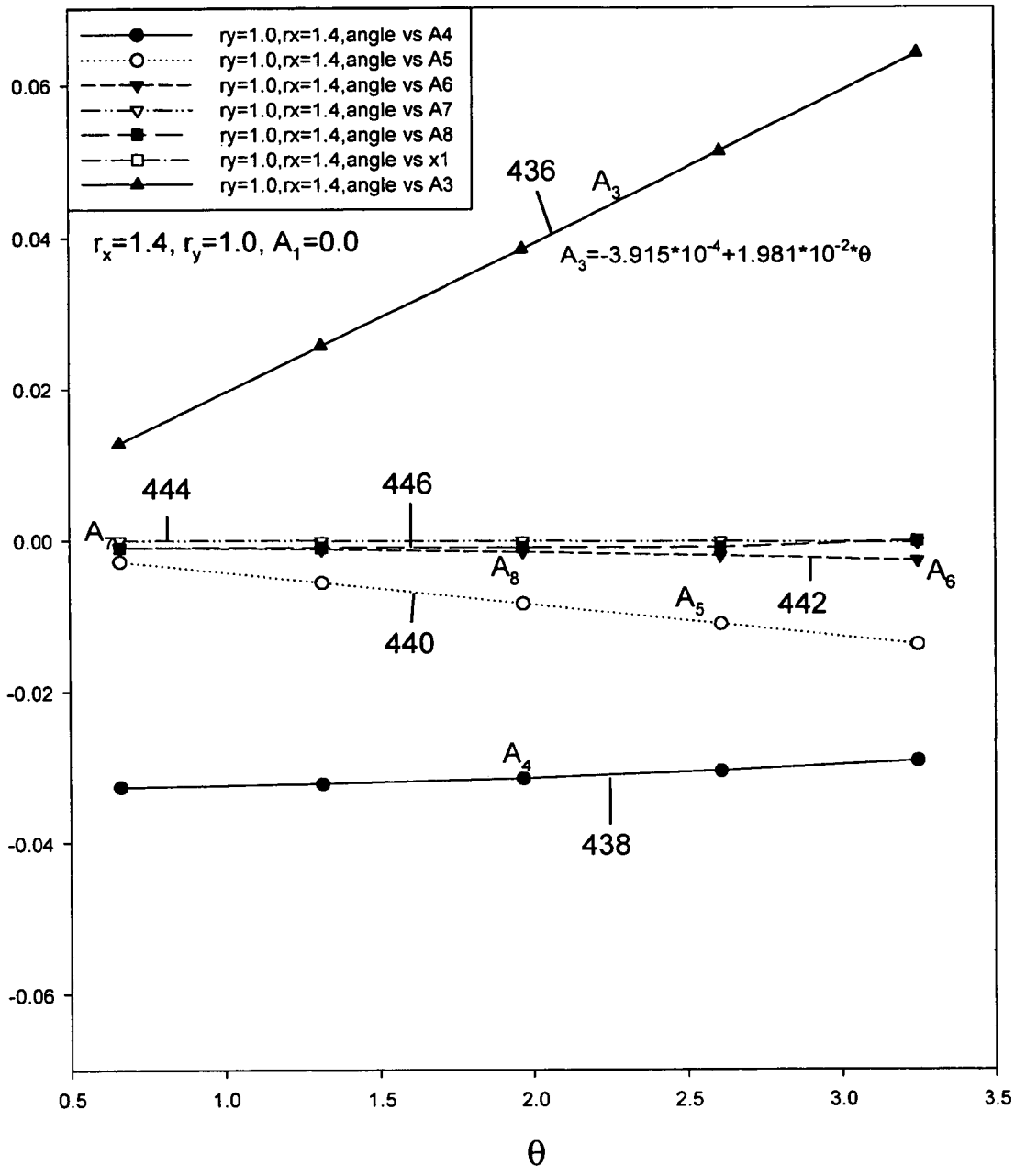
FIG. 23 is a graph plotting change in higher spatial harmonic amplitudes against change in rotation angle for the quadrupole of FIG. 21 in which the ratio of X rod radius to Y rod radius is 1.4.

In FIG. 23, the amplitudes of higher spatial harmonics are plotted against the rotation angle θ where the ratio of the X rod radius to the Y rod radius is 1.4. Line 436, representing hexapole harmonic $A_3$, has a relatively steep slope indicating that $A_3$ increases directly and substantially with increases in the rotation angle θ. Line 438, representing octopole amplitude $A_4$ has only a very slight slope, indicating $A_4$ becomes very slightly less negative with increases in the rotation angle θ. Lines 440 and 442 representing amplitudes $A_5$ and $A_6$ respectively have shallow negative slopes, indicating that these amplitudes become slightly more negative with increases in rotation angle θ. Lines 444 and 446, representing amplitudes $A_7$ and $A_8$, respectively remain substantially flat indicating that these amplitudes remain small with the rotation angle θ.

Figure 24:
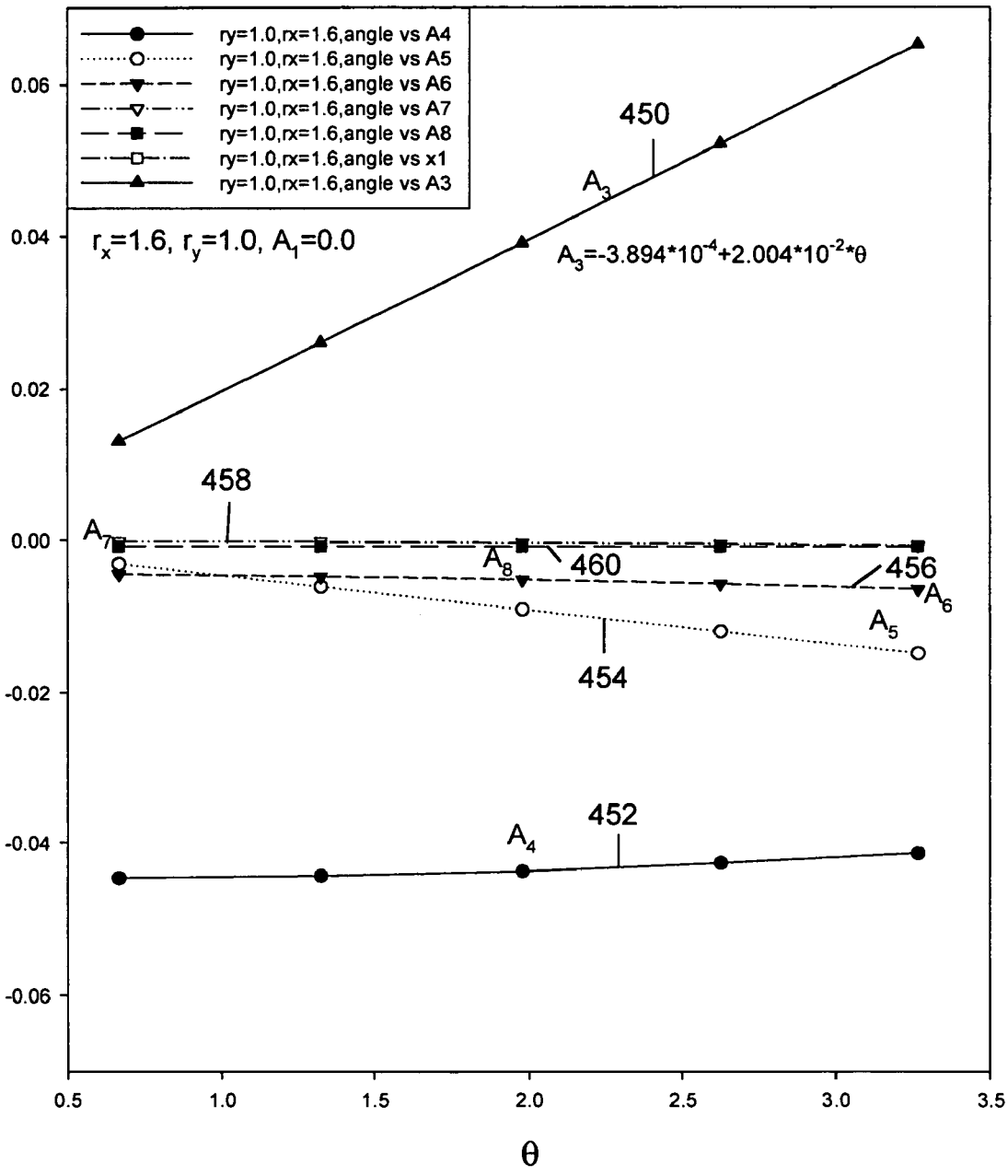
FIG. 24 is a graph plotting change in higher spatial harmonic amplitudes against change in rotation angle for the quadrupole of FIG. 21 in which the ratio of X rod radius to Y rod radius is 1.6.

Referring to FIG. 24, the amplitudes of higher spatial harmonics are plotted against a rotation angle θ where the ratio of the X rod radius to the Y rod radius is 1.6. Line 450, representing hexapole amplitude $A_3$, has a positive and relatively steep slope, indicating that $A_3$ increases significantly with increases in the rotation angle θ. Line 452, representing octopole amplitude $A_4$, has a very slight positive slope, indicating that $A_4$ becomes slightly less negative with increases in the rotation angle θ. Lines 454 and 456, representing amplitudes $A_5$ and $A_6$ respectively, have shallow negative slopes, indicating that these amplitudes become slightly more negative with increases in the rotation angle θ. Lines 458 and 460, representing amplitudes $A_7$ and $A_8$ respectively, are substantially flat, indicating that these amplitudes remain small with increases in the rotation angle θ.

Figure 25:
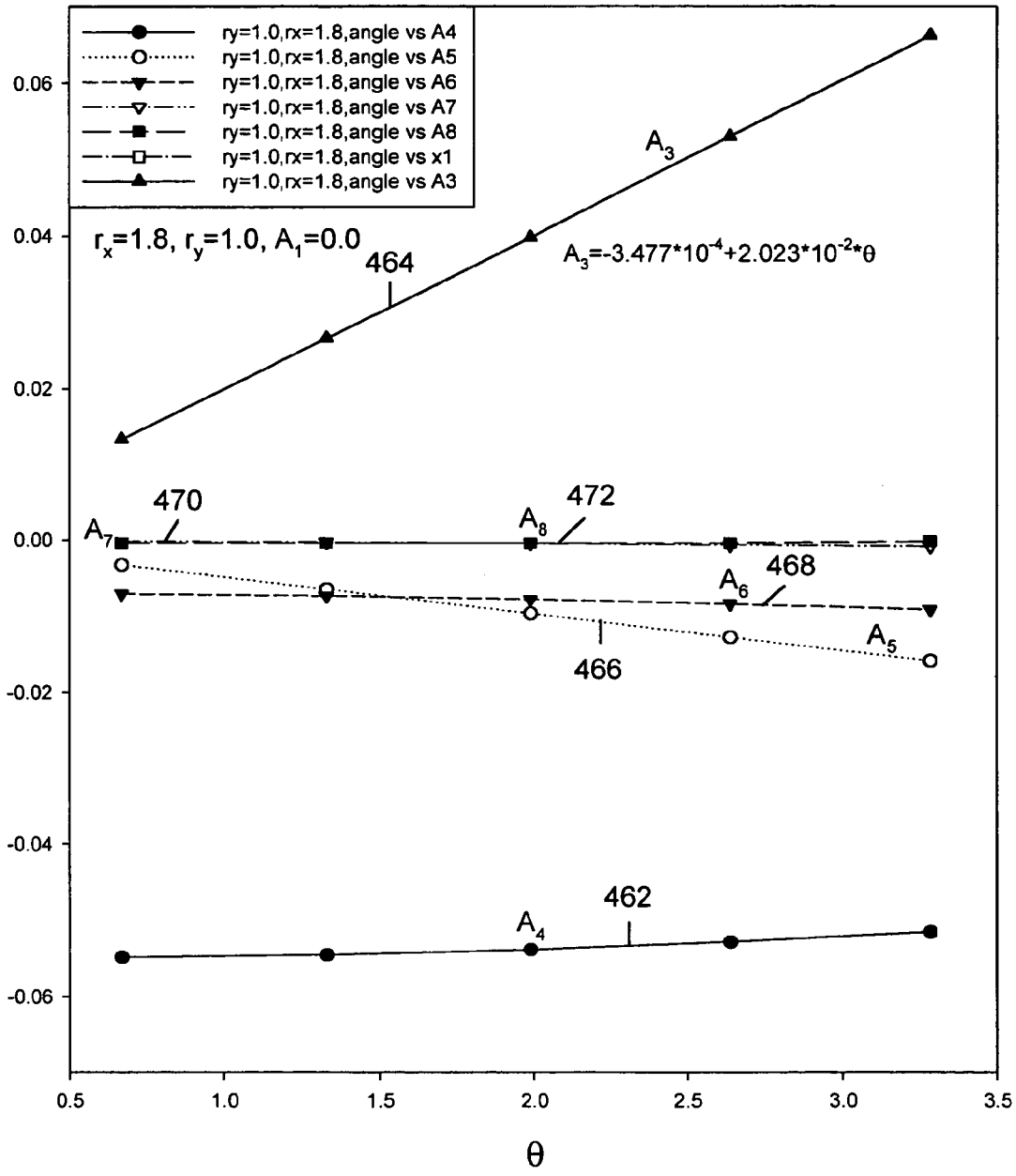
FIG. 25 is a graph plotting change in higher spatial harmonic amplitudes against change in rotation angle for the quadrupole of FIG. 21 in which the ratio of X rod radius to Y rod radius is 1.8.

Referring to FIG. 25, the amplitudes of higher spatial harmonics are plotted against rotation angle θ where the ratio of the X rod radius to the Y rod radius is 1.8. Line 464, representing hexapole amplitude $A_3$, has a relatively steep positive slope, indicating that amplitude $A_3$ increases significantly with increases in the rotation angle θ. Line 462, representing octopole amplitude $A_4$, has only a very slight slope, indicating $A_4$ becomes slightly less negative with increases in rotation angle θ. Lines 466 and 468, representing amplitudes $A_5$ and $A_6$ respectively, have slightly negative slopes, indicating that these amplitudes become slightly more negative with increases in rotation angle θ. Lines 470 and 472, representing amplitudes $A_7$ and $A_8$ respectively, are substantially flat, indicating that these amplitudes remain small with changes in the rotation angle θ.

Figure 26:
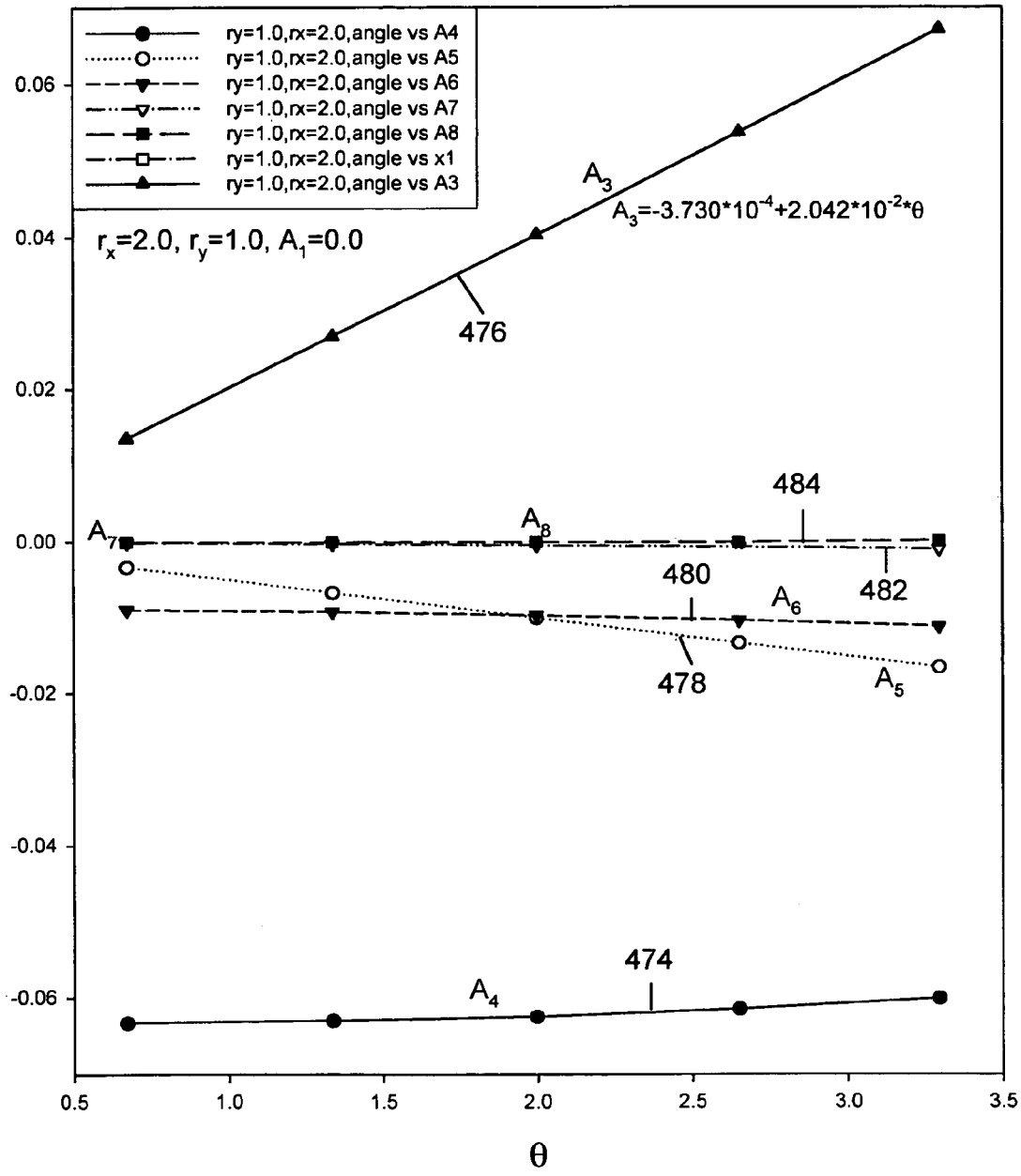
FIG. 26 is a graph plotting change in higher spatial harmonic amplitudes against change in rotation angle for the quadrupole of FIG. 21 in which the ratio of X rod radius to Y rod radius is 2.0.

Referring to FIG. 26, the amplitudes of higher spatial harmonics are plotted against the rotation angle θ where the ratio of the X rod radius to the Y rod radius is 2.0. Line 476 represents hexapole amplitude $A_3$ and has a relatively steep slope, indicating that $A_3$ increases significantly with increases in the rotation angle θ. Line 474, representing octopole amplitude $A_4$ has only a very slight slope, indicating that $A_4$ becomes slightly less negative with increases in the rotation angle θ. Lines 478 and 480, representing amplitudes $A_5$ and $A_6$ respectively, have a slight negative slope, indicating that these amplitudes become slightly more negative with increases in the rotation angle θ. Lines 482 and 484 represent amplitudes $A_7$ and $A_8$ respectively, and are substantially flat, indicating that these amplitudes remain small with increases in the rotation angle θ.

Mass Analysis with Combined Quadrupole and Hexapole Fields

A quadrupole mass filter which has both octopole and hexapole fields added, can be used for mass analysis, provided the signs of the added multipoles and applied DC are correct. Simulations of peak shapes have been done for a quadrupole with $A_3$ and $A_4$ terms of both signs. The simulations were done as described in the article "Influence of the $6^{th}$ and $10^{th}$ Spatial Harmonics on the Peak Shapes of a Quadrupole Mass Filter With Round Rods", D. J. Douglas and N. V. Konenkov, *Rapid Communications in Mass Spectrometry*, Vol. 16, 1425–1431, 2002.

Figure 27:
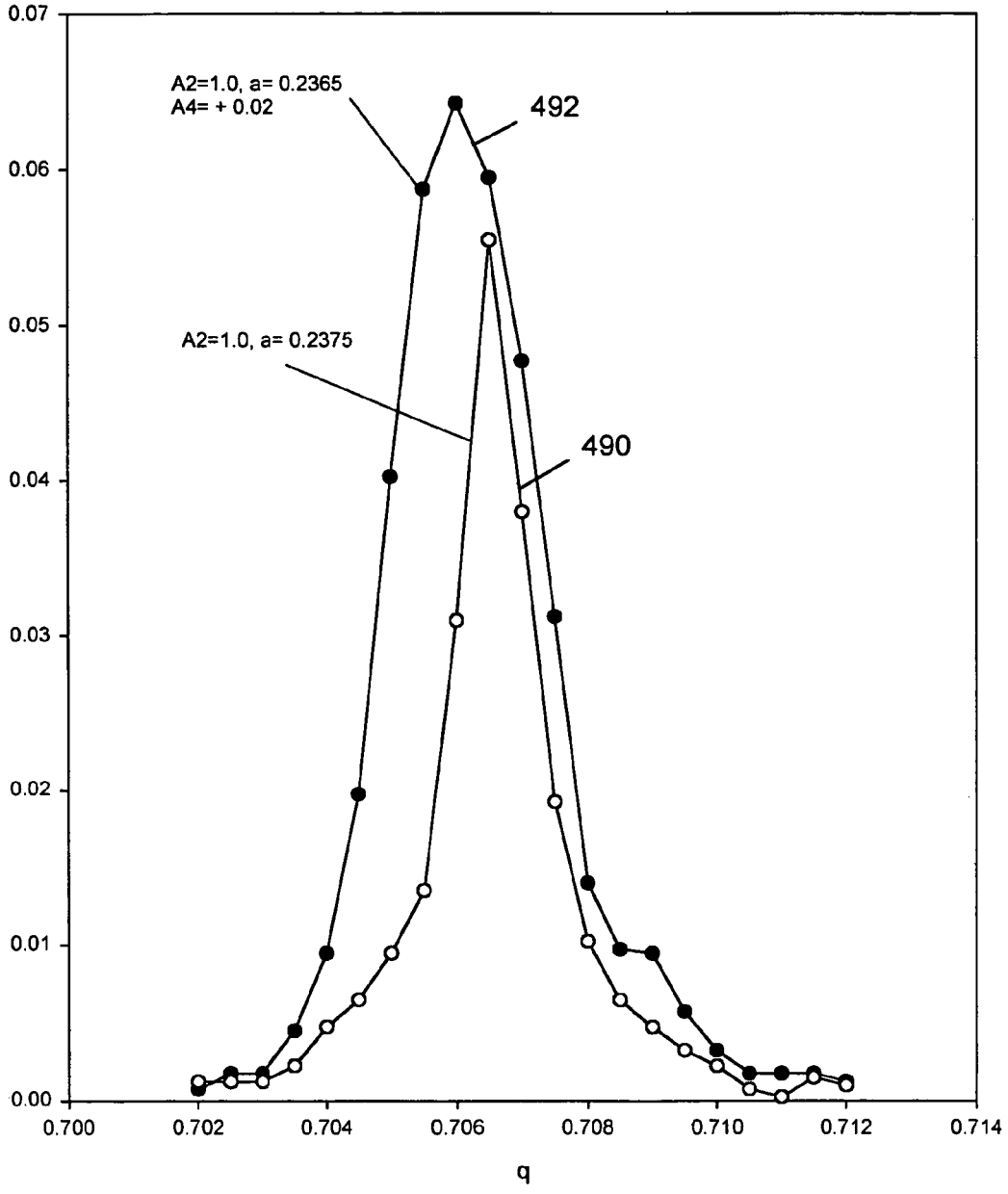
FIG. 27 is a graph of ion transmission through mass filters with a pure quadrupole field and for a quadrupole field with an added octopole field of amplitude $A_2$=+0.020.

FIG. 27 shows a peak shape 490 for a pure quadrupole field and a peak shape 492 for a quadrupole field (amplitude $A_2=1$) with an added octopole field of amplitude $A_2=+0.020$, and a>0. As described in US patent application "Improved Geometry for Generating a Substantially Quadrupole Field", Michael Sudakov, Chuan-Fan Ding and D. J. Douglas, U.S. application Ser. No. 10/211,238, filed Aug. 5, 2002, which is incorporated herein by reference, such an added octopole field can be created by using a rod set with Y rods greater in diameter than the X rods. For positive ions, provided the positive DC is applied to the X rods, the peak shape with the added octopole field has transmission and resolution similar to that of a pure quadrupole field. A slightly lower value of a is required for the same transmission and resolution.

For a quadrupole field with added octopole field, when $A_2>0$, there are two choices for the sign of $A_4$ and two choices for the sign of a (or equivalently, for the polarity of the applied DC), for a total of four possible combinations. However these are not all physically different. When $A_2>>A_4$, and $A_2>0$, the fields are described as follows $$A_4>0, a>0 \tag{1}$$

The field is stronger than a quadrupole field in the direction of the positive electrode and weaker in the direction of the negative electrode.

$$A_4>0, a<0 \tag{2}$$

The field is stronger in the direction of the negative electrode and weaker in the direction of the positive electrodes.

$$A_4<0, a>0 \tag{3}$$

The field is stronger in the direction of the negative electrode and weaker in the direction of the positive electrode.

$$A_4<0, a<0 \quad (4)$$

The field is stronger in the direction of the positive electrode and weaker in the direction of the negative electrode.

Thus (1) and (4) are equivalent physically and (2) and (3) are equivalent physically. They differ only in that the directions of x and y are interchanged. As shown in US patent application "Improved Geometry for Generating a Substantially Quadrupole Field", Michael Sudakov, Chuan-Fan Ding and D. J. Douglas, U.S. application Ser. No. 10/211,238, filed Aug. 5, 2002, for positive ions, good peak shape and transmission are only obtained with cases (1) and (4), and for negative ions with (2) and (3). Peak 492 of FIG. 27 corresponds to case (1). When a hexapole component is also added, all four cases differ.

Figure 28:
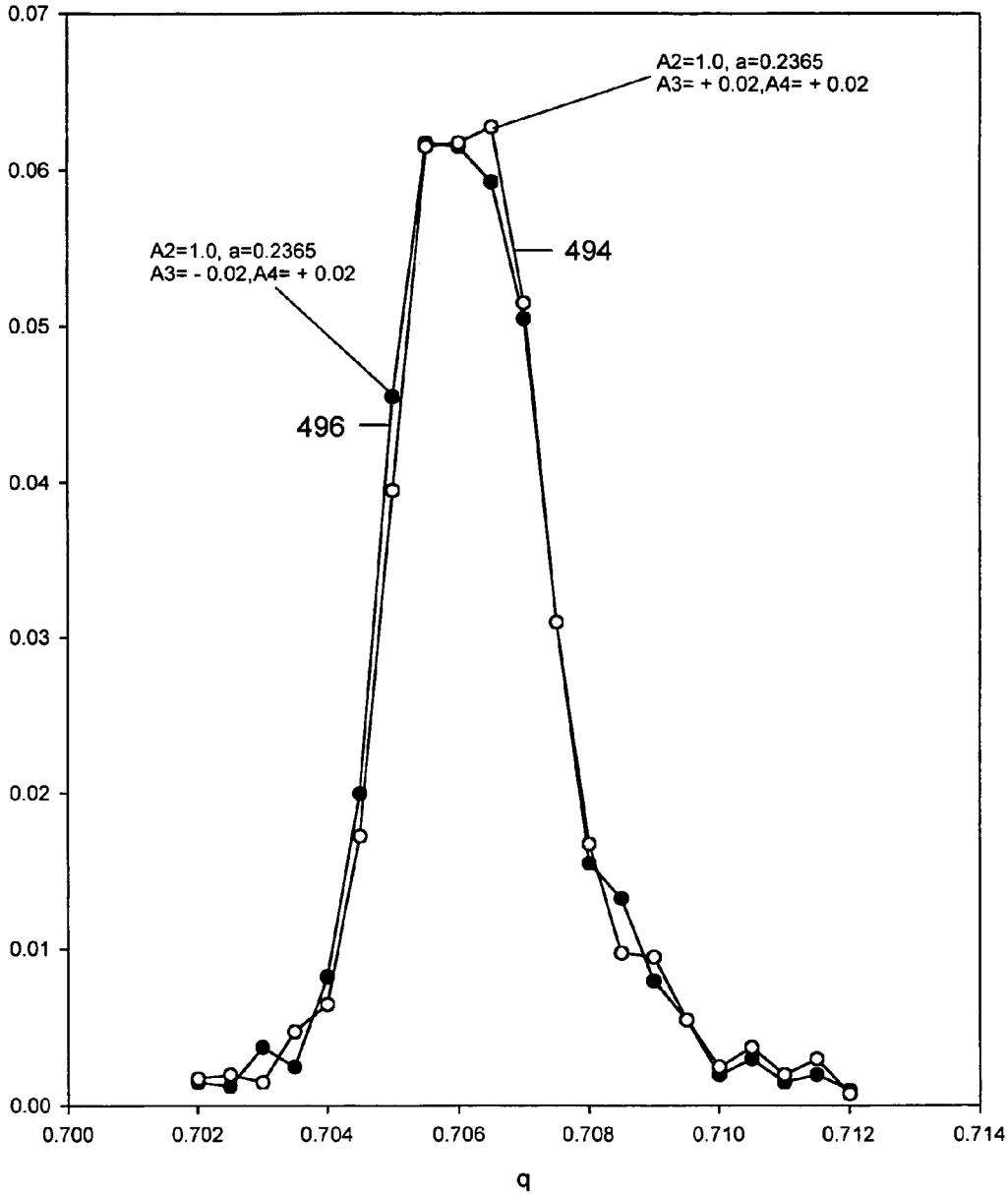
FIG. 28 is a graph of ion transmission through mass filters with a quadrupole amplitude $A_2$=1.0, a=0.2365, hexapole amplitude $A_3$=+0.02 and octopole harmonic $A_4$=+0.02, and for mass filters with a quadrupole field having a=0.2365, a hexapole amplitude $A_3$=−0.02, and an octopole amplitude $A_4$=+0.02.

FIG. 28 shows a peak shape 494 and a peak shape 496. Peak shape 494 is for positive ions with a quadrupole field with added octopole $A_4$=+0.020 and an added hexapole $A_3$=+0.02. Peak shape 496 is for positive ions with a quadrupole field with added octopole $A_4$=+0.020 and an added hexapole $A_3$=−0.02. With the added hexapole, the peak shape and transmission are very similar to that of the quadrupole with added octopole only (FIG. 27). In addition, the peak shapes with positive and negative hexapole terms are essentially the same. Examination of equation 19.7 shows that the sign of the hexapole term can be changed by making the substitution x→−x. At the same time the sign of the octopole is unchanged. Thus, rod sets with an added octopole are expected to show the same peak shape with positive and negative $A_3$ because they differ only by a reflection in the Y axis.

Figure 29:
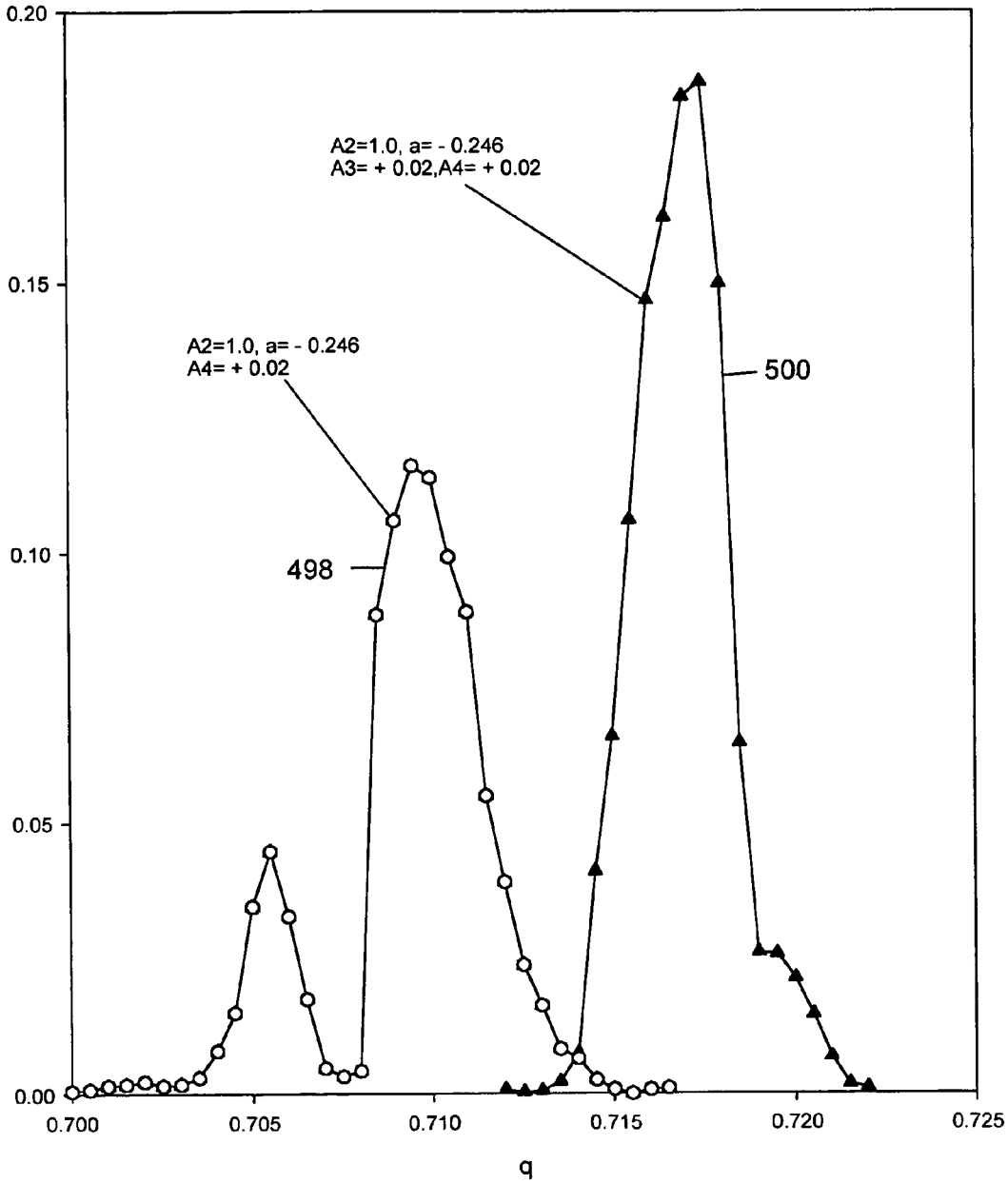
FIG. 29 is a graph of an ion transmission through mass filters with a quadrupole field with an added positive 2% hexapole and an added positive 2% octopole and a=−0.246, and through a quadrupole field with an added 2% octopole and a=−0.246.

FIG. 29 shows a peak shapes 498 for positive ions for $A_2$=+1.0, $A_4$=+0.02, a=−0.246 and $A_3$=0 and a peak shape 500 for positive ions for $A_2$=+1.0, $A_4$=+0.02, a=−0.246 and $A_3$=+0.02. As described above a negative value for a means the positive DC is connected to the Y rods and the negative DC is connected to the X rods. Where there is no added hexapole component, this corresponds to case (2) above and the peak 498 is badly split into two peaks. When a hexapole component with $A_3$=+0.02 is added, the peak 500 is not split, and the resolution and transmission are improved. The resolution ($R_{1/2}$=287) is comparable to that of FIG. 28 ($A_2$=+0.02, $A_3$=0). The transmission is ca. 3 times greater than that of the same field without the hexapole and of a pure quadrupole field at similar resolution (FIG. 27).

Figure 30:
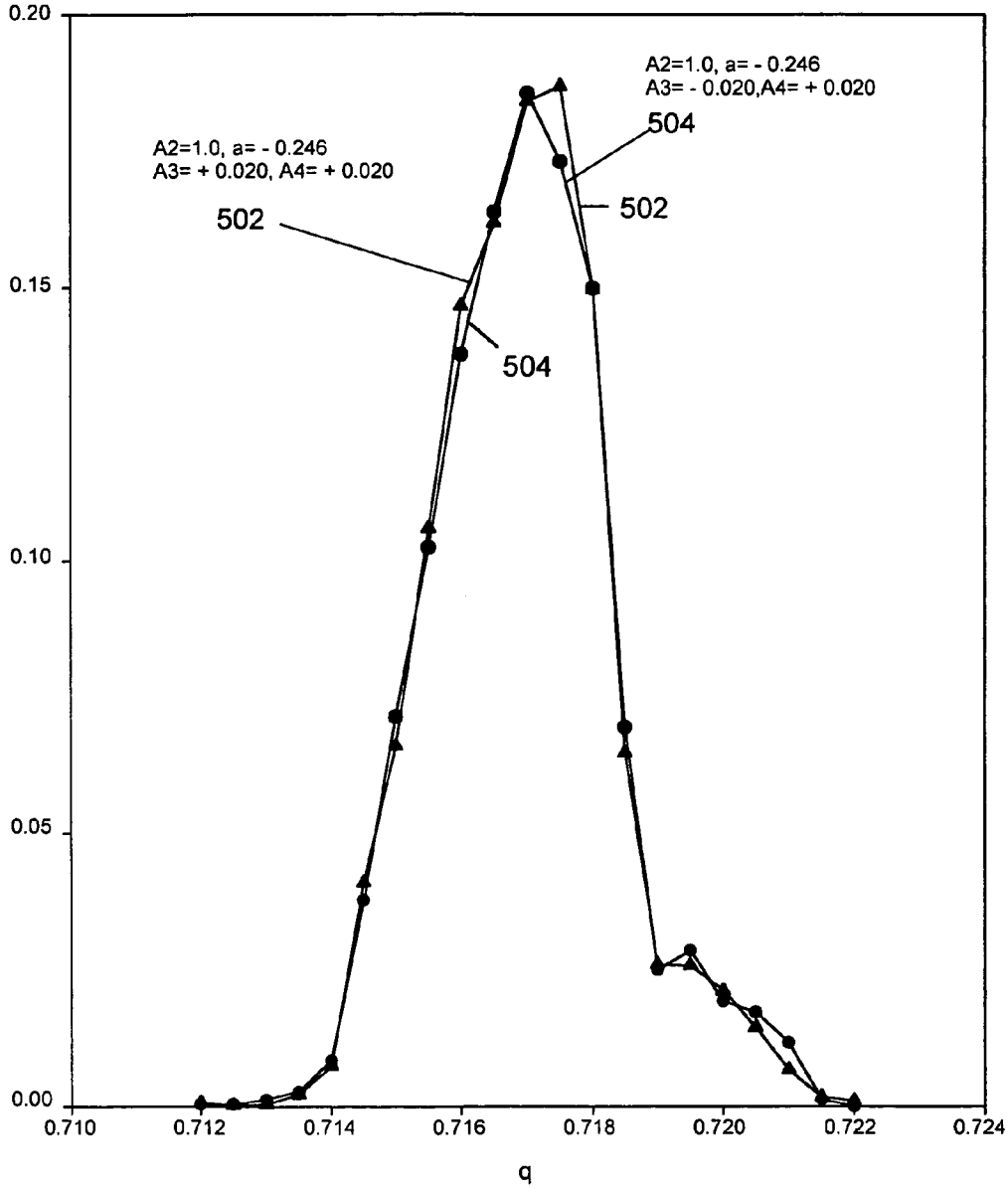
FIG. 30 is a graph of ion transmission through mass filters with a quadrupole field having an added negative 2% hexapole, and added positive 2% octopole and a=−0.246, and through a quadrupole field with an added positive 2% hexapole, and added positive 2% octopole and a=−0.246.

FIG. 30 shows two peak shapes 502 and 504. Both of peak shapes 502 and 504 are for positive ions. For peak shape 502, $A_2$=+1.0, $A_3$=+0.020, $A_4$=+0.020 and a=−0.246. For peak shape 504, $A_2$=+1.0, $A_4$=+0.02, a=−0.246 and $A_3$=−0.020. As expected the peak shape is the same for positive and negative $A_3$ and in both cases the peak shape and transmission are improved over the split peak that is formed without the addition of the hexapole component (FIG. 29, peak 498).

Figure 31:
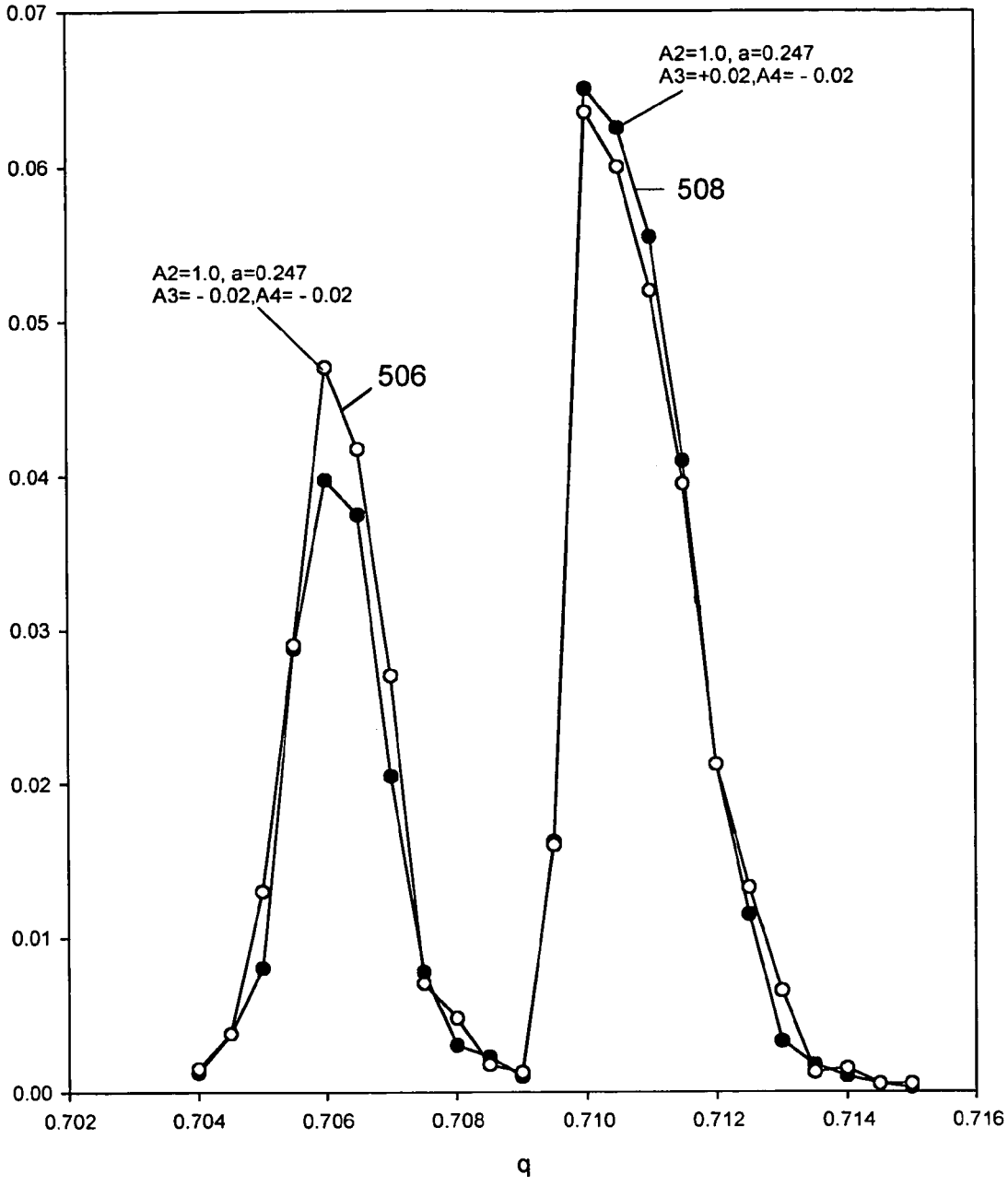
FIG. 31 is a graph of ion transmission through mass filters with a quadrupole field having an added positive 2% hexapole, and added negative 2% octopole and a=0.247, and with a quadrupole field with an added negative 2% hexapole, and added negative 2% octopole and a=0.247.

FIG. 31 shows peak shapes 506 and 508 for positive ions, both of which are badly split. For peak shape 506, $A_2$=1.0, $A_4$=−0.02, $A_3$=−0.02 and a=+0.247. For peak shape 508, $A_2$=1.0, $A_4$=−0.02, $A_3$=+0.02 and a=+0.247. In the absence of a hexapole field, there is a badly split peak that is equivalent to the case where $A_2$=1, $A_4$=+0.02 a=−0.246 (FIG. 30). When the hexapole is added, it is no longer equivalent to the case of FIG. 30. A different field is produced and a badly split peak remains. However positive and negative $A_3$ still give equivalent peak shapes.

Figure 32:
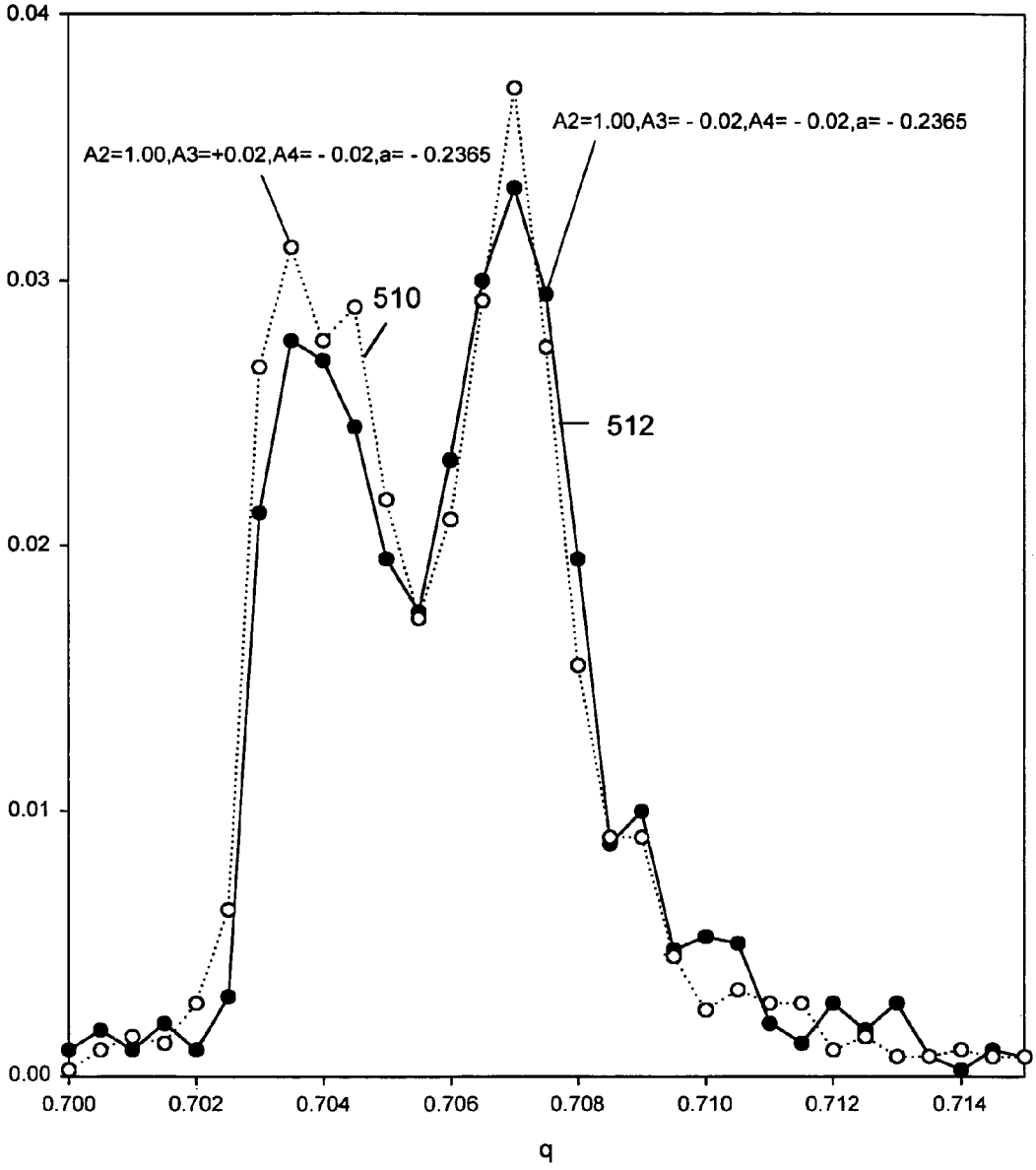
FIG. 32 is a graph of ion transmission through mass filters with a quadrupole field having an added positive 2% hexapole and added negative 2% octopole and a=−0.2365, and a quadrupole field with an added negative 2% hexapole and added negative 2% octopole and a=−0.2365; and, FIG. 33 is a graph of ion transmission through mass filters with a quadrupole field having a=0.2365 and an added 2% hexadecapole, and a pure quadrupole field with a=0.237.

FIG. 32 shows peak shape 510 and peak shape 512 for positive ions. For peak shape 510, $A_2$=1.00, $A_4$=−0.020, a=−0.2365 and $A_3$=+0.02. For peak shape 512, $A_2$=1.00, $A_4$=−0.020, a=−0.2365 and $A_3$=−0.02. In the absence of a hexapole field these correspond to case (4) above, which produces good peak shape and resolution. Adding a hexapole field cause the peak to split and poor resolution is obtained.

The results of FIGS. 27 to 32 can be summarized as follows:

| FIG. | $A_2$ | $A_4$ | α | $A_3$ | Peak without $A_3$ | Peak with $A_3$ |
|---|---|---|---|---|---|---|
| 27 | 1 | +0.020 | +0.2365 | 0 | good | |
| 28 | 1 | +0.020 | +0.2365 | ±0.020 | good | Good, improved transmission |
| 29 | 1 | +0.020 | −0.2460 | +0.020 | split | good |
| 30 | 1 | +0.020 | −0.2460 | ±0.020 | split | good |
| 31 | 1 | −0.020 | +0.2470 | ±0.020 | split | split |
| 32 | 1 | −0.020 | −0.2360 | ±0.020 | good | split |

As discussed, the sign of $A_3$ does not affect the peak shape. The four possibilities are shown in FIGS. 28 ($A_4$,a)=(+,+), 30 ($A_4$,a)=(+,−), 31 ($A_4$,a) =(−,+) and 32 ($A_4$,a)=(−,−). It can be seen that when a hexapole component is added, good peak shape is obtained only when $A_2$ and $A_4$ have the same sign, regardless of the sign of a.

The data in FIGS. 27 to 32 can also be summarized by considering the effect of adding an octopole field to a system that has an added hexapole field, as follows:

| FIG. | $A_2$ | $A_4$ | α | $A_3$ | Peak without $A_4$ | Peak with $A_4$ |
|---|---|---|---|---|---|---|
| 27 | 1 | +0.020 | +0.2365 | 0 | good | |
| 28 | 1 | +0.020 | +0.2365 | ±0.020 | good | good |
| 29 | 1 | +0.020 | −0.246 | +0.020 | poor | good |
| 30 | 1 | +0.020 | −0.246 | ±0.020 | poor | good |
| 31 | 1 | −0.020 | +0.247 | ±0.020 | good | split |
| 32 | 1 | −0.020 | −0.236 | ±0.020 | poor | split |

With positive ions, when there is a hexapole present good peak shape and transmission can be obtained provided the positive DC is applied to the X rods (a>0), as described. If the positive DC is applied to the Y rods (a<0), the transmission and resolution are poor. However, if the positive DC is applied to the Y rods and if a positive octopole component is added to the field (FIG. 30) good peak shape and transmission are restored. If a negative octopole component is added (FIG. 32) a badly split peak is produced.

Figure 33:
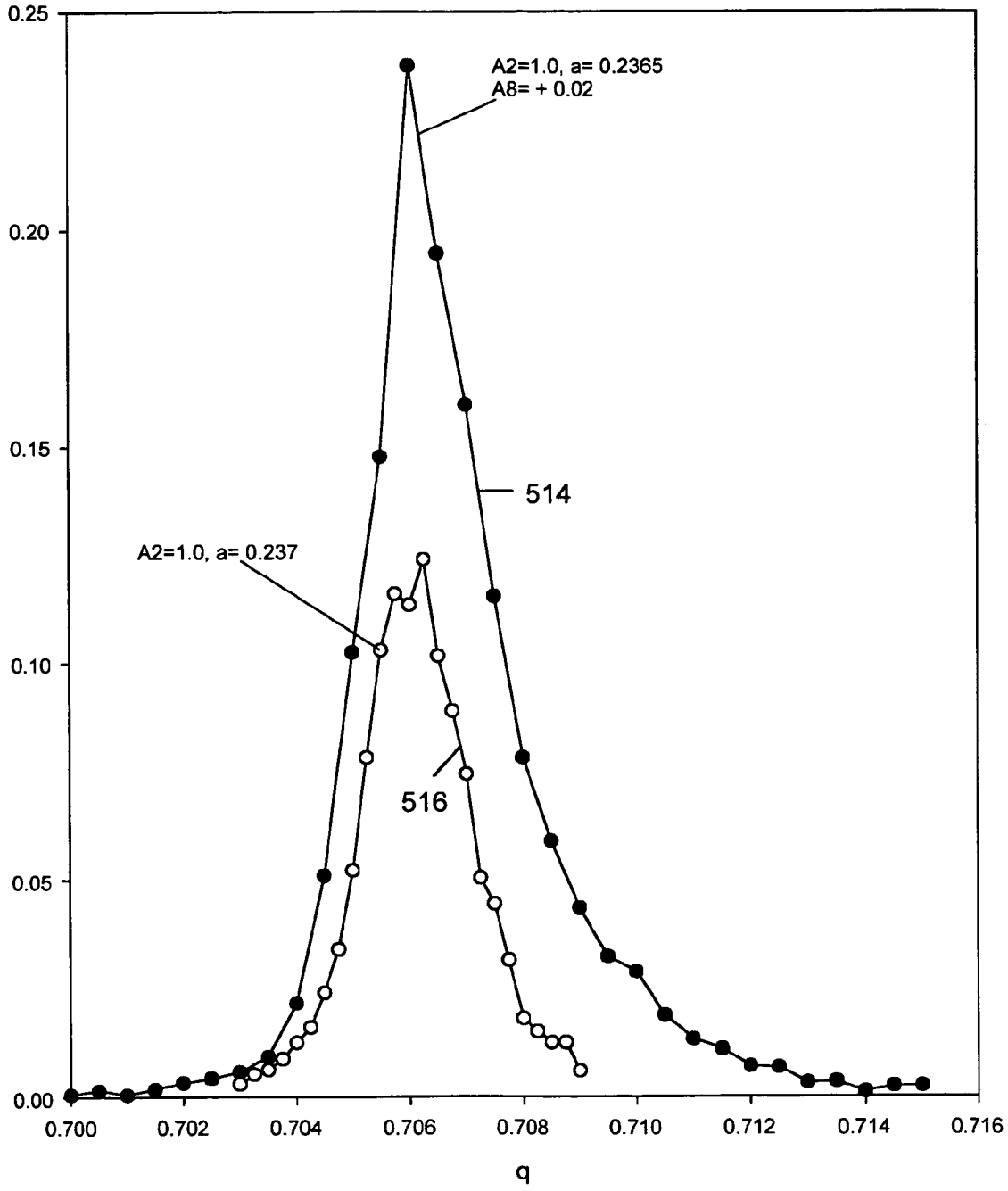

The operation of a mass filter can be improved by addition of still higher multipole fields. For example, FIG. 33 shows the peak shapes 516 and 514 obtained with a pure quadrupole field and with a quadrupole field with an added hexadecapole field (n=8) respectively. Addition of the 16-pole field increases the transmission by about a factor of four for the same resolution.

Figure 2:
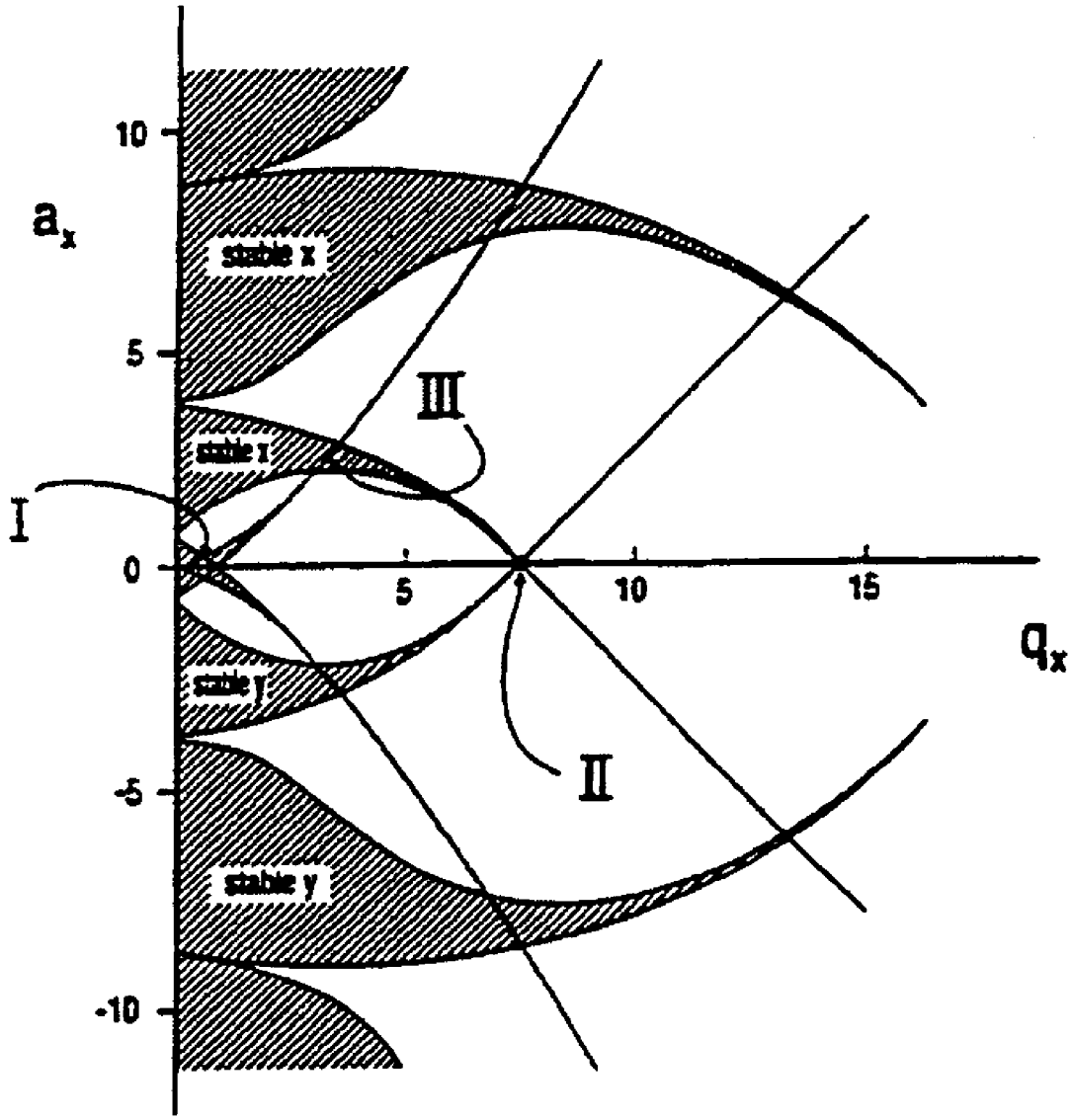
FIG. 2 shows a conventional stability diagram with different stability regions for a quadrupole mass spectrometer.

Other variations and modifications of the invention used with axial ejection are possible. For example the rod set may be used as an ion trap for mass selective axial ejection combined with another ion trap to improve the duty cycle as shown in FIG. 2 of U.S. Pat. No. 6,177,668. The rod set with axial ejection may also be operated at lower pressure such as $2\times10^{-5}$ torr, as shown in FIG. 4 of U.S. Pat. No. 6,177,668. In addition the rod set with axial ejection may be used as a collision cell to produce fragment ions, followed by axial ejection of the fragment ions for mass analysis. Fragment ions may be formed by injecting ions at relatively high energy to cause fragmentation with a background gas or by resonant excitation of ions within the rod set. In some cases it is desirable to operate the same rod set used for axial ejection as a mass filter with mass selection of ions at the tip of the stability diagram (J. Hager, "A New Linear Ion Trap Mass Spectrometer", *Rapid Communications in Mass Spectrometry,* 2002, Vol. 16, 512). Rod sets with added hexapole fields can be operated as mass filters as described above.

While the foregoing discussion has dealt with cylindrical rods and exact geometry rods, it will be appreciated by those skilled in the art that the invention may also be implemented using other rod configurations. Also, the rods could be constructed of wires, as described, for example, in U.S. Pat. No. 4,328,420. Also, while the foregoing has been described with respect to quadrupole systems having straight central axes, it will be appreciated by those skilled in the art that the invention may also be implemented using quadrupole electrode systems having curved central axes. All such modifications or variations are believed to be within the sphere and scope of the invention as defined by the claims appended here.

The invention claimed is:

1. A quadrupole electrode system for connection to a voltage supply means for providing an at least partially-AC potential difference within the quadrupole electrode system, the quadrupole electrode system comprising:

(a) a quadrupole axis;

(b) a first pair of rods, wherein each rod in the first pair of rods is spaced from and extends alongside the quadrupole axis;

(c) a second pair of rods, wherein each rod in the second pair of rods is spaced from and extends alongside the quadrupole axis; and (d) a voltage connection means for connecting at least one pair of the first pair of rods and the second pair of rods to the voltage supply means to provide the at least partially-AC potential difference between the first pair of rods and the second pair of rods;

such that in use the first pair of rods and the second pair of rods are operable, when the at least partially-AC potential difference is provided by the voltage supply means and the voltage connection means to at least one of the first pair of rods and the second pair of rods, to generate a two-dimensional substantially quadrupole field having a quadrupole harmonic with amplitude $A_2$ and a hexapole harmonic with amplitude $A_3$ wherein the magnitude of $A_3$ is greater than 0.1% of the magnitude of $A_2$.

2. The quadrupole electrode system as defined in claim 1 wherein the second pair of rods is closer to one rod in the first pair of rods than to the other rod in the first pair of rods.

3. The quadrupole electrode system as defined in claim 2 wherein the rods of the second pair of rods are closer together than the rods of the first pair of rods.

4. The quadrupole electrode system as defined in claim 3 wherein all of the rods are equidistant from the quadrupole axis.

5. A linear ion trap for manipulating ions, the linear ion trap comprising the quadrupole electrode system as defined in claim 1, and stopping electrodes at each end of the quadrupole electrode system for providing stopping potentials at each end of the quadrupole electrode system.

6. The linear ion trap as defined in claim 5 wherein the magnitude of $A_3$ is greater than 1% and is less than 10% of the magnitude of $A_2$.

7. The linear ion trap as defined in claim 5, wherein the voltage supply means comprises a first voltage source for supplying a first at least partially-AC voltage to the first pair of rods and a second voltage source for supplying a second at least partially-AC voltage to the second pair of rods; and, the voltage connection means comprises a first voltage connection means for connecting the first pair of rods to the first voltage source, and a second voltage connection means for connecting the second pair of rods to the second voltage source.

8. The linear ion trap as defined in claim 5, further comprising the voltage supply means, wherein the two-dimensional substantially quadrupole field includes a dipole harmonic with amplitude $A_1$;

the voltage supply means comprises a first voltage source for, for each rod in the first pair of rods, supplying an associated first at least partially-AC voltage to that rod, and a second voltage source for supplying a second at least partially-AC voltage to the second pair of rods;

the associated first at least partially-AC voltage for one rod in the first pair of rods is selected relative to the associated first at least partially-AC voltage for the other rod in the first pair of rods to reduce $A_1$ relative to $A_3$; and, the voltage connection means comprises a first voltage connection means for connecting each rod in the first pair of rods to the first voltage source, and a second voltage connection means for connecting each rod in the second pair of rods to the second voltage source.

9. A mass filter mass spectrometer for selecting ions, the mass spectrometer comprising:

the quadrupole electrode system as defined in claim 1;

the voltage supply means for providing the at least partially-AC potential difference to the quadrupole electrode system; and, ion introduction means for injecting ions between the first pair of rods and the second pair of rods at an ion introduction end of the first pair of rods and the second pair of rods.

10. The mass filter mass spectrometer as defined in claim 9 wherein in the quadrupole electrode system the second pair of rods is closer to one rod in the first pair of rods than to the other rod in the first pair of rods.

11. The mass filter mass spectrometer system as defined in claim 10 wherein in the quadrupole electrode system the rods of the second pair of rods are closer together than the rods of the first pair of rods.

12. The mass filter mass spectrometer as defined in claim 11 wherein in the quadrupole electrode system all of the rods are equidistant from the quadrupole axis.

13. The mass spectrometer as defined in claim 10 wherein the voltage supply means is operable to provide a selected positive DC voltage to the first pair of rods relative to the second pair of rods for selection of positive ions; and, a selected negative DC voltage to the first pair of rods relative to the second pair of rods for selection of negative ions.

14. The mass spectrometer as defined in claim 13 wherein a ratio of the at least partially-AC potential difference and the selected positive DC voltage is selectable to select resolution.

15. The mass spectrometer as defined in claim 11 wherein the magnitude of $A_3$ is greater than 1% and is less than 10% of the magnitude of $A_2$.

16. The mass spectrometer as defined in claim 10, wherein the voltage supply means comprises a first voltage source for supplying a first at least partially-AC voltage to the first pair of rods and a second voltage source for supplying a second at least partially-AC voltage to the second pair of rods; and, the voltage connection means comprises a first voltage connection means for connecting each rod in the first pair of rods to the first voltage source, and a second voltage connection means for connecting each rod in the second pair of rods to the second voltage source.

17. The mass spectrometer as defined in claim 10, wherein the two-dimensional substantially quadrupole field includes a dipole harmonic with amplitude $A_1$;

the voltage supply means comprises a first voltage source for, for each rod in the first pair of rods, supplying an associated first at least partially-AC voltage to that rod, and a second voltage source for supplying a second at least partially-AC voltage to the second pair of rods;

the associated first at least partially-AC voltage for each rod in the first pair of rods is selected relative to the associated first at least partially-AC voltage for the other rod in the first pair of rods to reduce the magnitude of $A_1$ relative to the magnitude of $A_3$; and, the voltage connection means comprises a first voltage connection means for connecting each rod in the first pair of rods to the first voltage source, and a second voltage connection means for connecting each rod in the second pair of rods to the second voltage source.

18. The mass spectrometer as defined in claim 13, wherein the two-dimensional substantially quadrupole field has a dipole harmonic with amplitude $A_1$, and the voltage supply means is operable to supply different at least partially-AC voltages to each rod in the first pair of rods to reduce the magnitude of $A_1$.

19. A method of processing ions in a quadrupole rod set, the method comprising establishing and maintaining a two-dimensional substantially quadrupole field for processing ions, the field having a quadrupole harmonic with amplitude $A_2$ and a hexapole harmonic with amplitude $A_3$ wherein the magnitude of $A_3$ is greater than 0.1% of the magnitude of $A_2$; and, introducing ions to the field and subjecting the ions to both a quadrupole component and a hexapole component of the field.

20. The method as defined in claim 19 further comprising selecting the field to impart stable trajectories to ions within a selected range of mass to charge ratios to retain such ions in the rod set for transmission through the rod set, and to impart unstable trajectories to ions outside of the selected range of mass to charge rations to filter out such ions.

21. The method as defined in claim 20 further comprising detecting ions within the selected range of mass to charge ratios at an ion detection end of the field.

22. The method as defined in claim 20 wherein the magnitude of $A_3$ is greater than 1% and is less than 10% of the magnitude of $A_2$.

23. The method as defined in claim 20 wherein the quadrupole mass filter comprises (a) a quadrupole axis;

(b) a first pair of rods, wherein each rod in the first pair of rods is spaced from and extends alongside the quadrupole axis;

(c) a second pair of rods, wherein each rod in the second pair of rods is spaced from and extends alongside the quadrupole axis; and (d) a voltage connection means for connecting at least one of the first pair of rods and the second pair of rods to the voltage supply means to provide an at least partially-AC potential difference between the first pair of rods and the second pair of rods.

24. The method as defined in claim 23 wherein the method further comprises selecting a selected positive DC voltage provided by voltage connection means to each rod in the first pair of rods relative to each rod in the second pair of rods for selection of positive ions; and, selecting a selected negative DC voltage provided by voltage connection means to the first pair of rods relative to the second pair of rods for selection of negative ions.

25. The method as defined in claim 24 wherein the method further comprises selecting a ratio of the at least partially-AC potential difference and the selected positive DC voltage to select resolution.

26. A method of increasing average kinetic energy of ions in a two-dimensional ion trap mass spectrometer, the method comprising (a) establishing and maintaining a two-dimensional substantially quadrupole field to trap ions within a selected range of mass to charge ratios wherein the field has a quadrupole harmonic with amplitude $A_2$ and a hexapole harmonic with amplitude $A_3$, wherein the magnitude of $A_3$ is greater than 0.1% of the magnitude of $A_2$;

(b) trapping ions within the selected range of mass to charge ratios; and (c) adding an excitation field to the field to increase the average kinetic energy of trapped ions within a first selected sub-range of mass to charge ratios, wherein the first selected sub-range of mass to charge ratios is within the selected range of mass to charge ratios.

27. The method as defined in claim 26 wherein the magnitude of $A_3$ is greater than 1% and is less than 10% of the magnitude of $A_2$.

28. The method as defined in claim 26 wherein step (a) comprises supplying a voltage $V_1$ to each rod in a first pair of rods, the voltage $V_1$ being at least partially-AC; and supplying a voltage $V_2$ to each rod in a second pair of rods, the voltage $V_2$ being at least partially-AC;

wherein the first pair of rods and the second pair of rods surround a quadrupole axis of the field and extend substantially parallel to the quadrupole axis.

29. The method as defined in claim 26 further comprising increasing the excitation field to impart unstable trajectories to trapped ions within a second selected sub-range of mass to charge ratios, wherein the second selected sub-range of mass to charge ratios is within the selected range of mass to charge ratios and the ions having unstable trajectories are ejected from the ion trap; and, detecting the ions having unstable trajectories as the ions leave the ion trap.

30. The method as defined in claim 26 further comprising:

providing a collision gas to the two-dimensional ion trap mass spectrometer, and adding the excitation field to fragment the trapped ions.

31. A method of manufacturing a quadrupole electrode system for connection to a voltage supply means for providing an at least partially-AC potential difference within the quadrupole electrode system to generate a two-dimensional substantially quadrupole field for manipulating ions, the method comprising the steps of:

(a) determining a selected hexapole component to be included in the field;

(b) installing a first pair of rods;

(c) installing a second pair of rods substantially parallel to the first pair of rods, and (d) configuring the first pair of rods and the second pair of rods to provide the field with the selected hexapole component.

32. The method as defined in claim 31 wherein step (d) comprises providing a selected shape to each rod to provide the field with the selected hexapole component.

33. The method as defined in claim 31 wherein step (d) comprises locating each rod in the second pair of rods closer to one rod in the first pair of rods than to the other rod in the first pair of rods to provide the field with the selected hexapole component.

34. The quadrupole electrode system as defined in claim 33 wherein the rods of the second pair of rods are closer together than the rods of the first pair of rods.

35. The quadrupole electrode system as defined in claim 34 wherein all of the rods are equidistant from the quadrupole axis.

36. A method of operating a mass spectrometer having an elongated rod set, said rod set having an entrance end and an exit end and a longitudinal axis, said method comprising:

(a) admitting ions into said entrance end of said rod set, (b) trapping at least some of said ions in said rod set by producing a barrier field at an exit member adjacent to the exit end of said rod set and by producing an AC field between the rods of said rod set adjacent at least the exit end of said rod set, (c) said AC and barrier fields interacting in an extraction region adjacent to said exit end of said rod set to produce a fringing field, and (d) energizing ions in said extraction region to mass selectively eject at least some ions of a selected mass to charge ratio axially from said rod set past said barrier field, wherein said AC field is a two-dimensional substantially quadrupole field having a quadrupole harmonic with amplitude $A_2$ and a hexapole harmonic with amplitude $A_3$, wherein the magnitude of $A_3$ is greater than 0.1% of the magnitude of $A_2$.

37. The method as defined in claim 36 wherein the magnitude of $A_3$ is greater than 1% and is less than 10% of the magnitude of $A_2$.

38. The method as defined in claim 36 further comprising detecting at least some of the axially ejected ions.

39. The method as defined in claim 36 wherein the rod set comprises:

(i) a quadrupole axis;

(ii) a first pair of rods, wherein each rod in the first pair of rods is spaced from and extends alongside the quadrupole axis;

(iii) a second pair of rods, wherein each rod in the second pair of rods is spaced from and extends alongside the quadrupole axis; the first pair of rods and the second pair of rods being oriented such that at any point along the quadrupole axis each rod in the second pair of rods is closer to one rod in the first pair of rods than to the other rod in the first pair of rods.

40. The method as defined in claim 39, further comprising a plurality of modes of operation, wherein each mode of operation comprises a trapping voltage sub-mode selected from a plurality of trapping voltage sub-modes, a DC voltage sub-mode selected from a plurality of DC voltage sub-modes, and, an excitation sub-mode selected from a plurality of excitation sub-modes.

41. The method as defined in claim 40 wherein step (b) comprises producing the AC field between the rods of said rod set by applying a first AC voltage to the first pair of rods and a second AC voltage to the second pair of rods; and, the plurality of trapping voltage sub-modes is selected from the group comprising (i) an AC balanced sub-mode wherein an amplitude of the first AC voltage equals an amplitude of the second AC voltage, (ii) a first AC unbalanced sub-mode wherein the amplitude of the first AC voltage exceeds the amplitude of the second AC voltage, and (iii) a second AC unbalanced sub-mode wherein the amplitude of the first AC voltage is less than the amplitude of the second AC voltage.

42. The method as defined in claim 40 wherein the plurality of DC voltage sub-modes is selected from the group comprising, (i) a first DC sub-mode wherein a first positive DC voltage is applied to the first rod pair relative to the second rod pair, (ii) a second DC sub-mode wherein a second positive DC voltage is applied to the second rod pair relative to the first rod pair; and, (iii) a zero DC sub-mode wherein zero DC voltage is applied between the first rod pair and the second rod pair.

43. The method as defined in claim 40 wherein the plurality of excitation sub-modes is selected to be one or more of the group comprising (i) a first excitation sub-mode comprising providing an exit auxiliary AC voltage to the exit member, (ii) a second excitation sub-mode comprising providing a first dipole excitation AC voltage between the first pair of rods; (iii) a third excitation sub-mode comprising providing a second dipole excitation AC voltage between the second pair of rods; (iv) a fourth excitation sub-mode comprising providing a quadrupole excitation AC voltage between the first pair of rods and the second pair of rods; (v) a fifth excitation sub-mode comprising providing an exit auxiliary AC voltage to the exit member and providing the first dipole excitation AC voltage between the first pair of rods, (vi) a sixth excitation sub-mode comprising providing the exit auxiliary AC voltage to the exit member and providing the second dipole excitation AC voltage between the second pair of rods; (vii) a seventh excitation sub-mode comprising providing the exit auxiliary AC voltage to the exit member and providing an auxiliary quadrupole excitation AC voltage between the first pair of rods and the second pair of rods; (viii) an eighth excitation sub-mode comprising providing the first dipole excitation AC voltage between the first pair of rods and providing the second dipole excitation AC voltage between the second pair of rods; and, (ix) a ninth excitation sub-mode comprising providing the exit auxiliary AC voltage to the exit member, providing the first dipole excitation AC voltage between the first pair of rods and providing the second dipole excitation AC voltage between the second pair of rods.

44. The method as defined in claim 40 wherein step (d) comprises scanning the amplitude of the AC field to bring the at least some ions into resonance with at least one excitation field generated by the excitation sub-mode selected from the plurality of excitation sub-modes.

45. A mass spectrometer system comprising:

(a) an ion source;

(b) a main rod set having an entrance end for admitting ions from the ion source and an exit end for ejecting ions traversing a longitudinal axis of the main rod set;

(c) an exit member adjacent to the exit end of the main rod set;

(d) power supply means coupled to the main rod set and the exit member for producing an AC field between rods of the main rod set and a barrier field at the exit end, whereby in use (i) at least some of the ions admitted in the main rod set are trapped within the rods and (ii) the interaction of the AC and barrier fields products a fringing field adjacent to the exit end; and (e) an AC voltage source coupled to one of: the rods of the main rod set and the exit member, whereby at least one of the AC voltage source and the power supply means mass dependently and axially ejects ions trapped in the vicinity of the fringing field from the exit end;

wherein said AC field is a two-dimensional substantially quadrupole field having a quadrupole harmonic with amplitude $A_2$ and a hexapole harmonic with amplitude $A_3$, wherein the magnitude of $A_3$ is greater than 0.1% of the magnitude of $A_2$.

46. The mass spectrometer system as defined in claim 45 wherein the magnitude of $A_3$ is greater than 1% and is less than 10% of the magnitude of $A_2$.

47. The mass spectrometer system as defined in claim 45 further comprising a detector for detecting at least some of the axially ejected ions.

48. The mass spectrometer system as defined in claim 45 wherein the rod set comprises:

(a) a quadrupole axis;

(b) a first pair of rods, wherein each rod in the first pair of rods is spaced from and extends alongside the quadrupole axis;

(c) a second pair of rods, wherein each rod in the second pair of rods is spaced from and extends alongside the quadrupole axis; the first pair of rods and the second pair of rods being oriented such that at any point along the quadrupole axis the second pair of rods is closer to one rod in the first pair of rods than to the other rod in the first pair of rods.

49. The mass spectrometer system as defined in claim 48 wherein the power supply comprises a first AC voltage supply means for supplying a first AC voltage to the first pair of rods, and a second AC voltage supply means for supplying a second AC voltage to the second pair of rods to produce the AC field between the rods.

50. The mass spectrometer system as defined in claim 49 further comprising a mode selection means for selecting the selected mode of operation from a plurality of modes of operation, wherein each mode of operation comprises a trapping voltage sub-mode selected from a plurality of trapping voltage sub-modes, a selected DC voltage sub-mode selected from a plurality of DC voltage sub-modes, and, a selected excitation sub-mode selected from a plurality of excitation sub-modes.

51. The mass spectrometer system as defined in claim 50 wherein the mode selection means comprises a trapping voltage sub-mode selection means for selecting the selected trapping voltage sub-mode from the plurality of trapping voltage sub-modes; and the plurality of trapping voltage sub-modes is selected from the group comprising (i) an AC balanced sub-mode wherein the amplitude of the first AC voltage equals an amplitude of the second AC voltage, (ii) a first AC unbalanced sub-mode wherein the amplitude of the first AC voltage exceeds the amplitude of the second AC voltage, and (iii) a second AC unbalanced sub-mode wherein the amplitude of the first AC voltage is less than the amplitude of the second AC voltage.

52. The mass spectrometer system as defined in claim 50 wherein the mode selection means comprises a DC voltage sub-mode selection means for selecting the selected DC voltage sub-mode from the plurality of DC voltage sub-modes; and the plurality of DC voltage sub-modes is selected from the group comprising (i) a first DC sub-mode wherein a first positive DC voltage is applied to the first rod pair relative to the second rod pair, (ii) a second DC sub-mode wherein a second positive DC voltage is applied to the second rod pair relative to the first rod pair; and, (iii) a zero DC sub-mode wherein zero DC voltage is applied between the first rod pair and the second rod pair.

53. The mass spectrometer system as defined in claim 50 wherein the mode selection means comprises an excitation sub-mode selection means for selecting an excitation voltage sub-mode from the plurality of excitation sub-modes; and the plurality of excitation sub-modes is selected to be one or more of the group comprising (i) a first excitation sub-mode comprising providing an exit auxiliary AC voltage to the exit member, (ii) a second excitation sub-mode comprising providing a first dipole excitation AC voltage between the first pair of rods; (iii) a third excitation sub-mode comprising providing a second dipole excitation AC voltage between the second pair of rods; (iv) a fourth excitation sub-mode comprising providing a quadrupole excitation AC voltage between the first pair of rods and the second pair of rods; (v) a fifth excitation sub-mode comprising providing an exit auxiliary AC voltage to the exit member and providing the first dipole excitation AC voltage between the first pair of rods, (vi) a sixth excitation sub-mode comprising providing the exit auxiliary AC voltage to the exit member and providing the second dipole excitation AC voltage between the second pair of rods; (vii) a seventh excitation sub-mode comprising providing the exit auxiliary AC voltage to the exit member and providing an auxiliary quadrupole excitation AC voltage between the first pair of rods and the second pair of rods; (viii) an eighth excitation sub-mode comprising providing the first dipole excitation AC voltage between the first pair of rods and providing the second dipole excitation AC voltage between the second pair of rods; and, (ix) a ninth excitation sub-mode comprising providing the exit auxiliary AC voltage to the exit member, providing the first dipole excitation AC voltage between the first pair of rods and providing the second dipole excitation AC voltage between the second pair of rods.

54. The quadrupole electrode system as defined in claim 1 wherein the two-dimensional substantially quadrupole field includes an octopole component with amplitude $A_4$, wherein the magnitude of $A_4$ is greater than 0.1% of the magnitude of $A_2$.

55. The method as defined in claim 19, wherein the two-dimensional substantially quadrupole field includes an octopole harmonic with amplitude $A_4$ wherein the magnitude of $A_4$ is greater than 0.1% of the magnitude of $A_2$.

56. The method as defined in claim 26, wherein the two-dimensional substantially quadrupole field includes an octopole harmonic with amplitude $A_4$ wherein the magnitude of $A_4$ is greater than 0.1% of the magnitude of $A_2$.

57. The method as defined in claim 31, wherein step (a) comprises determining a selected octopole component to be included in the field; and, step (d) comprises configuring the first pair of rods and the second pair of rods to provide the field with the selected octopole component.

58. The method as defined in claim 36, wherein the two-dimensional substantially quadrupole field includes an octopole harmonic with amplitude $A_4$, wherein the magnitude of $A_4$ is greater than 0.1% of the magnitude of $A_2$.

59. The mass spectrometer system as defined in claim 45, wherein the two-dimensional substantially quadrupole field includes an octopole harmonic with amplitude $A_4$, wherein the magnitude of $A_4$ is greater than 0.1% of the magnitude of $A_2$.

60. The quadrupole electrode system as defined in claim 1 wherein the first pair of rods and the second pair of rods are substantially circular in cross-section.

61. The mass spectrometer system as defined in claim 45 wherein the first pair of rods and the second pair of rods are substantially circular in cross-section.

62. The mass spectrometer system as defined in claim 48 wherein all of the rods are equidistant from the quadrupole axis.

* * * * *

UNITED STATES PATENT AND TRADEMARK OFFICE

CERTIFICATE OF CORRECTION

PATENT NO. : 7,141,789 B2
APPLICATION NO. : 10/943069
DATED : November 28, 2006
INVENTOR(S) : D.J. Douglas et al.

It is certified that error appears in the above-identified patent and that said Letters Patent is hereby corrected as shown below:

Title Page item 73

The Assignee, which appears as

MDS Inc., Concord (CA), should read as follows:

MDS Inc., Concord (CA) and The University of British Columbia, Vancouver (CA)

Signed and Sealed this

Twenty-seventh Day of May, 2008

JON W. DUDAS
*Director of the United States Patent and Trademark Office*